US005142300A

United States Patent [19]

Aoki

[11] Patent Number: 5,142,300

[45] Date of Patent: Aug. 25, 1992

[54] RECORDING HEAD FOR USE IN HALF-TONE RECORDING

[75] Inventor: Makoto Aoki, Yokohama, Japan

[73] Assignee: Canon Kabushiki Kaisha, Tokyo, Japan

[21] Appl. No.: 711,388

[22] Filed: Jun. 6, 1991

Related U.S. Application Data

[63] Continuation of Ser. No. 442,504, Nov. 28, 1989, abandoned.

[30] Foreign Application Priority Data

| | | | |
|---|---|---|---|
| Nov. 28, 1988 | [JP] | Japan | 63-298290 |
| Dec. 23, 1988 | [JP] | Japan | 63-323748 |
| Dec. 26, 1988 | [JP] | Japan | 63-326332 |
| Dec. 26, 1988 | [JP] | Japan | 63-326333 |
| Mar. 8, 1989 | [JP] | Japan | 1-053617 |
| Apr. 18, 1989 | [JP] | Japan | 1-096509 |

[51] Int. Cl.[5] ..... B41J 2/335; B41J 2/05

[52] U.S. Cl. ..... 346/76 PH; 338/333; 346/140 R

[58] Field of Search ..... 346/76 PH, 140 R; 358/298; 338/333

[56] References Cited

U.S. PATENT DOCUMENTS

| | | | |
|---|---|---|---|
| 4,339,762 | 7/1982 | Shirato | 346/140 |
| 4,510,507 | 4/1985 | Ishikawa | 346/76 PH |
| 4,514,741 | 4/1985 | Meyer | 346/140 |
| 4,558,331 | 12/1985 | Adkisson | 346/76 PH |
| 4,590,489 | 5/1986 | Tsumura | 346/76 PH |
| 4,591,876 | 5/1986 | Nozaki et al. | 346/76 PH |
| 4,623,903 | 11/1986 | Hashimoto | 346/76 PH |
| 4,630,073 | 12/1986 | Hashimoto | 346/76 PH |
| 4,712,930 | 12/1987 | Maruno | 346/76 PH X |

FOREIGN PATENT DOCUMENTS

| | | |
|---|---|---|
| 171669 | 9/1984 | Japan . |
| 135766 | 6/1986 | Japan . |
| 63-54261 | 3/1988 | Japan . |

*Primary Examiner*—Joseph W. Hartary

*Attorney, Agent, or Firm*—Fitzpatrick, Cella, Harper & Scinto

[57] ABSTRACT

In a recording head for use in a recording apparatus for effecting recording on a recording medium, having a plurality of heat generating elements and electrodes for applying energy to the heat generating elements, when the effective width of the heat generating elements is Wr and the width of the electrodes connected to the heat generating elements is We, $1/10 \leqq We/Wr \leqq \frac{1}{2}$, and when the length, in the direction of an electric current, of the portion of the heat generating elements in which the current distribution becomes roughest and the portion of the heat generating elements in which the current distribution becomes finest is L, the condition that $\frac{1}{4} \leqq L/Wr \leqq 3/2$ is satisfied wherein the junctions between said heat generating elements and said electrodes overlap each other.

32 Claims, 40 Drawing Sheets

RECORDING HEAD FOR USE IN HALF-TONE RECORDING

This application is a continuation of application Ser. No. 07/442,504 filed on Nov. 28, 1989, now abandoned.

BACKGROUND OF THE INVENTION

1. Field of the Invention

This invention relates to a recording head capable of accomplishing half tone expression in effecting recording on a recording medium and a recording apparatus provided with such recording head.

The term "recording apparatus" covers a printer, a facsimile apparatus, a copying apparatus, a word processor, an electronic typewriter, etc.

2. Related Background Art

A recording apparatus such as a printer or a facsimile apparatus is such that a dot pattern is formed on a recording sheet (a recording medium such as recording paper or a plastic sheet) while a plurality of dot forming elements provided on a recording head are selectively driven on the basis of recording information (image signals). As the types of such a recording apparatus, there are the serial type in which recording is effected while a recording head is moved widthwisely of a sheet, the line print type in which recording is effected collectively over a predetermined length in the direction of line, and the page print type in which recording is effected collectively for one page.

Also, the recording systems include the thermal system, the ink jet system, the wire dot system, etc. Of these, the thermal system can be classified into the heat transfer system in which ink is transferred to plain paper by the use of an ink sheet and the thermosensitive system in which thermosensitive paper is heated by a thermal head to cause color forming.

In these recording systems, a half tone recording method for expressing the density difference has heretofore been adopted during color recording or image recording using a plurality of colors such as cyan, magenta, yellow and black. In such conventional half tone recording, a method based on the principle of binary recording is generally adopted. As a technique for such harmonization expression, there has been adopted a technique of expressing half tone falsely by an area harmonization method such as the dither method in which with a plurality of dots as a unit, half tone is expressed by the rate of ON-OFF (two values) of the dots in the unit.

However, when the above-described area harmonization method is adopted, the number of dots necessary for one picture element increases in order to express many harmonies. This poses the problem that the resolution of image is reduced. To obtain an image of a resolution of the order of 6 picture elements/mm, for example, at 64 harmonies, by this area harmonization method, the resolution of the recording head need be of the order of 48 dots/mm. To realize this in a thermal printer, a thermal head of 48 dots/mm becomes necessary. However, the manufacture of a thermal head of such high density is difficult in the presentday technique. Even if such a thermal head could be manufactured, the number of elements will become huge and therefore, a large-scale driving circuit will become necessary for the driving of the thermal head, and this is not realistic. That is, in two-value recording, there is a limit in obtaining a harmony record of high image quality, and it has been desired that a multivalue harmony record expressing the size of a dot in multiple harmonies by some method or other be put into practical use.

Here, in the recording by heat melting transfer using a thermal head heretofore generally utilized, the density variation corresponding to a variation in applied energy is as shown in FIG. 9A of the accompanying drawings. That is, the rate of variation in the recording density to the applied energy $E_A$ is great, and the scattering width $S_W$ of the recording density $D_R$ is also great as indicated by the length of the vertical line in the graph. Therefore, it has been difficult to turn out intermediate density. In the prior-art thermal head shown in FIG. 9B of the accompanying drawings, a heat generating element 101 and electrodes 102 and 104 are of such a shape that they are of the same width and therefore, the distribution of an electric current flowing to the heat generating element 101 becomes uniform. The reference numeral 103 indicates the direction in which the electric current flows. Therefore, the temperature distribution of the heat generating element 101 is of such a degree that the temperature becomes somewhat high in the central portion of the heat generating element 101 wherein the amount of radiation is relatively small. Accordingly, even if the time of application of a pulse voltage applied to the signal electrode 104 is varied to thereby vary the temperature distribution of the heat generating element 101 as indicated by 111A and 112A (the time of application is 111A<112A) in FIG. 9B, whether the temperature of the heat generating element 101 becomes higher than the melting point Tm of heat transfer ink is very subtle depending on the position thereof. Accordingly, even if the same applied energy is applied to the heat generating element 101 as shown in FIG. 9A, the recording density will differ depending on a slight difference in the position of the heat generating element. Therefore, the heat transfer recording method using the prior-art thermal head could virtually accomplish only two-value or binary recording, and an improvement in the reproducibility of harmony has been desired.

So, the applicant has proposed a thermal head of capable of multivalue recording in Japanese Laid-Open Patent Application No. 63-54261 (filed in Japan on Aug. 26, 1986 and laid open on Mar. 8, 1988). According to this, the width of an electrode at the junction between the electrode and a heat generating element is made less than the effective recording width of the heat generating element. Thereby, in a heat generating member, particularly that portion of the heat generating member which is near the junction with the electrode is caused to generate heat concentratedly, whereby said portion can be endowed with a heat generation distribution. However, even with such a construction, there has been the undesirable possibility of sufficient harmonization being not obtained when recording is effected on recording paper whose surface is not smooth, and a thermal head and a recording apparatus which are more excellent in harmonization have been desired.

SUMMARY OF THE INVENTION

It is an object of the present invention to provide a recording head capable of obtaining clear-cut records and a recording apparatus provided with such recording head.

It is another object of the present invention to provide a recording head capable of obtaining records of good quality and a recording apparatus provided with such recording head.

It is still another object of the present invention to provide a recording head capable of half tone recording and a recording apparatus provided with such recording head.

It is yet still another object of the present invention to provide an inexpensive recording head in which the ratio of the width of an electrode to the width of a heat generating element and the ratio of the length of the heat generating element to the width of the heat generating element are made proper, whereby which is capable of multivalue recording and can easily realize recording at multiple harmonies, and a heat recording apparatus provided with such recording head.

It is a further object of the present invention to provide a thermal head which is formed so that there is created a difference in the density of an electric current flowing through a heat generating element and energy applied thereto is varied, whereby the distribution of generated heat can be easily changed.

It is still a further object of the present invention to provide a heat transfer recording apparatus which is made excellent in the reproducibility of harmony by changing the heat generating area of the thermal head thereof correspondingly to the degree of harmony of image data to thereby change the transfer area.

DESCRIPTION OF THE PREFERRED EMBODIMENTS

The following embodiments will be described with respect to a thermal recording system using a thermal head, whereas the present invention is not restricted thereto, but is also applicable to a recording system which effects image recording by the use of heat, such as the ink jet recording system in which ink liquid is discharged by the use of heat to thereby effect image recording.

DESCRIPTION OF FIRST EMBODIMENT (FIGS. 1-4)

Figure 1:
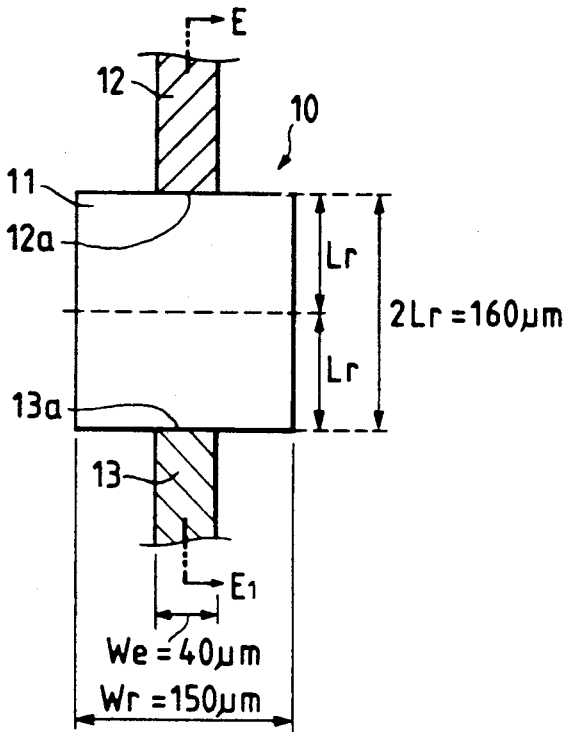
FIG. 1 shows the shapes of the heat generating element and the electrode portion of a thermal head according to a first embodiment of the present invention.
Figure 2:
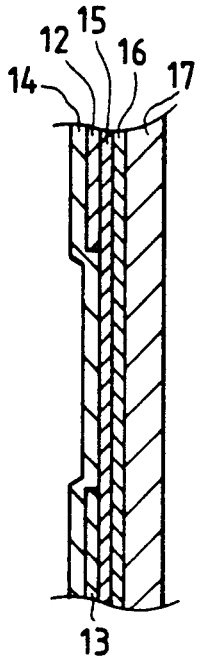
FIG. 2 shows the shape of the cross-section $E$-$E_1$ of FIG. 1.

FIG. 1 is an enlarged front view showing the shapes of the heat generating element 11 and the electrodes 12 and 13 of a thermal head 10 according to a first embodiment, and FIG. 2 is a cross-sectional view showing the shape of the cross-section $E-E_1$ of FIG. 1.

In FIG. 1, the reference numeral 11 designates a heat generating element of the thermal head 10, and this thermal head 10 is comprised of a plurality of such heat generating elements 11 (in this embodiment, each heat generating element has a width Wr of 150 μm and a length 2Lr = 160 μm) arranged in a row at a resolution of 6 dots/mm, and these heat generating elements are selectively electrically energized correspondingly to recording data, whereby they generate heat to effect image recording. The reference numeral 12 denotes a common electrode (having a width We of 40 μm) for supplying electric power to each heat generating element, and the reference numeral 13 designates a signal electrode (having a width We of 40 μm) provided correspondingly to each heat generating element, and the voltage level thereof is changed correspondingly to the recording data, whereby the control of the electrical energization of the heat generating elements 11 is executed.

The heat generating elements 11 and the electrodes 12 and 13 of the thermal head 10 according to the present embodiment will now be described with reference to FIG. 2. A glaze layer 16 as a heat accumulating portion is formed on an alumina substrate 17. Further, on the glaze layer 16, a resistance layer 15 and films of electrode layers 12 and 13 are formed as by vacuum evaporation or sputtering. A portion of the electrode layers and resistance layer is cut away as by photolithography or photo-etching to thereby form the electrodes 12, 13 and heat generating elements 11, and further thereon, a wear resisting layer 14 is formed as by sputtering. Here, the portion called the heat generating element 11 refers to that portion of the resistance layer 15 which is between the electrode layers 12 and 13.

As is apparent from FIG. 1, the electrode width We (40 μm) of portions 12*a* and 13*a* in which the heat generating element 11 and the electrodes 12 and 13 are connected together is smaller than the width Wr (150 μm) of the heat generating element 11.

Figure 3A:
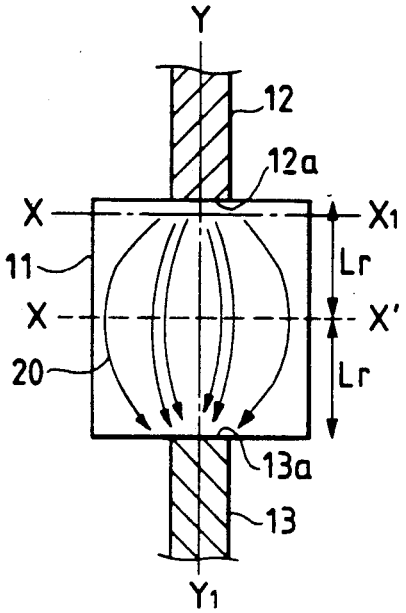
FIG. 3A shows the distribution of an electric current flowing through the thermal head according to the first embodiment.

FIG. 3A shows the flow of an electric current when a pulse voltage is applied to the heat generating element 11 of the thermal head 10 shown in FIG. 1 through the electrodes 12 and 13 which are narrower than the width of the heat generating element 11.

In FIG. 3A, the reference numeral 20 designates an electric current flowing through the heat generating element 11, and the density of the electric current flowing through the heat generating element 11 is great near the junctions 12*a* and 13*a* between the narrow electrodes 12, 13 and the heat generating element 11.

Figure 3C:
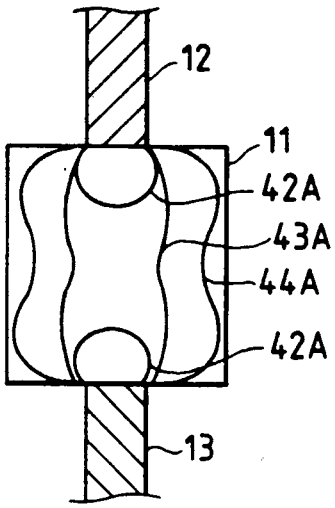
FIG. 3C shows the heat transfer area corresponding to applied energy in the thermal head according to the first embodiment.
Figure 3B:
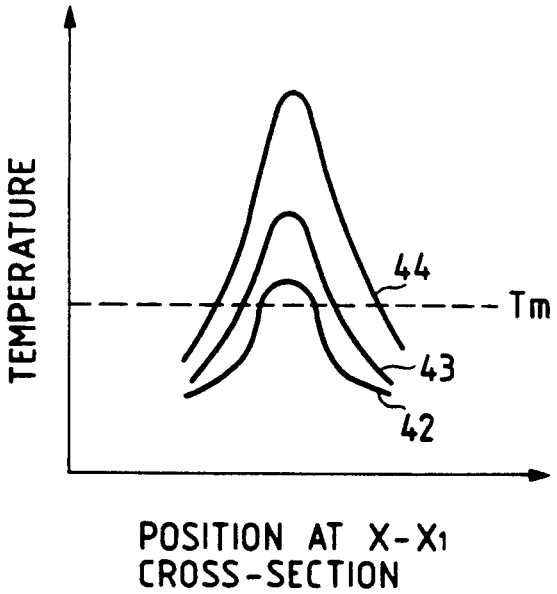
FIG. 3B shows the temperature distribution relative to the widthwise position at the cross-section $X$-$X_1$ of FIG. 3A.

FIG. 3B shows the temperature distribution near the electrode 12 in the heat generating element 11 (at the cross-section $X\text{-}X_1$ of FIG. 3A).

The temperature of the vicinity of the electrode 12 (or the electrode 13) (the vicinity of the junctions 12*a* and 13*a*) is particularly high in the heat generating element 11. As the time of application of the pulse signal applied to the signal electrode of the heat generating element 11 is gradually lengthened to change the applied energy to the heat generating element 11, the widthwise temperature distribution at the cross-section $X\text{-}X_1$ of the heat generating element 11 varies as indicated by curves 42→43→44 in FIG. 3B. In FIG. 3B, Tm indicates the melting point of the ink of an ink sheet, and in a temperature area higher than this, the ink of the ink sheet is melted and transferred to a recording sheet. The pulse width of the applied pulse signal is 42<43<44.

Accordingly, the area of the dot of the transferred ink becomes wider as indicated by 42A, 43A and 44A in FIG. 3C, correspondingly to the variations in the temperature distributions 42, 43 and 44 of FIG. 3B.

Also, in FIGS. 3B and 3C, the applied energy has been varied in three stages to vary the transfer area to three kinds, but if the applied energy is further made into intermediate applied energy, the variation in the transfer area can be made finer and continuous harmonization will become possible. That is multivalue information can be recorded by a heat generating element 11.

Figure 4:
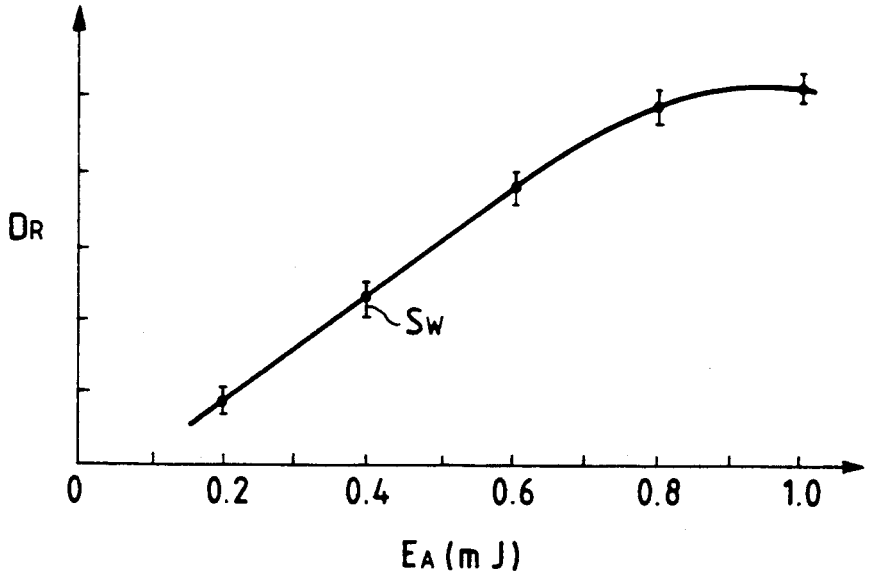
FIG. 4 shows the relation of recording density to applied energy in the thermal head according to the first embodiment.
Figure 9A:
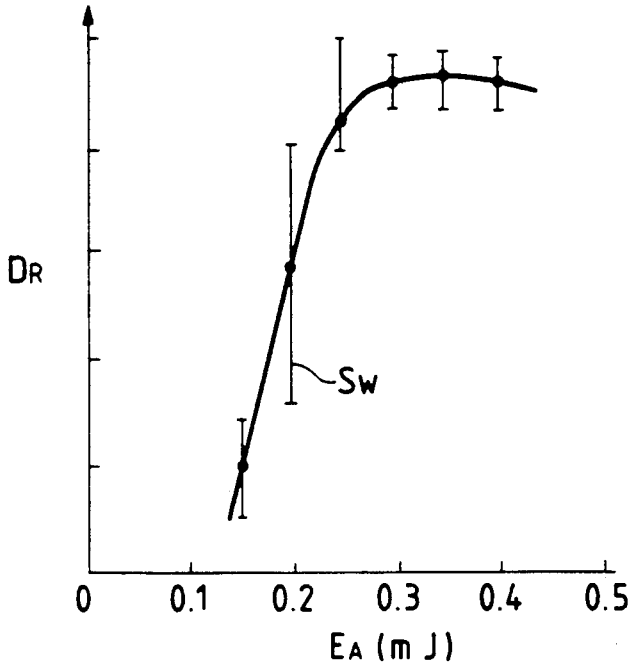
FIG. 9A PRIOR ART
FIGS. 9A and 9B illustrate a thermal head according to the prior art.
Figure 9B:
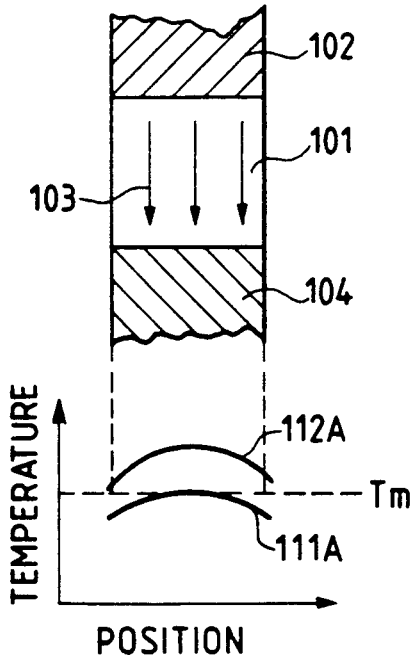
FIG. 9B PRIOR ART

Further, as shown in FIG. 3B, the temperature gradient near the electrodes of the heat generating element 11 in the present embodiment is sufficiently great as compared with the prior-art heat generating element 101 shown in FIG. 9, and the temperature of the heat generating element 11 is of a value sufficiently greater than the melting point Tm of the ink. Therefore, the fluctuation of the recording density relative to a minute variation in the applied energy can be suppressed, and the fluctuation of the recording density $D_R$ relative to the applied energy assumes a gradient (a variation rate) as shown in the graph of FIG. 4. Also, the scattering width $S_W$ of the recording density relative to each applied energy is as shown by the length of a vertical line in the graph, and is sufficiently small as compared with the case shown in FIG. 9A.

The reason why the thermal head according to the present embodiment is thus excellent in continuous harmonization and also excellent in durability will hereinafter be described.

(A) DURING THE RECORDING OF SMALL DOTS

When small dots are to be transferred for recording, the thermal head is driven with the applied energy to the heat generating element 11 of the thermal head made small. At this time, the current density in that portion of the heat generating element which is near the electrodes becomes high, and that portion generates heat extremely as compared with the surroundings thereof and a small dot of ink is transferred. The energy applied to the heat generating element 11 at this time is small and therefore, the temperature of the heat generating element 11 does not rise so much and thus, there is no problem.

(B) DURING THE RECORDING OF MEDIUM DOTS

When dots of a medium size are to be transferred for recording, somewhat high applied energy is applied to the heat generating element 11 of the thermal head as compared with the recording of the aforedescribed small dots. Thereby, as in the aforedescribed case, the temperature of the portions near the junctions 12*a* and 13*a* between the electrodes 12, 13 and the heat generating element 11 first rises. Since the applied energy further rises, that portion of the heat generating element 11 which corresponds to the width of the electrodes generates heat and an elongate ink dot is transferred.

This is because the electric current flowing through the heat generating element 11 is liable to flow over the shortest distance between the individual electrode 13 and the common electrode 12 and therefore the current density in that portion of the heat generating element 11 which corresponds to the width of the electrodes 12 and 13 becomes higher than in the other portion. If seems that there is no problem in the durability of the heat generating element 11 in this case because the applied energy is relatively small.

(C) DURING THE RECORDING OF LARGE DOTS

When large dots are to be transferred for recording, high applied energy is applied to the heat generating element 11 of the thermal head. Thereby, as in the aforedescribed case, the temperature of the portions near the junctions 12*a* and 13*a* between the electrodes 12, 13 and the heat generating element 11 and that portion of the heat generating element 11 which corresponds to the width of the electrodes 12 and 13 first rises, but since higher energy is applied to the heat generating element, that portion of the heat generating element which corresponds to the width of the electrodes becomes higher in temperature. Generally, the resistance value of the heat generating element 11 becomes greater as the temperature thereof rises and therefore, the resistance value of that portion of the heat generating element 11 which corresponds to the width of the electrodes increases due to the temperature rise and it becomes difficult for the electric current to flow through that portion. As a result, the electric current begins to flow through the outside of that portion of the heat generating element 11 which corresponds to the width of the electrodes, and the current density in that outside portion becomes high and that portion generates heat. In this manner, a dot of a size corresponding to the size of the heat generating element 11 is transferred.

Considering the durability of the heat generating element 11 at this time, the energy applied to the heat generating element 11 is great and the heat generation temperature thereof also becomes high. However, the resistance of that portion of the heat generating element 11 which becomes particularly high in temperature becomes great and it becomes difficult for the electric current to flow through that portion. Thereby, the electric current is dispersed to the outside of that portion of the heat generating element 11 which corresponds to the width of the electrodes. Thus, the peak temperature of the portion which becomes particularly high in temperature can be suppressed and the aforementioned outside portion can be caused to generate heat efficiently. Therefore, the deterioration of the heat generating element 11 during the formation of large dots is little, and this thermal head can be said to be a thermal head which is excellent in durability and heat efficiency.

Accordingly, by controlling, for example, the time for which the pulse signal is applied to the thermal head, or the voltage value, i.e., the applied energy, the picture element density at which recording is effected by a heat generating element can be changed with good accuracy. Therefore, it becomes possible to express half tone and there can be provided a thermal head in which the irregularity of the density in half tone recording can be made sufficiently small and stable and which is sufficiently excellent in durability.

Figure 5:
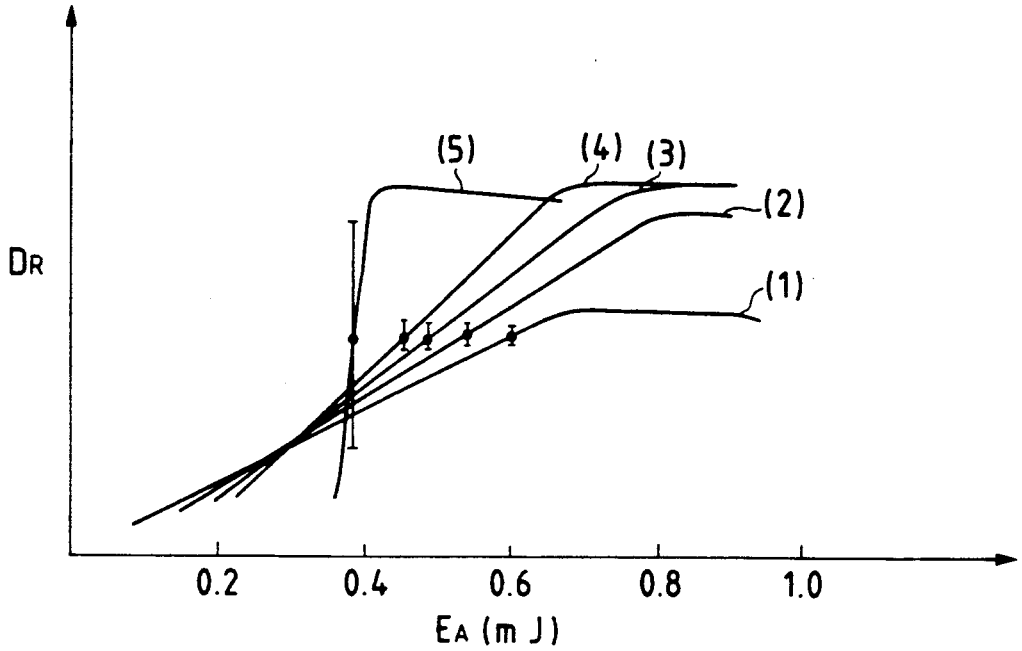
FIG. 5 shows the recording density when the width of the electrodes is varied in the thermal head according to the first embodiment.

Here, it has been found that the ratio of the width We of the electrodes to the width Wr of the heat generating element 11 and the ratio of the length (2Lr) of the heat generating element 11 to the width Wr of the heat generating element 11 greatly affect the multivalue harmonization of the thermal head and the durability of the heat generating element 11. So, the relation between the applied energy and the recording density when use is made of a thermal head in which the width Wr of the heat generating element is fixed at 150 μm and the length (2Lr) of the heat generating element 11 is fixed at 160 μm and the width We of the electrodes 12 and 13 is changed to 10 μm–120 μm has been found by the actual measurement The durability of the thermal head relative to the shape ratio (We/Wr) of the thermal head is shown in Table 1 below, and the relation of the recording density to the applied energy in each head is shown in FIG. 5.

TABLE 1

| Nos. of thermal heads | Width (We) of electrodes | We/Wr | Durability of head |
|---|---|---|---|
| (1) | 10 μm | 1/15 | x |
| (2) | 15 μm | 1/10 | o |
| (3) | 40 μm | 4/15 | o |
| (4) | 75 μm | ½ | o |
| (5) | 120 μm | 4/5 | o |

Here, the durability of the thermal head is evaluated as "o" when for the pulse application $1\times10^7$ (the printing rate 12.5%), the rate of variation in the resistance value of the heat generating element 11 is equal to or less than ±15%.

As is apparent from Table 1 above and FIG. 5, the harmonization and durability of the thermal heads Nos. (2), (3) and (4) in which We/Wr is within the range of 1/10 to ½ are very excellent, but in the head No. (1) wherein We/Wr is smaller than 1/10, the width of the electrodes is too small and therefore recording cannot be effected at a high density and moreover, the current density in the heat generating element becomes too high and therefore the durability of this heads is bad. Also, in the head No. (5) wherein We/Wr is greater than ½, the difference between the width of the electrodes and the width of the heat generating element is too small and therefore, a clear difference does not occur to the density of the electric current flowing through the heat generating element. Thus, no difference occurs to the heat generation distribution in the heat generating element, and as in the prior-art head, the irregularity of the density at the intermediate density becomes great and virtually only two-value recording can be effected.

Figure 6:
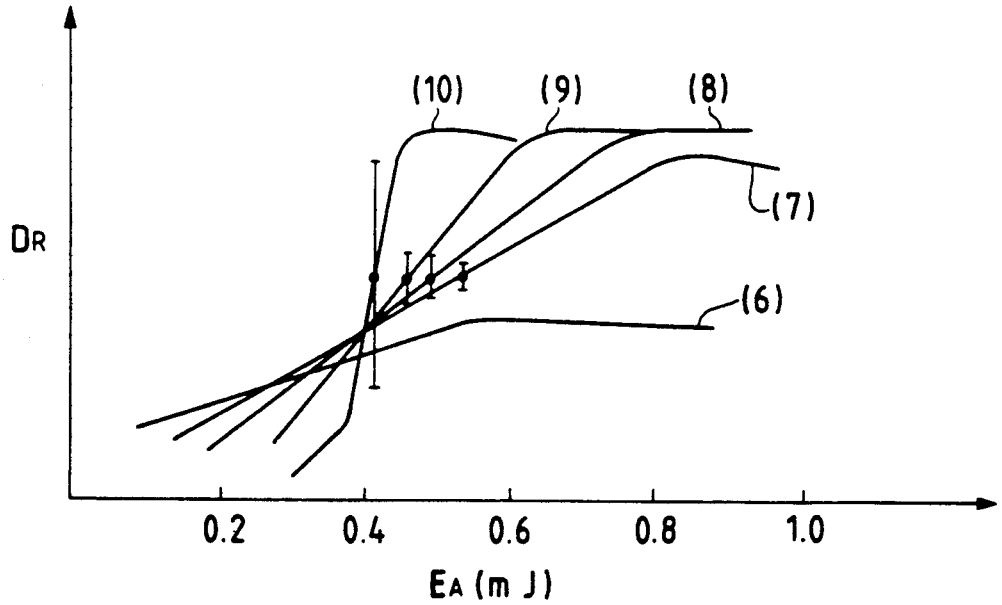
FIG. 6 shows the recording density when the length of the heat generating element is changed in the thermal head according to the first embodiment.

Next, the recording density relative to the applied energy has been actually measured by the use of a thermal head in which the width (Wr) of the heat generating element 11 is fixed at 150 μm and the width (We) of the electrodes 12 and 13 is fixed at 40 μm and the length (2Lr) of the heat generating element 11 is changed to 50 μm–600 μm. The durability of the head for the shape (Lr/Wr) of the head which is the result of the measurement is shown in Table 2 below, and the recording density relative to each applied energy is shown in FIG. 6.

Here, Lr is the length between a point at which the current density in the heat generating element 11 becomes greatest and a point at which the current density becomes smallest. That is, in the thermal head of FIG. 1, the distance from the center of the heat generating element 11 to the electrodes is indicated by Lr.

TABLE 2

| Nos. of thermal heads | Length (2 Lr) of heat generating element | Lr/Wr | Durability of head |
|---|---|---|---|
| (6) | 50 μm | 1/6 | x |
| (7) | 75 μm | ¼ | o |
| (8) | 150 μm | ½ | o |
| (9) | 450 μm | 3/2 | o |

TABLE 2-continued

| Nos. of thermal heads | Length (2 Lr) of heat generating element | Lr/Wr | Durability of head |
|---|---|---|---|
| (10) | 600 μm | 2 | c |

As is apparent from Table 2 above and FIG. 6, the harmonization and durability of the thermal heads Nos. (7), (8) and (9) in which Lr/Wr is within the range of ¼-3/2 are very excellent. However, in the head No. (6) wherein Lr/Wr is smaller than ¼, the ratio of the length of the heat generating element 11 to the width of the heat generating element 11 is too small and therefore, current flow into the surrounding regions of the heat generating element does not take place. Therefore, recording at a high density is difficult to accomplish and thus, the applied energy becomes higher and the durability of the head is reduced. Also, in the head No. (10) wherein Lr/Wr is greater than 3/2, the length of the heat generating element 11 is too great and therefore, the rate of the portion of the heat generating element 11 in which a difference in the current density occurs becomes smaller, and thus, as in the prior-art head, the irregularity at the intermediate density becomes greater and virtually only two-value recording can be effected.

DESCRIPTION OF SECOND EMBODIMENT (FIG. 7)

Figure 7A:
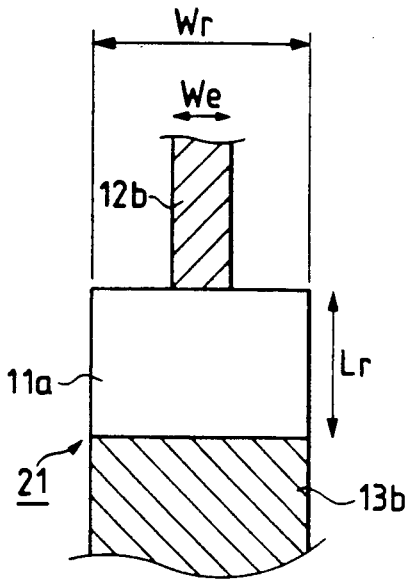
FIG. 7 shows the shape of a thermal head according to a second embodiment, FIG. 7A being a fragmentary enlarged view showing the shapes of the heat generating element and the electrodes of the thermal head, FIG. 7B showing the distribution of an electric current flowing through the heat generating element, and FIG. 7C showing the transfer area relative to applied energy.
Figure 7B:
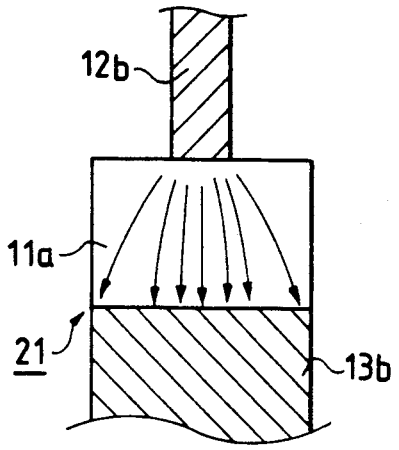
Figure 7C:
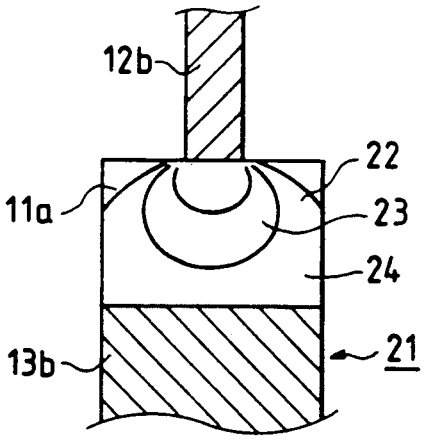

FIG. 7A is an enlarged front view showing the shapes of a heat generating element 11*a* and electrodes 12*b* and 13*b* in a thermal head 21 according to a second embodiment, FIG. 7B shows the flow of an electric current in the heat generating element 11*a*, and FIG. 7C shows the transfer area of ink when applied energy is varied.

In this thermal head 21, the width of the common electrode 12*b* is smaller than the width of the heat generating element 11*a*, and the width of the individual electrode 13*b* is substantially equal to the width of the heat generating element 11*a*. Therefore, as shown in FIG. 7B, the current density becomes higher in that portion of the heat generating element 11*a* which is near the common electrode 12*b* and the heat generation temperature thereof becomes higher. It is FIG. 7C that shows the transfer area of ink when this thermal head 21 is electrically energized. The transfer area of ink becomes gradually wider as indicated by 22, 23 and 24 as the applied energy is made greater, and when the greatest energy is applied, the transfer area extends substantially over the whole area of the heat generating element 11*a*.

In this manner, the energy applied to the heat generating element 11*a* is adjusted to change the transfer area transferred to an ink sheet, whereby the expression of half tone becomes possible. Again in this head, the ratio of the width of the electrode 12*b* to the width of the heat generating element 11*a* and the ratio of the length of the heat generating element 11*a* to the width of the heat generating element 11*a* affect the multivalue harmonization and durability.

So, the relation between the applied energy and the recording density has been actually measured by the use of a thermal head in which the width (Wr) of the heat generating element 11*a* is fixed at 150 μm and the length (Lr) of the heat generating element 11*a* is fixed at 100 μm and the width (We) of the common electrode 13*b* is changed to 10 μm-120 μm (the width of the individual electrode 13*b* is 150 μm). The result of the durability and the harmony reproducibility of the head for the shape (We/Wr) of the head at this time is shown in Table 3 below.

TABLE 3

| Nos. of heads | Width (We) of common electrode | We/Wr | Durability | Harmonization |
|---|---|---|---|---|
| (11) | 10 μm | 1/15 | x | c |
| (12) | 15 μm | 1/10 | c | c |
| (13) | 40 μm | 4/15 | c | o |
| (14) | 75 μm | ½ | o | o |
| (15) | 120 μm | 4/5 | o | x |

Here, the durability and harmonization of the thermal head are excellent for We/Wr within the range of 1/10-½, for the same reason as that set forth in the first embodiment.

Next, the recording density relative to the applied energy when in the thermal head 21 of FIG. 7, the width (Wr) of the heat generating element 11*a* is fixed at 150 μm and the width of the electrode 12*b* is fixed at 40 μm and the length Lr of the heat generating element 11*a* is changed to 25 μm-300 μm has been actually measured. Here, Lr is defined by the length between a point at which the current density through the heat generating element 11*a* becomes greatest (the vicinity of the individual electrode 13*b*) and a portion in which the current density the least is (the vicinity of the common electrode 12*b*) and therefore, here, it is the length Lr of the heat generating element 11*a*. The durability and the harmony reproducibility of the head relative to the shape (Lr/Wr) of the thermal head 21 at this time are shown in Table 4 below.

TABLE 4

| Nos. of heads | Length (Lr) of heat generating element | Lr/Wr | Durability | Harmonization |
|---|---|---|---|---|
| (16) | 25 μm | 1/6 | x | x |
| (17) | 37.5 μm | ¼ | c | c |
| (18) | 75 μm | ½ | c | c |
| (19) | 225 μm | 3/2 | c | c |
| (20) | 300 μm | 2 | c | x |

The durability and harmonization of this thermal head 21 are excellent when Lr/Wr is within the range of ¼-3/2, as in the case of the previously described first embodiment.

DESCRIPTION OF THIRD EMBODIMENT (FIG. 8)

FIG. 8 illustrates a thermal head 27 according to a third embodiment. FIG. 8A is an enlarged front view showing the shapes of the heat generating elements 11*b* and 11*c* and the electrodes 12*c* and 13*c* of the thermal head 27, FIG. 8B shows the flows of an electric current in the heat generating elements 11*b* and 11*c*, and FIG. 8C shows a variation in the ink transfer area when the energy applied to the heat generating elements 11*b* and 11*c* is varied.

In this thermal head 27, the heat generating element is divided into two portions as indicated by 11*b* and 11*c*. These two heat generating elements 11*b* and 11*c* have substantially the same width as that of the electrodes 12*c* and 13*c*, and are connected together by the central conductor portion 13*d* which is narrower than the width of the common electrode 12*c* and the individual electrode 13*c*.

Figure 8A:
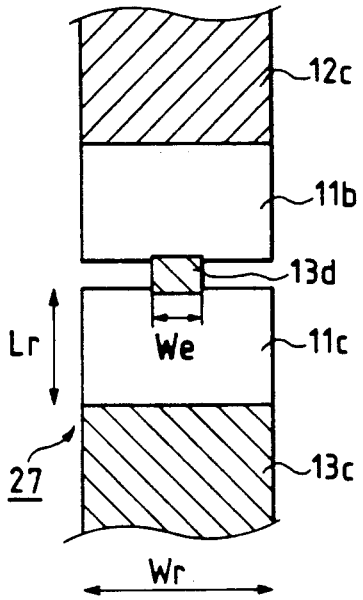
FIG. 8 shows the shape of a thermal head according to a third embodiment, FIG. 8A being a fragmentary enlarged view showing the shapes of the heat generating elements and the electrodes of the thermal head, FIG. 8B showing the distribution of an electric current flowing through the heat generating element, and FIG. 8C showing the transfer area relative to applied energy.
FIG. 8D shows still another embodiment of the present invention.
Figure 8B:
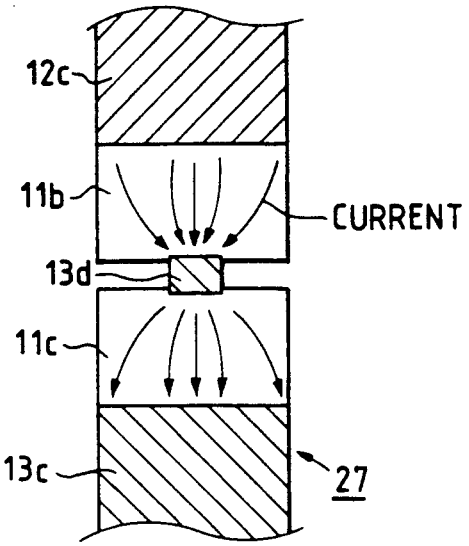
Figure 8C:
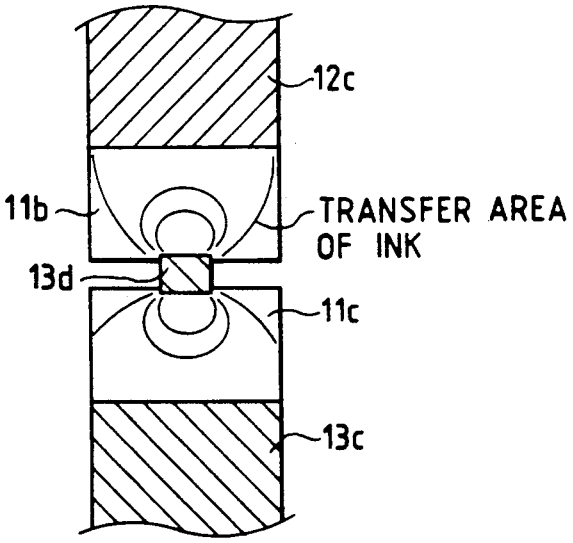

The heat generating elements of this thermal head 27 are of a construction in which the heat generating element 11*a* in the second embodiment is connected in a pair with the conductor portion 13*d* interposed therebetween and therefore, the manner in which the electric current flows through the heat generating elements 11*b* and 11*c* and the variation in the transfer area of ink are basically similar to those in the case of the second embodiment, and are shown in FIGS. 8B and 8C, respectively.

Here, the relation between the ratio of the width of the electrodes 12*c* and 13*c* to the width of the heat generating elements 11*b* and 11*c* and the ratio of the length of the heat generating elements 11*b* and 11*c* to the width of the heat generating elements 11*b* and 11*c* is also substantially similar to that in the second embodiment.

That is, when the heat generating elements and the electrodes are of shapes which are in the relations that $$1/10 \leqq We/Wr \leqq \tfrac{1}{4}$$

$$\tfrac{1}{4} \leqq Lr/Wr \leqq 3/2.$$

the durability and harmonization of the thermal head 27 become excellent.

Figure 8D:
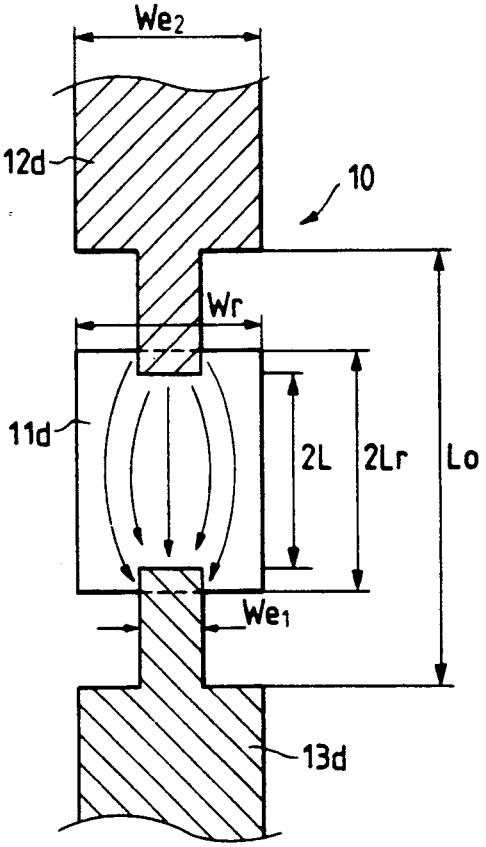

Further, the embodiment shown in FIG. 8D is a modification of the embodiment shown in FIG. 1, and also satisfies the aforementioned relations. That is, in this embodiment, a convex common electrode 12*d* and a signal electrode 13*d* are connected to one end and the other end of a heat generating element 11*d*. The common electrode 12*d* and the signal electrode 13*d* partly overlap the heat generating element 11*d* in their junctions with the heat generating element 11*d*. By the heat generating element 11*d* and the electrodes 12*d*, 13*d* being thus connected together with parts thereof overlapping each other, it becomes easier to manufacture the thermal head. An example of each size in the present embodiment will be shown below.

$We_1 = 50\ \mu m$ $2L = 190\ \mu m$ $Lo = 340\ \mu m$ $We_2 = Wr = 147\ \mu m$ $2Lr = 150\ \mu m$

In the present embodiment, Lr is the distance between the electrodes 12*d* and 13*d*, but in some cases, it may be the length (2L) of the heat generating element. Again in the present embodiment, the aforementioned relations are satisfied and also, good half tone recording can be obtained.

As described above, the durability and harmonization of the thermal head are greatly related to the values of We/Wr and Lr/Wr. The reason for this is not clear, but the following reason is roughly conceivable. Unless the width of the electrodes is about one half of the width of the heat generating element, no difference occurs in the distribution of the density of the electric current flowing through the heat generating element, and the transfer area cannot be changed correspondingly to the applied energy and harmony cannot be reproduced. However, if conversely, the width of the electrodes is too small relative to the width of the heat generating element, however great energy is applied, the electric current flowing through the heat generating element will not expand to the marginal portion of the heat generating element and the transfer area will not expand correspondingly to the applied energy and therefore, it will become impossible to record large dots. Also, since at this time, great energy is applied to the heat generating element, the temperature of the vicinity of the junctions between the heat generating element and the electrodes in which the electric current concentrates will become very high as compared with the temperature of the other portion and the deterioration of the heat generating element by heat will become vehement.

In a similar manner, unless the length of the heat generating element from a position at which the expause of the electric current becomes narrowest to a position at which the expause of the electric current becomes greatest is about 1.5 times as great as the width of the heat generating element, the area of the portion in which there is no difference in the current density (the middle portion of the heat generating element) will become great and harmony cannot be reproduced. If conversely, the length of the heat generating element is too small, the electric current will not flow into the surrounding portions of the heat generating element, but will flow substantially rectilinearly through the heat generating element and therefore, current density will vary across the width of the heat generating element. Therefore, great energy must be applied to the heat generating element and the durability of the thermal head will become bad.

As described above, according to the present embodiment, the ratio of the length of the heat generating element to the width of the electrodes in the junctions between the heat generating element and the electrodes and to the width of the heat generating element are limited within particular ranges, whereby there can be provided a thermal head of good harmony reproducibility.

DESCRIPTION OF A HEAT TRANSFER RECORDING APPARATUS (FIGS. 10-12)

Figure 10:
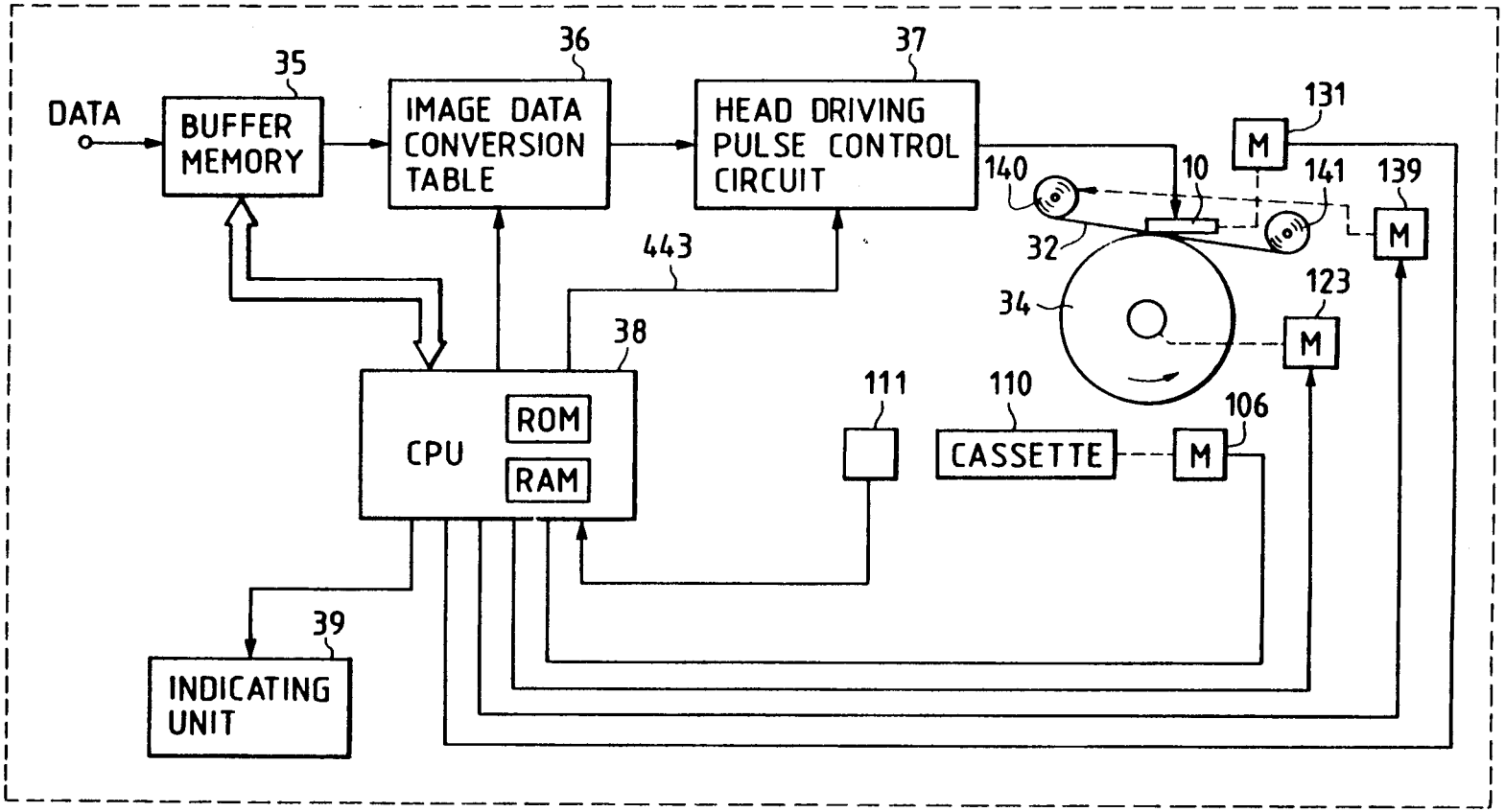
FIG. 10 is a block diagram schematically showing the construction of a heat transfer recording apparatus using a thermal head according to an embodiment of the present invention.

FIG. 10 is a block diagram schematically showing the construction of a heat transfer recording apparatus using the thermal head 10 according to the aforedescribed embodiment, and this figure shows the case of the thermal head 10 according to the first embodiment, the use of a thermal head according to other embodiment can also realize such recording apparatus.

In FIG. 10, the reference numeral 110 designates a plain paper cassette containing therein plain paper which is recording sheets, the reference numeral 111 denotes a sensor for detecting the presence or absence of the plain paper, and the reference numeral 106 designates a conveying motor for picking up and conveying the plain paper from the cassette 110. The reference numeral 123 denotes a stepping motor which rotatively drives a platen 34 through a reduction gear mechanism, not shown. The reference numeral 131 designates a motor for bringing the thermal head 10 up and down, and by the driving of this motor 131, the thermal head 10 is urged against the platen 34 with an ink sheet 32 and recording paper interposed therebetween (the down state), and is moved away from the platen 34 (the up state). The reference numeral 139 denotes a motor which is a drive source for a feeding mechanism for the ink sheet 32. The rotation of the motor 139 is transmitted to the drive shaft of a take-up roll 140, whereby the ink sheet 32 is taken up in the direction of arrow. The reference numeral 141 designates a supply roll of the ink sheet 32.

Figure 11:
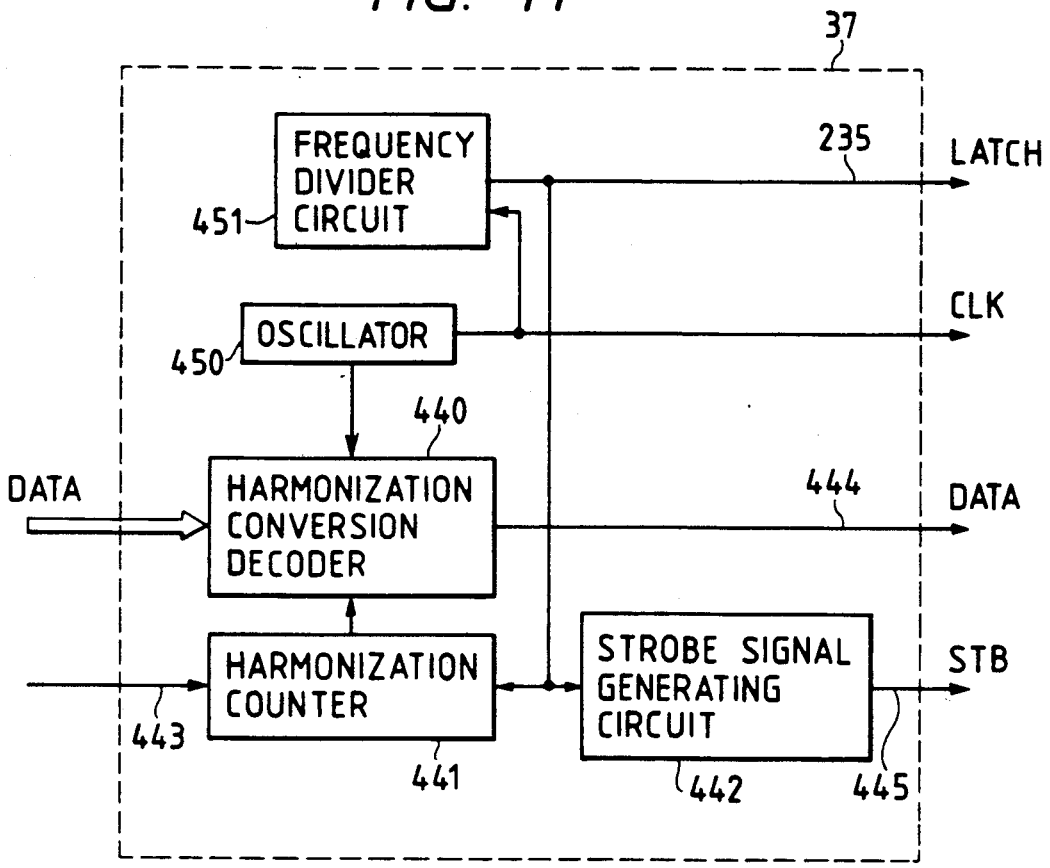
FIG. 11 is a block diagram schematically showing the construction of a head driving pulse control circuit.

The reference numeral 35 denotes a buffer memory for temporarily holding input image data therein, and the reference numeral 36 designates an image data conversion table for converting the image data read out of the buffer memory 35. Usually the image data conversion table 36 is comprised of a look-up table such as ROM. The reference numeral 37 denotes a head driving pulse control circuit of which the details are shown in FIG. 11.

Figure 12:
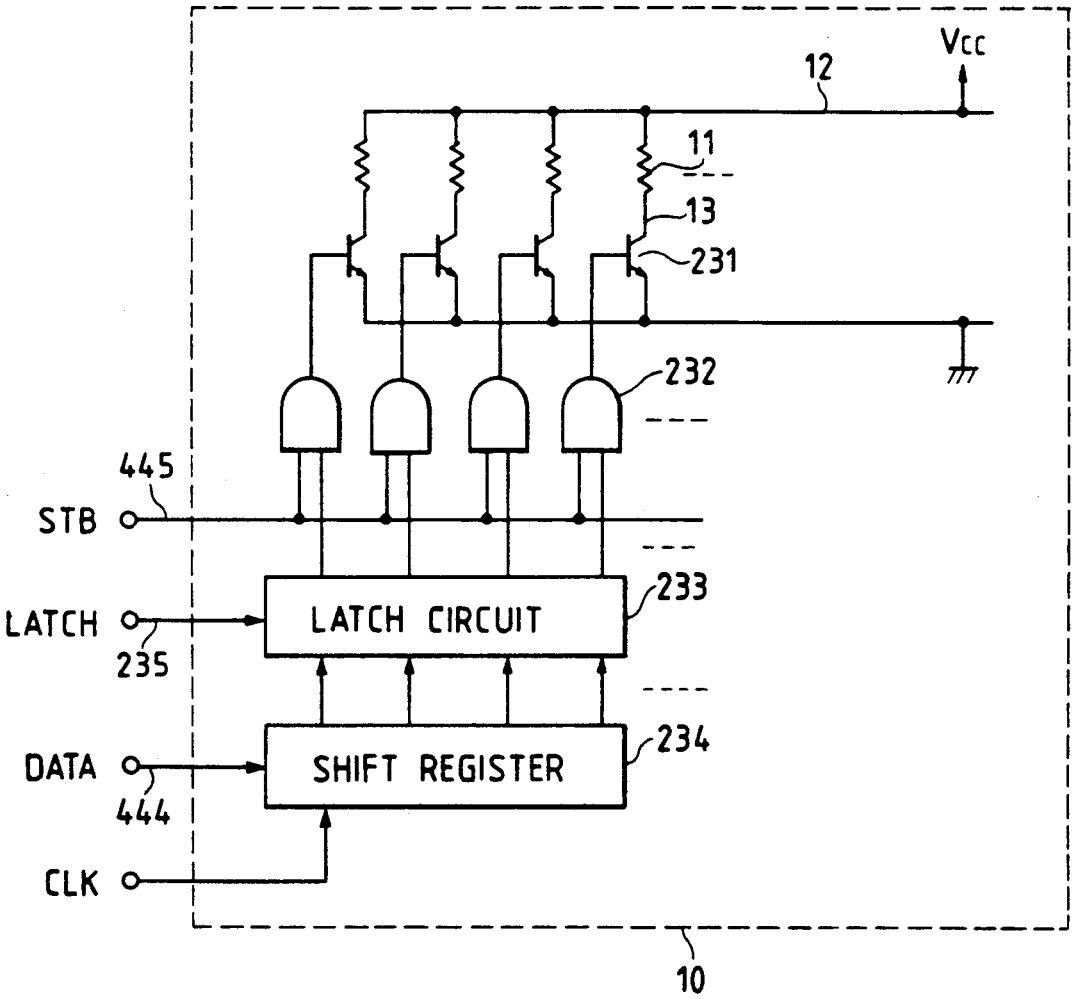
FIG. 12 shows the construction of the thermal head.

FIG. 12 is a block diagram showing the construction of the thermal head 10.

In FIG. 12, the reference numeral 11 designates heat generating elements each of which is made on the basis of the aforedescribed embodiment, and which are provided for one line in the widthwise direction of the recording paper. The reference numeral 233 denotes a latch circuit for latching recording data for one line, and the reference numeral 234 designates a shift register which successively receives as inputs serial recording data (harmony data) 444 in synchronism with a clock signal CLK. The serial data thus input to the shift register 234 are latched in the latch circuit 233 by a latch signal 235 and are converted into parallel data. Thus, the recording data corresponding to each heat generating element is held in the latch circuit 233. The timing and time at which a voltage is applied are determined by a strobe signal STB 445, and an output transistor 231 connected to an AND circuit 232 having data therein is turned on. Thereby, the corresponding heat generating elements 11 are electrically energized from the common electrode 12 through the signal electrode 13, and the heat generating elements 11 are driven for heat generation.

The head driving pulse control circuit 37 will now be described with reference to FIG. 11.

The reference numeral 450 designates an oscillator which outputs a clock signal CLK of a predetermined frequency, and the reference numeral 451 denotes a frequency divider circuit for frequency-dividing the clock signal CLK and outputting a latch signal 235 each time, for example, the number of the heat generating elements of the thermal head 10 for one line is counted. The reference numeral 440 designates a harmonization conversion decoder which corresponds to each picture element of input picture element data and transports harmonization data 444 to each shift register stage of a shift register 234 in synchronism with the signal CLK. Thereby, when for example, a color image is to be processed, harmonization conversion is effected by the harmonization conversion decoder 440 for each of colors Y, M and C.

The reference numeral 441 denotes a harmonization counter which counts up each time the latch signal 235 is input, and which carries out the counting of mod 64 (6 bits), for example, in the case of an ink sheet of sublimating property, and the counting of mod 16 (4 bits) in the case of an ink sheet of meltable property, on the basis of an instruction signal 443 from CPU 38. The harmonization conversion decoder 440 compares the count value from the harmonization counter 441 with each input picture element data, and outputs "1" as harmonization data 444 when the picture element data is greater than or equal to the count value, and outputs "0" when the picture element data becomes smaller than the count value. A strobe signal generating circuit 442 outputs a strobe signal STB 445 a little later than the latch signal 235, whereby the heat generating elements are driven and recording is effected.

Figure 13:
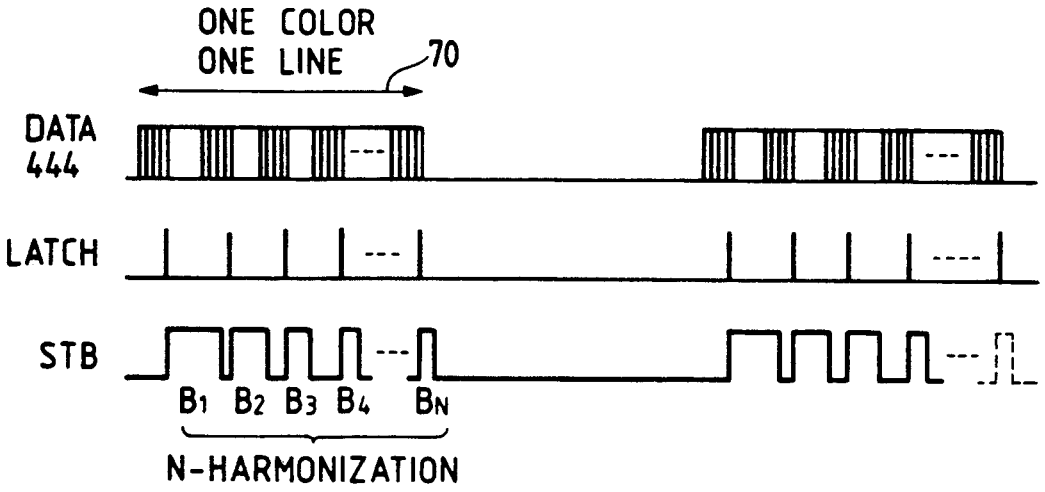
FIG. 13 shows the timing of signals applied to the thermal head.

FIG. 13 shows the driving of the thermal head 10 according to the aforedescribed embodiment and the timing of the strobe signal STB.

The thermal head 10 is a line type head, and the reference numeral 70 indicates the recording timing for one line. Assuming that the image data per picture element input to the harmonization conversion decoder 440 comprises, for example, 6 bits, 64 kinds of data per picture element can be assumed. Thus, in this case, N of N harmonization is "64". First, harmonization data 444 for the first STB signal $B_1$ of the data for one line is transported to the shift register 234, and is latched in the latch circuit 233 by the latch signal 235. The strobe signal $B_1$ is then output and the heat generating element to which the data "1" has been output is driven by the pulse width of the strobe signal $B_1$. During this driving, the next harmonization data 444 is input to the shift register 234, and when the STB signal 445 falls, said harmonization data is latched in the latch circuit 233 by the latch signal 235. Thus, the STB signal is then output for $B_2$. Such an operation is executed 64 times (STB signals $B_1$–$B_{64}$), whereby recording by one line is terminated.

That is, the harmonization conversion decoder 440 receives image data as an input, and when of the images, the value of the mth picture element data of the line to be recorded is "20", it outputs such data that the first half 20 data are "1" and the second half 44 (64–20) data are "0", 64 times in total, to the mth stage of the shift register 234 which corresponds to the position of that picture element data while referring to the value of the harmonization counter 441. At this time, however, of course, data are set in the other stages of the shift register 234 in conformity with the degree of harmonization of the corresponding picture element.

At this time, each strobe signal STB has its pulse width changed correspondingly to the number of times of the outputting of the STB signal, as shown. It is the strobe signal generating circuit 442 that executes the adjustment of the pulse width of such a strobe signal STB. This strobe signal generating circuit 442, as previously described, receives as an input the harmonization data 444 corresponding to the kind of the ink sheet 32 by a corresponding ROM table or the like, and adjusts the width, period, etc. of the STB signal 445 correspondingly to the kind of the ink sheet 32.

Figure 14:
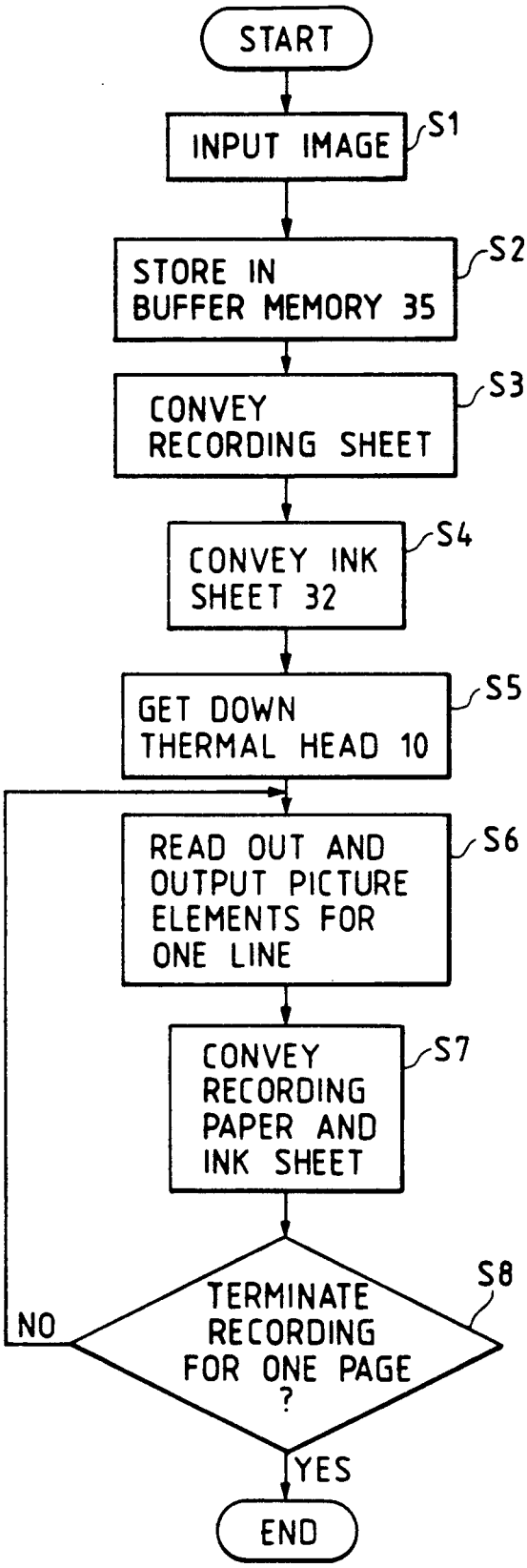
FIG. 14 is a flow chart showing the recording process in a heat transfer recording apparatus according to an embodiment of the present invention.

FIG. 14 is a flow chart showing the recording process in the heat transfer recording apparatus according to the present embodiment, and this recording process is stored in the ROM of the CPU 38.

When at step S1, image data is input, advance is made to step S2, where the image data is stored in the buffer memory 35. At step S3, a recording sheet is picked up from the cassette 110 and conveyed to the recording position. At step S4, the ink sheet 32 is conveyed so that the desired position of the ink sheet 32 comes to the recording position. Advance is then made to step S5, where the motor 131 is driven to get down the thermal head 10.

At step S6, picture elements for one line are read out from the buffer memory 35 and output to the head driving pulse control circuit 37 through the conversion table 36. Thereby, the harmonization data 444, the latch signal 235 and the strobe signal STB are output at the timing as shown in FIG. 13. Thereby the thermal head 10 is caused to generate heat, and transfer recording is effected on the recording sheet. Advance is then made to step S7, where the recording paper and the ink sheet 32 are conveyed by one line, and at step S8, whether the recording process for one page has been terminated is examined. If the recording for one page is not terminated, return is made to the step S6, where picture element data for the next line is read out from the buffer memory 35, and the aforedescribed recording process is carried out again.

In the case of color recording, recording is effected at one page unit of recording data for each color, and each time recording of each color is terminated, the color portion cf the ink sheet to be recorded next time is conveyed to the recording position and the recording sheet also makes a round of the platen 34 and is returned to its original position, and recording is effected in another color. Such operation is performed for three colors such as Y, M and C, whereby full color recording can be accomplished on the recording sheet. Also, the harmonization width of the aforementioned harmonization data 444 and the pulse width of the strobe signal STB may be changed correspondingly to the kind of the ink sheet 32 and the kind of the recording sheet used.

DESCRIPTION OF THE OTHER EMBODIMENTS (FIGS. 15-60)

A recording head according to an embodiment which will now be described is such that each of a plurality of heat generating resistance members includes at least one narrow portion narrower than the width of the heat generating resistance member and said narrow portion is formed by an electric conductor or an electric conductor portion provided on the heat generating resistance member. Therefore, the density of the electric current flowing through the heat generating resistance members is changed and the heat generation distribution is biased, whereby harmony expression is made possible.

Also, according to another recording head, a conductor portion is provided in a heat generating resistance member and the density of the electric current flowing through the heat generating resistance member can be changed to thereby change the heat generation distribution.

Figure 15A:
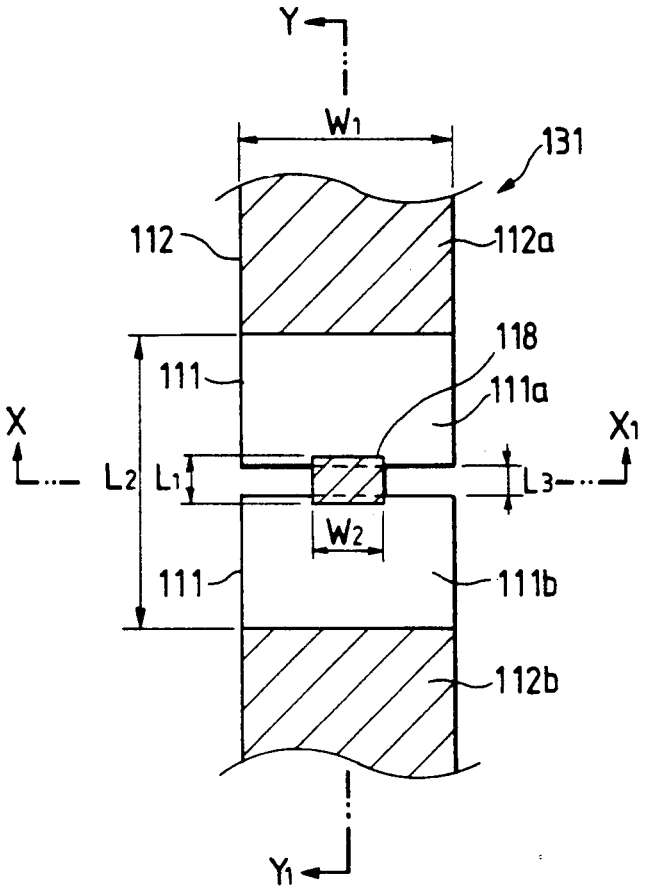
FIGS. 15A–15C show the shape of a thermal head according to another first embodiment of the present invention.
Figure 15C:
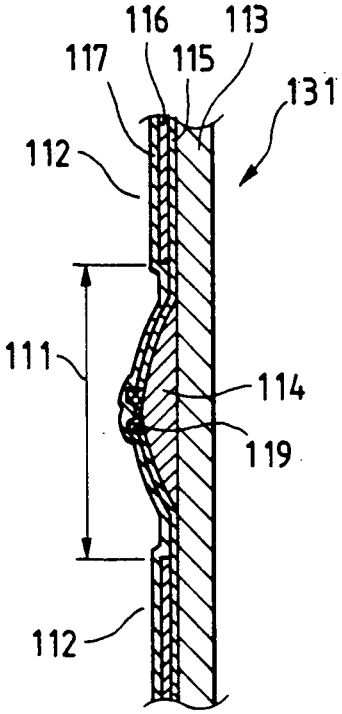
Figure 15B:
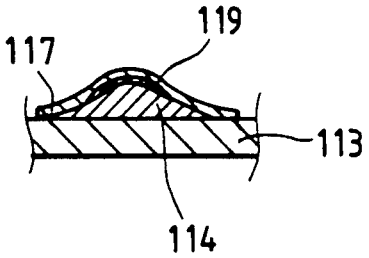

FIG. 15 shows the shapes of the heat generating element and the electrodes of a thermal head according to another embodiment. FIG. 15A is a top plan view of a heat generating element and the electrodes thereof, FIG. 15B is a cross-sectional view taken along line $X$-$X_1$ of FIG. 15A, and FIG. 15C is a cross-sectional view taken along line $Y$-$Y_1$ of FIG. 15A.

The heat generating element 111 and the electrode portion 112 of this thermal head will hereinafter be described.

In the thermal head according to the present embodiment, as shown in FIG. 15C, a glaze layer 114 as a heat accumulating portion is formed on an alumina substrate 113. Further, a resistance layer 115 is formed on the glaze layer as by vacuum evaporation or sputtering. The central portion of the resistance layer 115 (a conductor layer 119 portion) is cut as by photolithography or photoetching. An electrode layer 116 is formed on the resistance layer as by the aforementioned vacuum evaporation or sputtering. Further, as by photolithography or photoetching, the electrode layer 116 and the central conductor layer 119 are formed in the same process to thereby form the heat generating element 111 and the electrode portion 112. Further, a wear resisting layer 117 is formed on the electrode layer as by sputtering. The portion called the heat generating element 111 refers to the resistance layer in the portion wherein the electrode layer 116 is cut.

As is apparent from FIG. 15A, the thermal head 131 according to this embodiment is of a construction in which the heat generating element of the prior art thermal head is divided into two, which are connected together by a conductor portion 118 narrower in width than the heat generating element. Thus, the heat generating element 111 in a picture element is divided into two heat generating elements 111*a* and 111*b*. Also, as is apparent from FIGS. 15B and 15C, the central glaze layer 114 in this picture element protrudes with respect to its surroundings and therefore, the thermal head 131 is convex in this portion. The reference character 112*a* designates a common electrode, and the reference character 112*b* denotes an individual electrode. An example of each size is shown here. The width ($W_1$) of the electrode portion 112 is 147 μm, the width ($W_2$) of the conductor portion 118 is 40 μm, the length ($L_1$) of the conductor portion 118 is 52 μm, the distance ($L_2$) between the electrodes is 280 μm, and the distance ($L_3$) between the heat generating elements is 22 μm.

The heat transfer recording portion will now be described.

Figure 16:
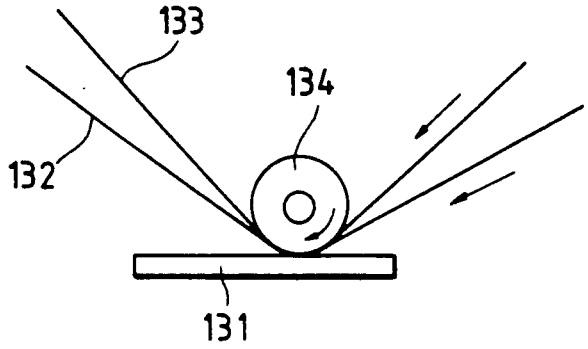
FIG. 16 shows the form of use of the thermal head of FIG. 15.

FIG. 16 is a schematic view of the recording portion of a heat transfer recording apparatus using the thermal head 131 of FIG. 15.

The thermal head 131 provided with a plurality of heat generating elements 111 and electrodes 112 for supplying electrical energy to the heat generating elements 111 is disposed astride the full recording width and in opposed relationship with a platen 134. The thermal head is mounted in such a manner that it can be urged against and spaced apart from the surface of the platen by a mechanism, not shown. During recording, the heat generating portion of the thermal head 131 is urged against the platen 134 with a recording sheet 133 and an ink sheet 132 which are supported by the platen 134 being interposed therebetween. In this state, the heat generating elements 111 of the thermal head 131 are selectively driven on the basis of an image signal, whereby the ink of the ink sheet 132 is melted and transferred to the recording sheet 133 to thereby accomplish recording.

The driving of the heat generating elements 111 is accomplished by a pulse voltage being applied to the electrodes 112 thereof. Each time predetermined recording is terminated, the recording sheet 133 and the ink sheet 132 are conveyed in the direction of arrow in FIG. 16.

Figure 17A:
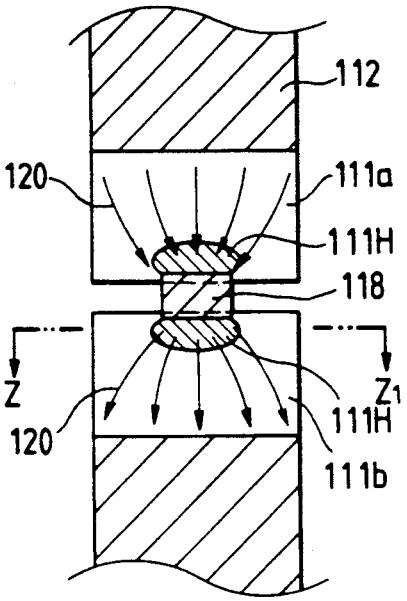
FIG. 17A shows an electric current flowing through the thermal head according to said another first embodiment.

FIG. 17A shows the flow of an electric current flowing from the common electrode 112*a* toward the individual electrode 112*b* when a pulse voltage is applied to the heat generating elements 111 of the thermal head shown in FIG. 15 through the electrodes 112.

In FIG. 17A, the reference numeral 120 represents the electric current flowing through the heat generating element 111, and the density of the electric current flowing through the heat generating element 111 is great at the vicinity 111H of the junctions between the narrow conductor portion 118 and the heat generating elements 111*a* and 111*b*.

Figure 17B:
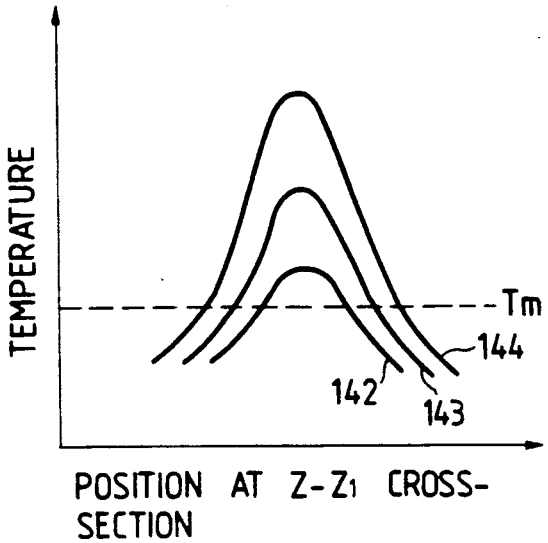
FIG. 17B shows the temperature distribution relative to the widthwise position in the cross-section $Z$-$Z_1$ of FIG. 17A.

FIG. 17B shows the temperature distribution in the vicinity of the conductor portion 118 in the heat generating element 111 (at the cross-section Z-$Z_1$ of FIG. 17A).

The temperature of the vicinity of this conductor portion 118 is particularly high in the heat generating element 111 and the temperature difference thereof from the other portion of the heat generating element 111 is very great. As the time of application of the pulse signal applied to the heat generating element 111 is gradually lengthened to change the applied energy, the widthwise temperature distribution at the cross-section Z-$Z_1$ of the heat generating element 111 varies as indicated by curves 142→143→144 in FIG. 17B.

Since the glaze layer 114 of the thermal head 131 protrudes about the central portion in a picture element with respect to its surroundings, the pressure force applied to the recording sheet 133 concentrates in the vicinity of the junction between the conductor portion 118 and the heat generating element 111. Also, the glaze layer 114 is thick in the vicinity of this portion and therefore, the amount of accumulated heat in that portion becomes great and the concentration effect of the heat generating energy becomes more remarkable. Thus, in the portion near this junction, it becomes easy for the ink of the ink sheet 132 to be transferred. In FIG. 17B, Tm indicates the melting point of the ink of the ink sheet 132, and in the temperature area higher than this, the ink of the ink sheet 132 is melted and transferred to the recording sheet 133.

Figure 17C:
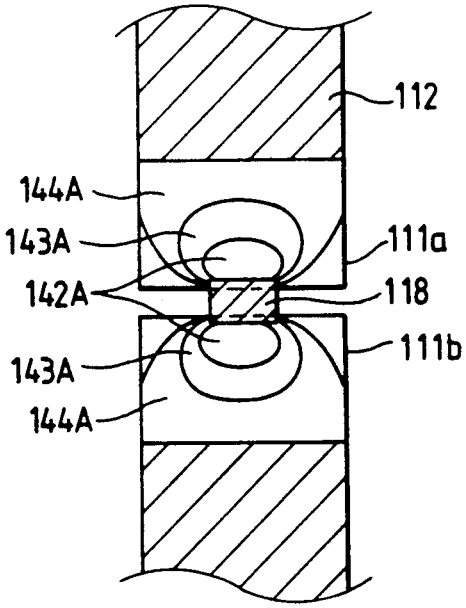
FIG. 17C shows the heat transfer area of the thermal head according to said another first embodiment.

Accordingly, the area of a dot transferred widens as indicated by 142A, 143A and 144A in FIG. 17C correspondingly to the variations in the temperature distributions 142, 143 and 144 of FIG. 17B. At this time, the shape of the head in the vicinity of the junction between the conductor portion 118 and the heat generating element 111 is convex. Therefore, the area of the dot is small and moreover, the reproducibility of image in the area of low recording density becomes good. Also, if as shown, for example, in FIG. 17B, the applied energy is varied and the temperature of the thermal head is varied, the transfer area will vary as shown in FIG. 17C, but for medium energy, a medium transfer area will be provided and continuous harmonization will become possible. That is, multivalue information can be recorded by a heat generating element 111.

Figure 18:
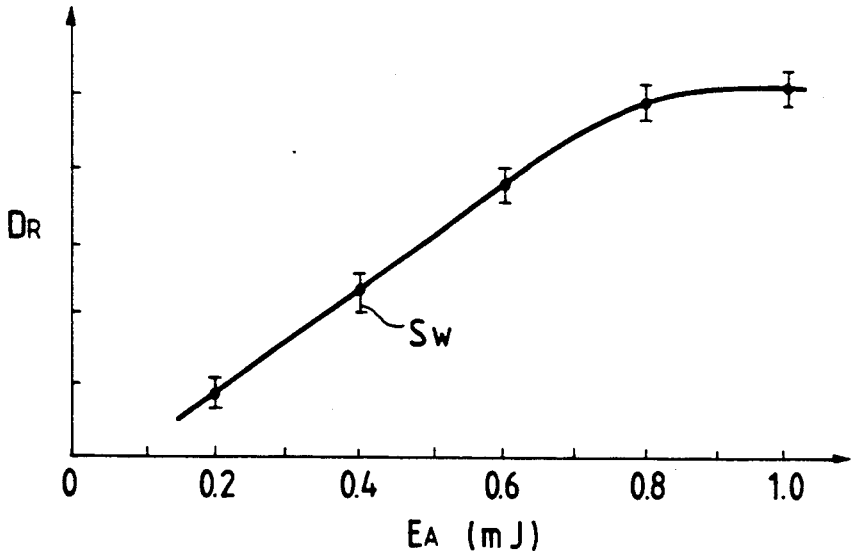
FIG. 18 shows the relation of recording density to applied energy in the thermal head according to said embodiment.

Also, as shown in FIG. 17B, the temperature gradient of those portions of the heat generating element 111 in the present embodiment which is near the electrodes is sufficiently great as compared with the prior-art heat generating element shown in FIG. 9, and the temperature of the heat generating element 111 is of a value sufficiently greater than the melting point Tm of the ink. Therefore, the change in the recording density for a minute variation in the applied energy can be suppressed, and the fluctuation of the recording density for that applied energy assumes an inclination (a rate of variation) as shown in the graph of FIG. 18. Also, the scattering width $S_W$ of the recording density $D_R$ for each applied energy $E_A$ is as shown by the length of the vertical line in the graph, and is sufficiently small as compared with the case shown in FIG. 9A.

Therefore, by controlling, for example, the time of application of the pulse signal to the thermal head or the voltage value thereof, i.e., the applied energy, the density of the picture element recorded by a heat generating element can be changed with good accuracy. Therefore, it becomes possible to express half tone, and the irregularity of the density in half tone recording can be made sufficiently small and stable.

Also, the heat generating central portion is the central portion of the heat generating element (when the heat generating elements 111*a* and 111*b* are regarded as one). Therefore, the amount of radiant heat to the common electrode 112*a* and the individual electrode 112*b* becomes small and the mutual interference between adjacent dots becomes small. On the other hand, the conductor portion 118 which is near the heat generating portion is a heat radiating substance which takes the heat of the heat generating portion away and reduces the heat efficiency of the heat generating element 111, but since the capacity (area) thereof is very small, there is no problem such as the deterioration of the energy efficiency by radiant heat. Rather, it moderately takes the heat of the heat generating central portion away, and this leads to the effect that the temperature of the heat generating resistance member need not be locally too high. That is, the thermal head according to the present embodiment is excellent in resolution and can effectively use the heat generating energy and further, by being endowed with a heat generation distribution, multivalue recording becomes possible.

While the present embodiment is of such a construction that the resistance layer 115 is not present in the lower layer of the narrow conductor portion 118, a similar effect has been recognized even when the resistance layer remains provided in the lower layer of the conductor portion 118 for the simplification or the like of the method of manufacturing the head. Also, the conductor portion 118 can be formed of a material having an electric conductivity substantially equal to that of the material of the electrode layer 116 forming the electrode portion 112, and need not always be the same material.

Also, in this embodiment, the heat generating element has been described as being divided into two, but may be divided into more portions. In such case, of course, the number of conductor portions for connecting these heat generating elements will be increased.

Figure 19:
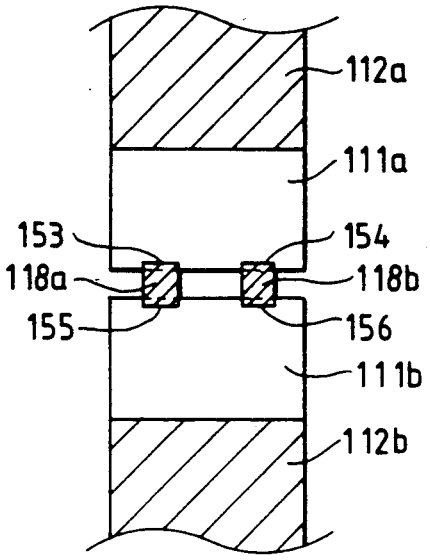
FIG. 19 shows the shape of a thermal head according to another second embodiment.

FIG. 19 is a top plan view of the heat generating elements and the electrodes of a thermal head according to still another second embodiment. In this thermal head, as compared with the thermal head according to the aforedescribed another first embodiment, the number of the narrow conductor portions is changed from one to two, and in FIG. 19, portions common to those in FIG. 15 are designated by the same reference characters.

In the thermal head of FIG. 19, two heat generating elements 111*a* and 111*b* are connected together by two conductor portions 118*a* and 118*b* provided on the opposed sides of these heat generating elements 111*a* and 111*b* or provided in spaced apart relationship with each other. The heat generating elements 111*a* and 111*b* and the conductor portions 118*a* and 118*b* are connected together, respectively, at two points (153, 154 and 155, 156) and therefore, the electric current concentrates in the vicinity of these junctions and the current density near the junctions becomes great.

Figure 20A:
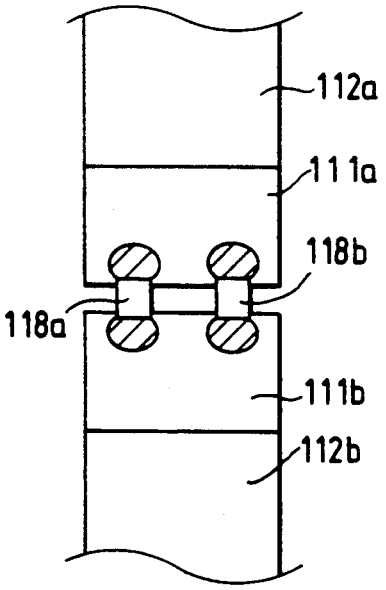
FIGS. 20A–20C show the heat transfer area relative to applied energy in the thermal head according to said another first embodiment.
Figure 20B:
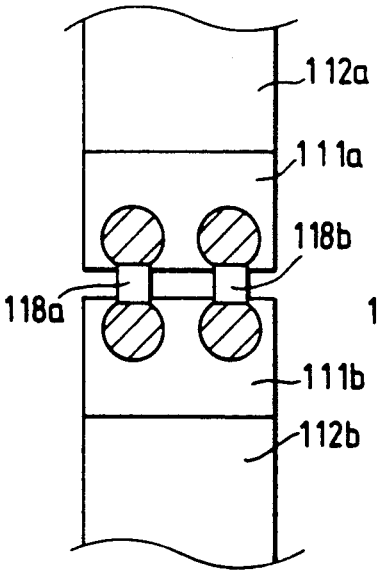
Figure 20C:
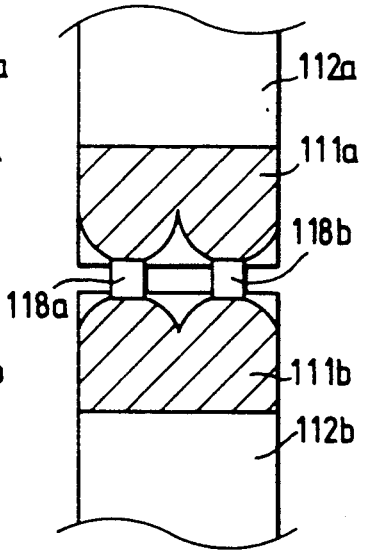

Thus, the heat energy applied to the thermal head is varied by a principle similar to that of the aforedescribed embodiment, whereby the dot area of ink transferred can be varied as indicated by hatching portions in FIGS. 20A-20C. In FIG. 20, portions common to those in FIG. 19 are designated by the same reference characters, and the applied energy is $A<B<C$. In this manner, the dot area is changed correspondingly to the applied energy, whereby half tone expression becomes possible.

Thus, according to said another second embodiment, in addition to the individual electrode and the common electrode, conductor portions narrower than the heat generating elements are formed and the heat generating elements on the individual electrode side and the common electrode side are electrically connected together by the conductor portions. By controlling the pulse width of the driving pulse applied by the heat generating elements, the amount of ink transferred to the recording sheet can be varied to express half tone. The number of the conductor portions is not limited to two.

Figure 21A:
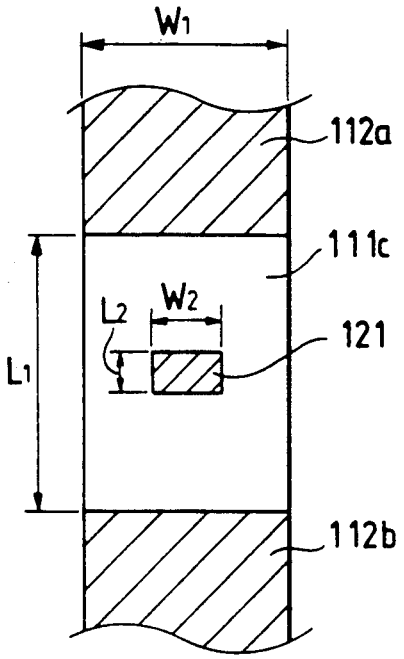
FIG. 21A shows the shape of a thermal head according to a third embodiment.

FIG. 21A shows an example of the structure of the heat generating element and the electrodes of a thermal head according to another third embodiment, and in FIG. 21A, portions common to those in FIG. 15 are designated by the same reference characters.

Here, the heat generating element 111*c* of the thermal head is not divided into two, and a conductor 121 is provided in the central portion of the heat generating element 111*c*.

An example of each size in the present embodiment is shown: the width ($W_1$) of the electrodes is 147 μm, the width ($W_2$) of the conductor is 40 μm, the length ($L_1$) of the heat generating element is 280 μm, and the length ($L_2$) of the conductor is 52 μm. In FIG. 21A, the conductor 121 is shown as being long sideways, but the vertical size thereof has been shown.

Figure 21B:
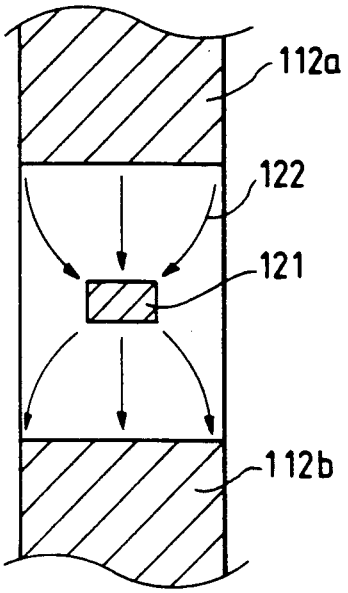
FIG. 21B shows the distribution of an electric current in the thermal head shown in FIG. 21A.

FIG. 21B shows the flow of the electric current in the thermal head of FIG. 21A.

Figure 22A:
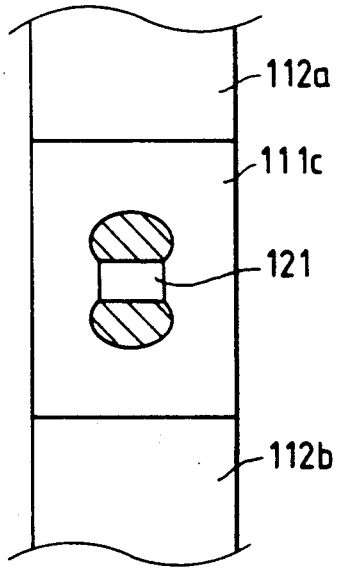
FIGS. 22A–22C show the heat transfer area relative to applied energy in a thermal head according to another third embodiment.
Figure 22B:
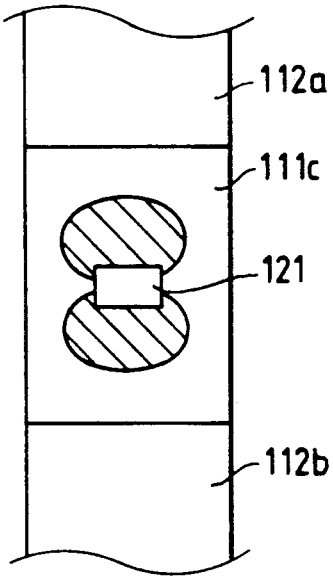
Figure 22C:
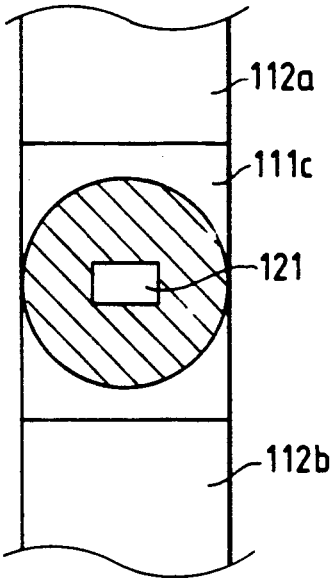

Here, as indicated by 122, the electric current concentrates in the conductor 121 at the center of the heat generating element 111*c* which is small in resistance value and therefore, the current density near the central conductor 121 becomes high and heat generation takes place concentratedly about this portion. So, if the energy applied to the thermal head is varied, the transfer area of the ink sheet changes as indicated by hatching portions in FIGS. 22A-22C and therefore, multiharmony recording becomes possible. Thus, in the thermal head according to said another third embodiment, as compared with the aforedescribed another first embodiment, the ink transfer in the opposite end portions becomes easy to effect.

Of course, the location and number of the conductor 121 are not limited to those shown in this embodiment.

As described above, according to the present embodiment, a shape in which a conductor portion is provided in the heat generating element of the thermal head is adopted, whereby the thermal head is formed so that there is provided a difference in the density of the electric current flowing through the heat generating element, and the glaze layer in the portion wherein the density of the electric current becomes great is protruded into a convex shape, whereby the control of the heat generating area, i.e., harmony expression, can be accomplished easily.

Other embodiments will further be described by the use of fourth to sixth embodiments. The embodiment which will now be described is a thermal head provided with heat generating elements and electrodes for supplying electrical energy to said heat generating elements, and the shape of said heat generating elements or said electrodes is formed so that the density of the electric current flowing through said heat generating elements may be rough and fine, and the glaze layer is protruded with respect to its surroundings in the portion thereof wherein the density of the electric current is fine.

DESCRIPTION OF FOURTH EMBODIMENT (FIG. 23)

Figure 23A:
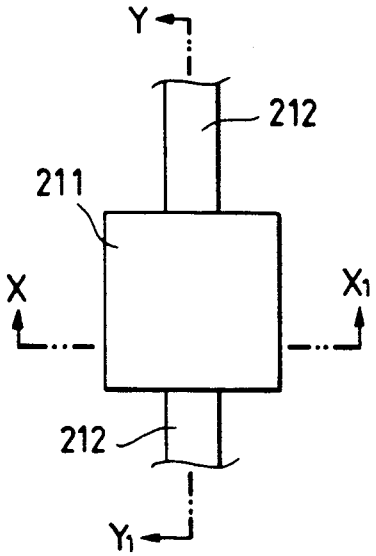
FIGS. 23A–23C show the shape of a thermal head according to a fourth embodiment.
Figure 23B:
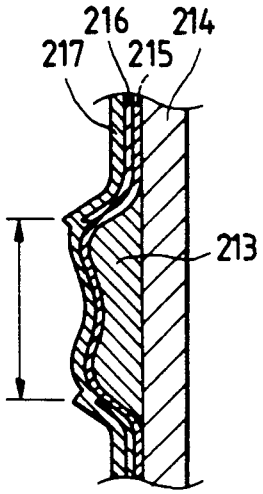
Figure 23C:
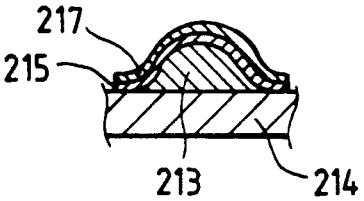

FIG. 23 shows the shapes of the heat generating element and the electrodes of a thermal head according to still another embodiment. FIG. 23A is a top plan view of a heat generating element and the electrodes thereof, FIG. 23B is a cross-sectional view taken along line $Y$-$Y_1$ of FIG. 23A, and FIG. 23C is a cross-sectional view taken along line $X$-$X_1$ of FIG. 23A.

The heat generating element 211 and the electrode portions 212 of this thermal head will hereinafter be described.

In the thermal head according to the present embodiment, a glaze layer 213 as a heat accumulating portion is formed on an alumina substrate 214. Further, a resistance layer 215 and an electrode layer 216 are formed on the glaze layer as by vacuum evaporation or sputtering. The electrode layer 216 is formed as by photolithography or photoetching, and a wear resisting layer 217 is further formed thereon as by sputtering. Here, the portion called the heat generating element 211 refers to the resistance layer in which the electrode layer 216 is cut.

As is apparent from FIG. 23A, the width of the electrode layer 216 (the electrodes 212) is smaller than the width of the heat generating element 211. As is clear from FIG. 23B, the glaze layer 213 corresponding to the width of the electrodes 212 protrudes with respect to its surroundings with the vicinity of the junctions between the heat generating element 211 and the electrodes 212 (the point at which the electrode layer 216 is cut) as the vertex and therefore, this portion is convex.

Figure 24A:
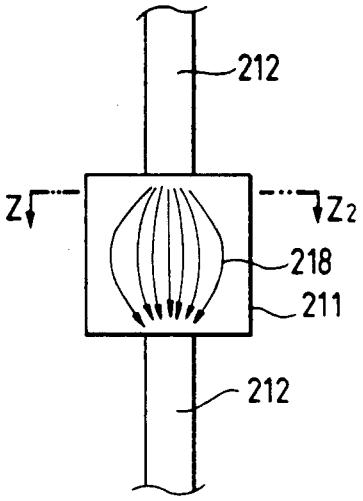
FIG. 24A shows an electric current flowing through the thermal head according to the fourth embodiment.

FIG. 24A shows the flow of an electric current when a pulse voltage is applied to the heat generating element 211 of the thermal head shown in FIGS. 23A-23C through the electrodes 212 narrower than the width of this heat generating element 211.

In FIG. 24A, the density of the electric current flowing through the heat generating element 211 is great near the junctions between the narrow electrodes 212 and the heat generating element 211.

Figure 24B:
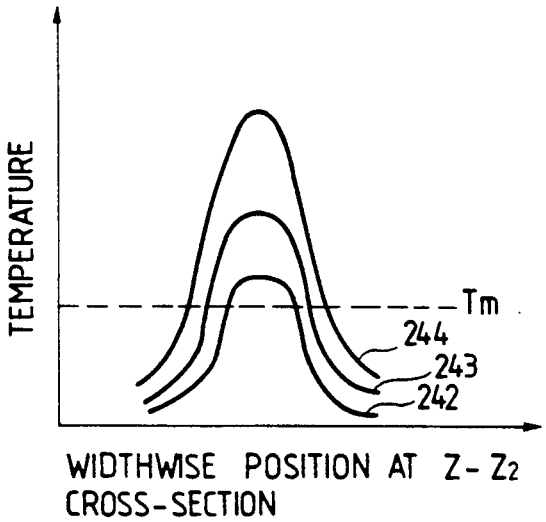
FIG. 24B shows the temperature distribution relative to the widthwise position in the cross-section Z of FIG. 24A.

FIG. 24B shows the temperature distribution in the portions of the heat generating element 211 which are near the electrodes 212 (at the cross-section $Z$-$Z_2$ of FIG. 24A).

The temperature of the vicinity of the electrodes 212 is particularly high in the heat generating element 211, and the temperature difference thereof from the other portion of the heat generating element 211 is very great. As the time of application of the pulse signal applied to the heat generating element 211 is gradually lengthened to change the applied energy, the widthwise temperature distribution at the cross-section $Z$-$Z_2$ of the heat generating element 211 varies as indicated by curves 242→243→244 in FIG. 24B.

Here, the thermal head is of such a construction that the glaze layer 213 thereof is protuberant with the vicinity of the junctions between the heat generating element 211 and the electrodes 212 as the vertex and is somewhat concave in the central portion of the heat generating element 211. Thus, the pressure force applied to the recording sheet 133 (FIG. 16) concentrates in the vicinity of the junctions between the electrodes 212 and the heat generating element 211. Also, the glaze layer 213 is thick near this portion and therefore, the amount of accumulated heat in that portion becomes great and the concentration effect of the heat generating energy becomes more remarkable. Thus, in the portions near the junctions, it becomes easy for the ink of the ink sheet to be transferred. In FIG. 24B, Tm indicates the melting point of the ink of the ink sheet 132 (FIG. 16), and in a temperature area higher than this, the ink of the ink sheet is melted and transferred to the recording sheet.

Figure 24C:
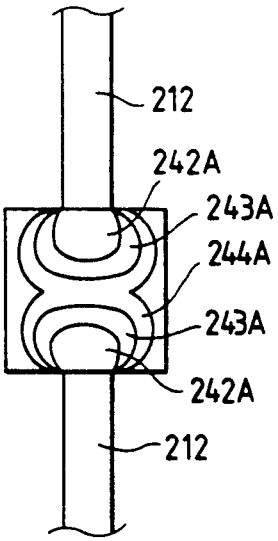
FIG. 24C shows the heat transfer area of the thermal head according to the fourth embodiment.

Accordingly, the area of a dot transferred widens as indicated by 242A, 243A and 244A in FIG. 24C, corresponding to the variations in the temperature distributions 242, 243 and 244 of FIG. 24B. At this time, the shape of the head in the vicinity of the junctions between the electrodes 212 and the heat generating element 211 is convex and therefore, the area of the dot becomes small and moreover, the reproducibility of image in the area wherein the recording density is low becomes good. Also, when the applied energy is varied as shown, for example, in FIG. 24B, the transfer area varies as shown in FIG. 24C. Therefore, multivalue information (for example, in the case of FIG. 24C, 2-bit data) can be recorded by a heat generating element 211.

Figure 25:
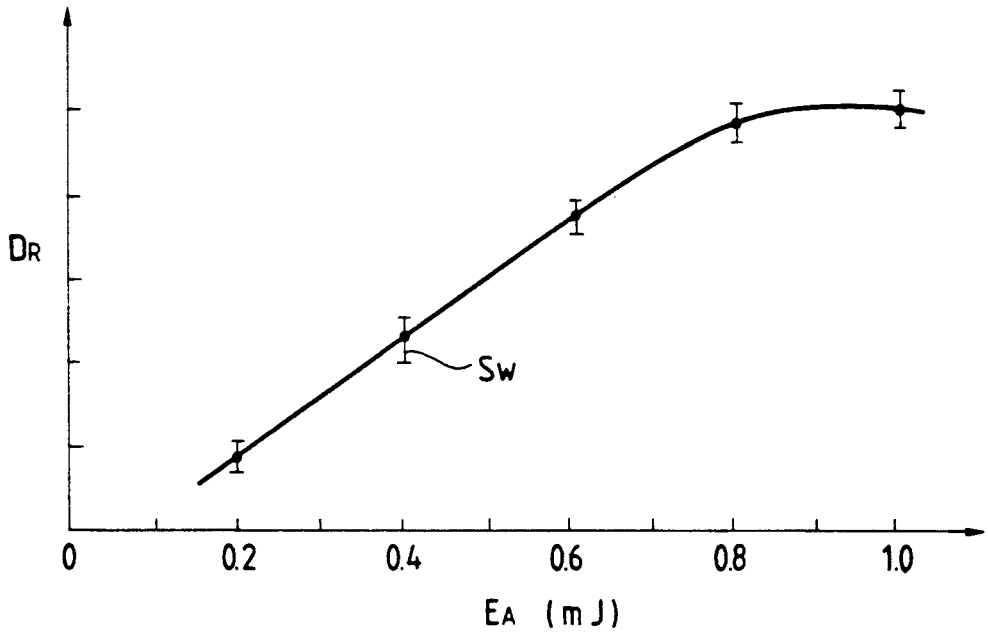
FIG. 25 shows the relation of recording density to applied energy in the thermal head according to said embodiment.

Also, as shown in FIG. 24B, the temperature gradient of the portions of the heat generating element 211 in the present embodiment which are near the electrodes is sufficiently great as compared with the prior-art heat generating element shown in FIG. 9, and the temperature of the heat generating element 211 is of a value sufficiently greater than the melting point Tm of the ink. Therefore, the change in the recording density for a minute variation in the applied energy can be suppressed, and the fluctuation of the recording density $D_R$ for that applied energy $E_A$ assumes an inclination (a rate of variation) as shown in the graph of FIG. 25. Also, the scattering width $S_W$ of the recording density $D_R$ for each applied energy $E_A$ is as indicated by the length of the vertical line in the graph, and is sufficiently small as compared with the case shown in FIG. 9A.

Therefore, by controlling, for example, the time of application of the pulse signal to the thermal head, or the voltage value thereof, i.e., the applied energy, the density of picture elements recorded by a heat generating element can be changed with good accuracy. Therefore, it becomes possible to express half tone and the irregularity of the density in half tone recording can be made sufficiently small and stable.

DESCRIPTION OF FIFTH EMBODIMENT (FIG. 26)

Figure 26A:
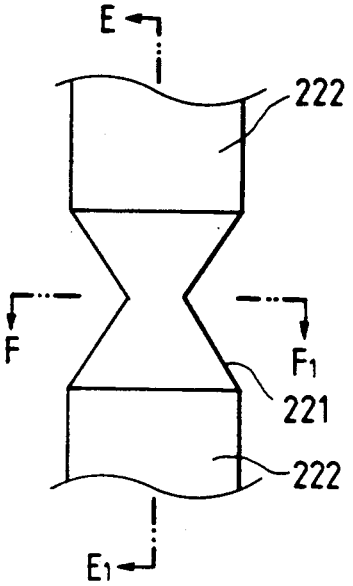
FIGS. 26A–26C show the shapes of a thermal head according to a fifth embodiment.
Figure 26B:
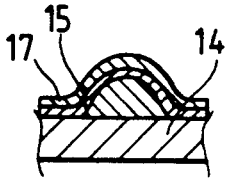
Figure 26C:
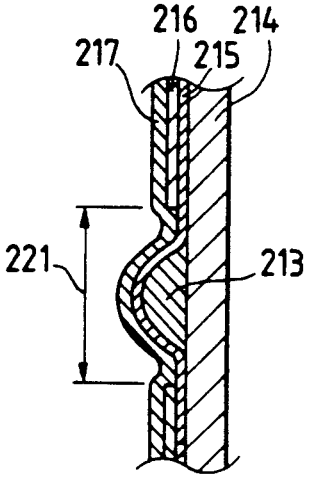

FIG. 26 shows the construction of a thermal head according to a fifth embodiment. FIG. 26A is a top plan view of the heat generating element 221 of the thermal head, FIG. 26B is a cross-sectional view showing the cross-section F-$F_1$ of FIG. 26A, and FIG. 26C is a cross-sectional view showing the cross-section E-$E_1$ of FIG. 26A. In FIG. 26, portions common to those in FIGS. 23A-23C are designated by the same reference characters.

As shown in FIG. 26A, the central portion of the heat generating element 221 is of a constricted shape and therefore, the electric current flowing through the heat generating element 221 concentrates in this constricted portion and thus, the electric current is dense in this portion. So, the thickness of the glaze layer corresponding to the middle of this central portion is made great to thereby protrude the glaze layer (FIGS. 26B and 26C). Thus, the force with which this central portion is urged against the recording sheet 133 (FIG. 16) during recording becomes strong.

Figure 27:
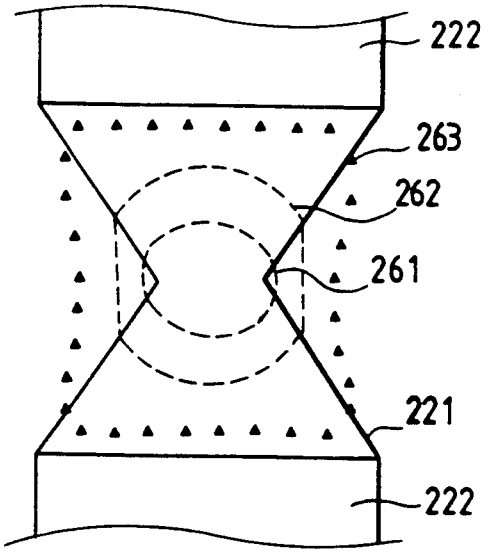
FIG. 27 shows the heat generation temperature distribution in the thermal head according to the fifth embodiment.

Also, generally, by thickening the glaze layer, the accumulated heat in that portion of the head becomes great and therefore, the concentration effect of the heat generating energy becomes more remarkable and it becomes easy for the ink of the ink sheet to be melted and transferred. In this manner, the heat energy applied to the head is varied, whereby the dot area of the ink transferred is varied correspondingly to an increase in the applied energy, as indicated by 261, 262 and 263 in FIG. 27, and therefore half tone expression becomes possible.

DESCRIPTION OF SIXTH EMBODIMENT (FIG. 28)

Figure 28A:
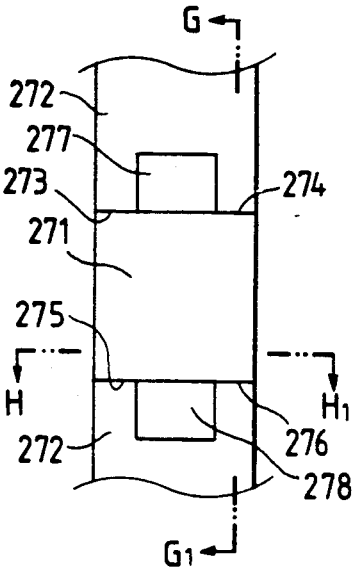
FIGS. 28A–28C show the shapes of a thermal head according to a sixth embodiment.
Figure 28B:
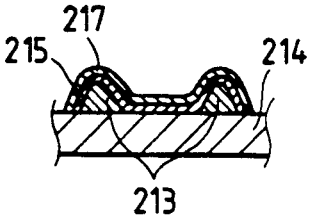
Figure 28C:
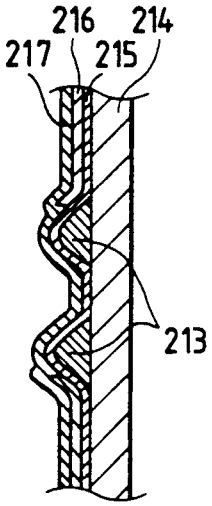

FIGS. 28A-28C show an example of the structure of the heat generating element 271 and the electrodes 272 of a thermal head according to a sixth embodiment, and FIG. 28A is a top plan view thereof, FIG. 28B is a cross-sectional view showing the cross-section H-$H_1$ of FIG. 28A, and FIG. 28C is a cross-sectional view showing the cross-section G-$G_1$ of FIG. 28A. In these figures, portions common to those in FIGS. 23A-23C are designated by the same reference characters.

In the thermal head of FIG. 28, the electrodes 272 are connected to the heat generating element 271 at two locations toward the opposite sides of the heat generating element 271 or at two spaced apart points (273, 274 and 275, 276). Therefore, the electric current concentrates in those portions of the heat generating element 271 which are near the junctions at which the electrodes 272 are connected to the heat generating element 271, and the density of the electric current in the vicinity thereof becomes great. Portions designated by 277 and 278 in FIG. 28A are, for example, opening portions or insulating portions.

Figure 29A:
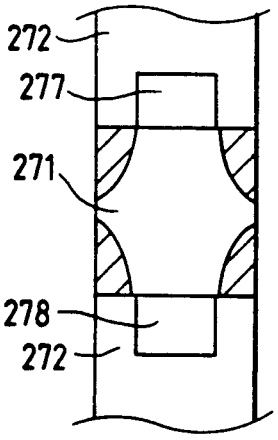
FIGS. 29A–29C show the heat generation distribution corresponding to applied energy to the thermal head according to the sixth embodiment.
Figure 29B:
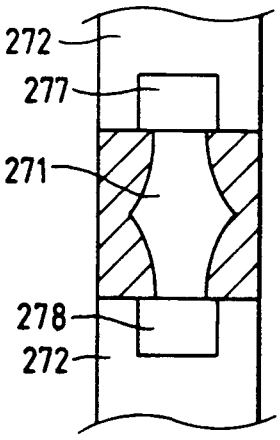
Figure 29C:
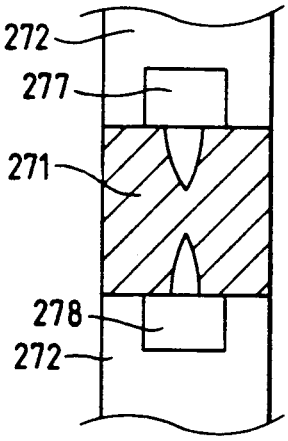

So, as shown in FIGS. 28B and 28C, the glaze layer 213 corresponding to the vicinity of the portions of the heat generating element in which the electrodes 272 are connected to the heat generating element is made thick and protruded with respect to its surroundings. Thus, the heat energy applied to the head is varied by a principle similar to that of the aforedescribed embodiment, whereby the dot area of the ink transferred can be varied as shown in FIGS. 29A-29C. In FIGS. 29A-29C, portions common to those in FIGS. 28A-28C are designated by the same reference characters, and the applied energy is $A<B<C$. The transferred area is the portions of the heat generating element 271 which are indicated by hatching and thus, as is apparent from the figures, the transfer of the ink widens from the four corners of the heat generating element 271 (the portions corresponding to 273-276 in FIGS. 28A-28C). In this manner, the dot area is changed correspondingly to the applied energy, whereby half tone expression becomes possible.

Thus, according to the present embodiment, the shapes, sizes, widths, etc. of the heat generating element and the electrodes are formed so that the electric current flowing through the heat generating element may be partly dense, and the glaze layer 213 in the portion wherein the density of the electric current becomes great (the heat generation temperature becomes high) is protruded into a concave shape with respect to its surroundings. By controlling the pulse width of the driving pulse applied to the heat generating element, the amount of ink transferred to the recording sheet is varied and half tone can be expressed.

As described above, according to the present embodiment, the shapes of the heat generating element and the electrodes of the thermal head are formed so that there may be provided a difference in the density of the electric current flowing through the heat generating element, and the glaze layer in that portion wherein the density of the electric current becomes great is protruded into a concave shape, whereby the control of the heat generating area, i.e., harmony expression, can be accomplished easily.

Other embodiments will further be described by the use of seventh to eleventh embodiments. The embodiment of the thermal head which will now be described is one which is provided with a plurality of heat generating resistance members arranged in a row and electrodes for supplying electrical energy to respective ones of said plurality of heat generating resistance members and in which the width of said electrodes is less than the effective width of said heat generating resistance members at the junctions between said electrodes and said heat generating resistance members and the width of the electrodes in the portion thereof remote from said junctions is greater than the width of the electrodes at said junctions.

DESCRIPTION OF SEVENTH EMBODIMENT (FIG. 30)

Figure 30:
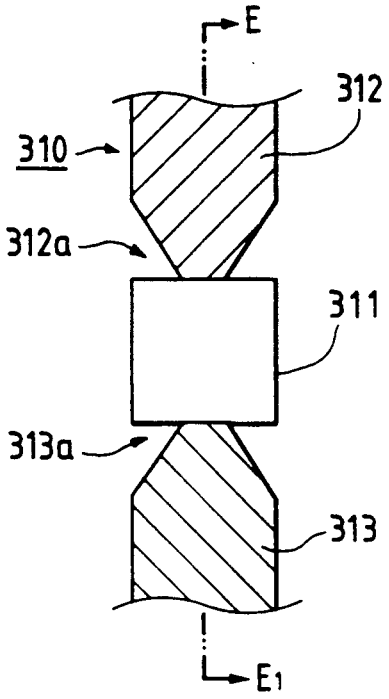
FIG. 30 is an enlarged front view showing the shape of the heat generating element and the electrode portion of a thermal head according to a seventh embodiment.
Figure 31:
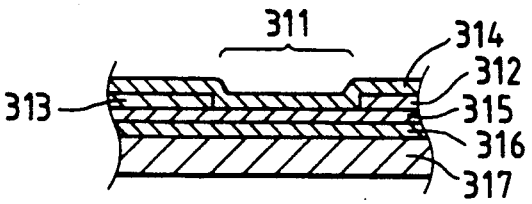
FIG. 31 shows the cross-section $E$-$E_1$ of the heat generating element of FIG. 30.

FIG. 30 shows the shapes of a heat generating element and electrodes of a thermal head 310 according to still another embodiment, and FIG. 31 is a cross-sectional view showing the cross-section E-$E_1$ of FIG. 30.

In FIG. 30, the reference numeral 311 designates a heat generating element of the thermal head 310, and this thermal head 310 is comprised of a plurality of such heat generating elements 311 arranged in a row, and image recording is accomplished by these heat generating elements being selectively electrically energized correspondingly to recording data. The reference numeral 312 denotes a common electrode for supplying electric power to each heat generating element, and the reference numeral 313 designates a signal electrode provided correspondingly to each heat generating element, and by the voltage level thereof being changed correspondingly to the recording data, the control of the electrical energization of the heat generating elements 311 is executed.

The heat generating element 311 and the electrodes 312 and 313 of the thermal head 311 according to the present embodiment will now be described with reference to FIG. 31. A glaze layer 316 as a heat accumulating portion is formed on an alumina substrate 317. A resistance layer 315 and an electrode layer 312 are further formed on the glaze layer as by vacuum evaporation or sputtering. The electrodes 312 and 313 and the heat generating element 311 are formed as by photolithography or photoetching, and a wear resisting layer 314 is further formed thereon as by sputtering. The portion called the heat generating element 311 refers to the resistance layer portion between the electrode layers 312 and 313.

As is apparent from FIG. 30, the electrode width of portions 312*a* and 313*a* in which the heat generating element 311 is connected to the electrodes 312 and 313 is smaller than the width of the heat generating element 311, and the electrode width in the portion remote from the junctions 312*a* and 313*a* is substantially equal to the width of the heat generating element 311.

Figure 32A:
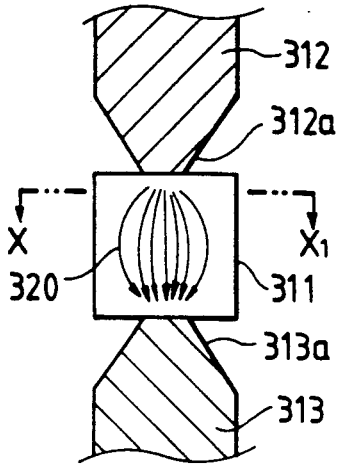
FIG. 32A shows the distribution of an electric current flowing through the thermal head according to the seventh embodiment.

FIG. 32A shows the flow of an electric current when a pulse voltage is applied to the heat generating element 311 of the thermal head 310 shown in FIG. 30 through the electrodes 312 and 313 smaller in width than the heat generating element 311.

In FIG. 32A, the reference numeral 320 designates an electric current flowing through the heat generating element 311, and the density of the electric current flowing through the heat generating element 311 is great near the junctions 312*a* and 313*a* between the narrow electrodes 312, 313 and the heat generating element 311.

Figure 32B:
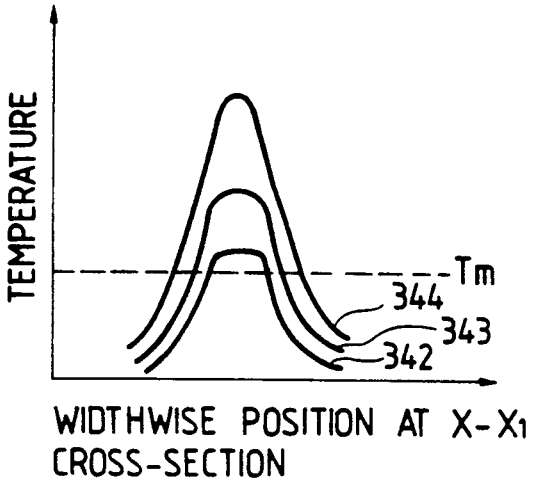
FIG. 32B shows the temperature distribution relative to the widthwise position at the cross-section $X-X_1$ of FIG. 32A.

FIG. 32B shows the temperature distribution near the electrode 312 in the heat generating element 311 (at the cross-section X-$X_1$ of FIG. 32A).

The temperature of the vicinity of the electrode 312 (or the electrode 313) is particularly high in the heat generating element 311. As the time of application of the pulse signal applied to the heat generating element 311 is gradually lengthened to change the applied energy to the heat generating element 311, the widthwise temperature distribution at the cross-section X-$X_1$ of the heat generating element 311 varies as indicated by curves 342→343→344 in FIG. 32B. In FIG. 32B, Tm indicates the melting point of the ink of the ink sheet 132 (FIG. 16), and in a temperature area higher than this, the ink of the ink sheet 132 is melted and transferred to the recording sheet 133 (FIG. 16).

Figure 32C:
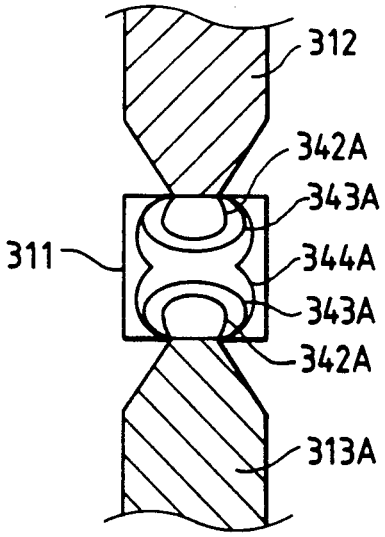
FIG. 32C shows the heat transfer area corresponding to applied energy to the thermal head according to the seventh embodiment.

Accordingly, the area of a dot transferred widens as indicated by 342A, 343A and 344A in FIG. 32C, correspondingly to the variations in the temperature distributions 342, 343 and 344 of FIG. 32B.

Also, the width of the electrodes 312 and 313 is small near the junctions 312*a* and 313*a* in which the electrodes are connected to the heat generating element 311, but in the other portion, the width of the electrodes is substantially equal to the width of the heat generating element 311. Therefore, as compared with the heat generating element of the prior-art thermal head, no special accuracy is required of this heat generating element and therefore, the yield during the manufacture changes very little. Consequently, there can be provided a thermal head which is good in productivity and low in cost.

How a variation in the recording density appears by varying the applied energy to such a thermal head has been measured by the use of the thermal head. The result is shown in FIG. 33.

Figure 33:
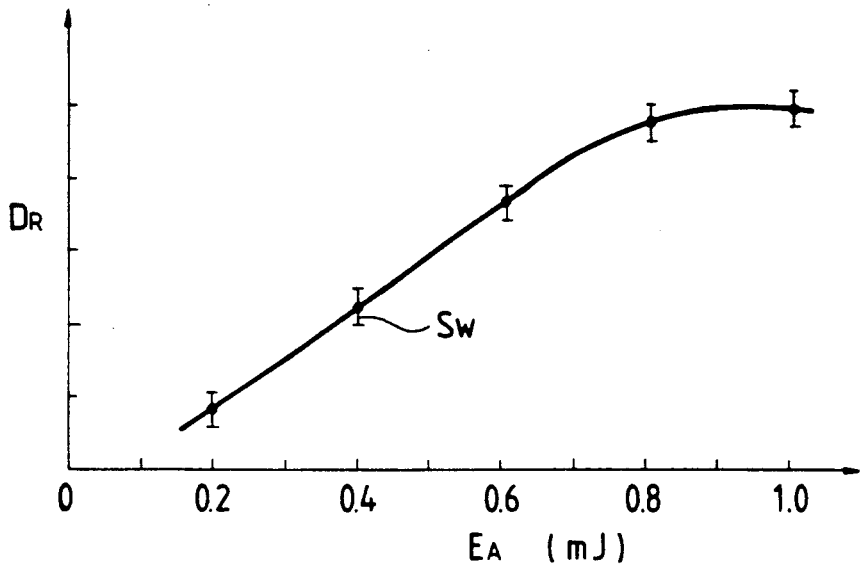
FIG. 33 shows the relation of recording density to applied energy in the thermal head according to said embodiment.

As the result, the recording density $D_R$ assumes an inclination (a rate of variation) as shown in the graph of FIG. 33, for the magnitude of the applied energy $E_A$, and the scattering width $S_W$ of the density becomes small as indicated by the length of vertical lines in the graph. Therefore, by controlling, for example, the time of application of the pulse signal applied to the thermal head 310, or the voltage value thereof, i.e., the applied energy, the density of picture elements recorded by a heat generating element can be changed with good accuracy. Thus, it becomes possible to express half tone and the irregularity of the density in half tone recording can be made sufficiently small and stable.

DESCRIPTION OF EIGHTH EMBODIMENT (FIG. 34)

Figure 34:
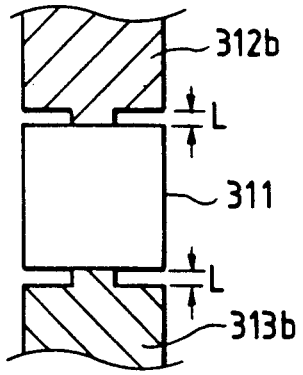
FIG. 34 is an enlarged front view showing the shapes of the heat generating element and the electrodes of a thermal head according to an eighth embodiment.

FIG. 34 shows the shapes of the heat generating element 311 and the electrodes 312*b* and 313*b* of a thermal head according to an eighth embodiment.

In this heat generating element 311, the electrode width in the vicinity of the junctions between the common electrode 312*b* and the heat generating element 311 and between the signal electrode 313*b* and the heat generating element 311 is smaller than the width of the heat generating element 311, and in the portion remote from the heat generating element 311, the electrode width is substantially equal to the width of the heat generating element 311.

Generally, the heat of the heat generating element 311 is radiated into the air and in addition, is radiated through the electrodes 312 and 313 which are high in heat conductivity. Accordingly, by adopting a shape as shown in FIG. 34, the heat radiation of the heat generating element 311 takes place through the electrodes 312 and 313 proximate thereto by a distance L. Therefore, the heat radiation of the heat generating element 311 does not concentrate in the vicinity of the junctions between the electrodes and the heat generating element 311. Thus, the heat radiation of the heat generating element 311 becomes substantially uniform over the entire element 311, whereby the heat concentration effect can be enhanced more.

The distance L between the heat generating element 311 and the electrode 312, 313 need be made longer than the limit value of the manufacturing accuracy of the head in order to prevent the contact between the electrodes and the heat generating element 311. If conversely, the distance L is too long, the heat radiation effect by the electrodes 312 and 313 will not be obtained and thus, the heat radiation of the heat generating element 311 will concentrate in the vicinity of the junctions between the heat generating element and the electrodes. Further, if the distance L is too long, the portion in which the width of the electrodes at the junctions between the heat generating element 311 and the electrodes 312, 313 will become long and therefore, the yield of manufacture will become bad.

The above result can be collectively shown in the Table below.

TABLE

| Distance L | Harmonization | Yield of manufacture |
|---|---|---|
| 0.05 μm | — | X (bad) |
| 0.1 μm | ◎ | ○ |
| 1 μm | ◎ | ◎ |
| 10 μm | ◎ | ◎ |
| 50 μm | ◎ | ◎ |
| 3 mm | ○ | ◎ |
| 10 mm | Δ | X |

As is apparent from the above table, the harmonization when thermal heads in which the distance L is 0.1 μm–3 mm are used to vary the amount of the applied energy is good. In addition, there is no problem in the yield of manufacture of these thermal heads. However, when the distance L is less than 0.1 μm, manufacture is impossible in respect of the manufacturing accuracy, and when the distance L is greater than 3 mm, the portion in which the width of the electrodes is small becomes long and therefore, the yield of manufacture becomes bad.

DESCRIPTION OF NINTH EMBODIMENT (FIG. 35)

Figure 35:
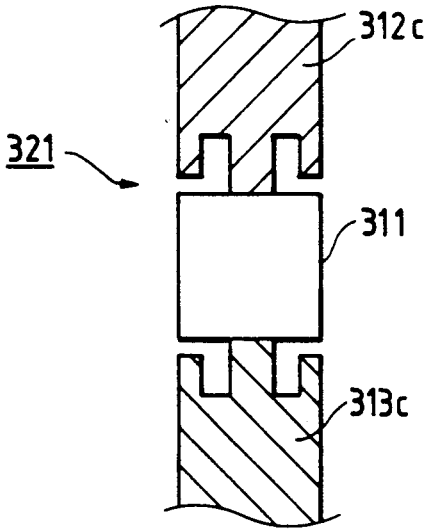
FIG. 35 is an enlarged front view showing the shapes of the heat generating element and the electrodes of a thermal head according to a ninth embodiment.

FIG. 35 is an enlarged front view showing the shapes of the heat generating element 311 and the electrodes 312*c* and 313*c* of a thermal head 321 according to a ninth embodiment. The electrode 312*c* is a common electrode, and the electrode 313*c* is a signal electrode.

As shown, in the junctions between the heat generating element 311 and the electrodes 312*c* and 313*c*, the width of the electrodes 312*c* and 313*c* is sufficiently small as compared with the width of the heat generating element 311. In the portions remote from the junctions of the electrodes 312*c* and 313*c* and moreover, in the portions near the marginal portion of the heat generating element 311, the electrodes 312*c* and 313*c* are proximate to the heat generating element 311 with a minute space formed therebetween.

The heat generation temperature distribution when this heat generating element 311 is electrically energized is shown in FIG. 36.

Figure 36A:
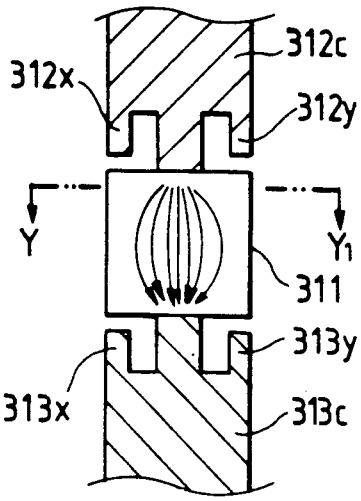
FIG. 36A shows the distribution of an electric current in the heat generating element of the thermal head according to the ninth embodiment.

FIG. 36A shows the distribution of an electric current flowing through the heat generating element 311, and in the vicinity of the junctions between the heat generating element 311 and the electrodes 312*c* and 313*c* in which the width of the electrodes is small, the density of the electric current is high. Further, it is the narrow portions of the electrodes 312*c* and 313*c* that are in contact with the heat generating element 311, but as indicated by 312*x* and 312*y* (313*x* and 313*y*), portions of the electrodes are proximate to the vicinity of the marginal portion of the heat generating element 311. Therefore, the heat of the marginal portion of the heat generating element 311 is conducted and radiated through the portions 312*x* and 312*y* (313*x* and 313*y*) of the electrodes. Thus, in a state in which the heat generating element 311 is generating heat, the temperature of the marginal portion of the heat generating element 311 becomes particularly lower than that of the other portion.

Figure 36B:
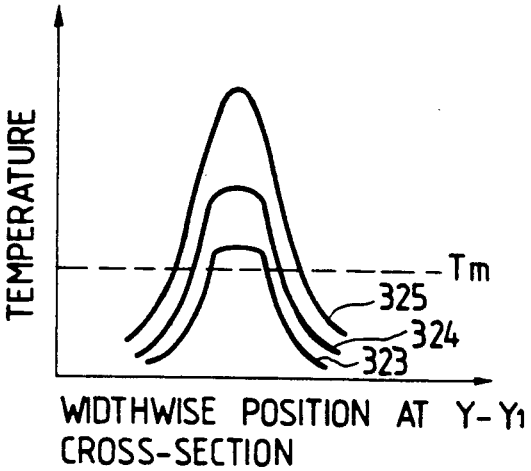
FIG. 36B shows the temperature distribution in the portion $Y-Y_1$ of FIG. 36A.
Figure 36C:
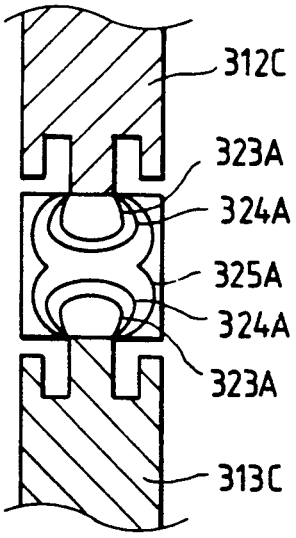
FIG. 36C shows the transfer area relative to the temperature distribution.

FIG. 36B shows the heat generation temperature distribution of the portion of the heat generating element 311 which is near the electrode 312*c* (313*c*) and particularly high in temperature (the portion $Y$-$Y_1$ of FIG. 36A), and the temperature difference between this portion and the other portion of the heat generating element is particularly great. So, as the time of application of the pulse voltage is gradually lengthened to change the applied energy, the widthwise temperature distribution of the heat generating element 311 varies as indicated by curves 323→324→325 in FIG. 36B.

If at this time, the melting point of the ink of the ink sheet 132 (FIG. 16) is Tm, the ink is melted in a temperature area higher than Tm and is transferred to the recording sheet 133 (FIG. 16). Accordingly, the dot area transferred widens as indicated by 323A, 324A and 325A in FIG. 36C, in conformity with the variation in the temperature distribution shown in FIG. 36B. The time of application of the pulse is in the relation that 323<324<325.

Also, the relation between the applied energy $E_A$ and the recording density $D_R$ by this thermal head 321 assumes an inclination corresponding to the applied energy as in the aforedescribed case of FIG. 33, and the scattering width $S_W$ of each density is small as indicated by a vertical line in the graph.

Figure 37:
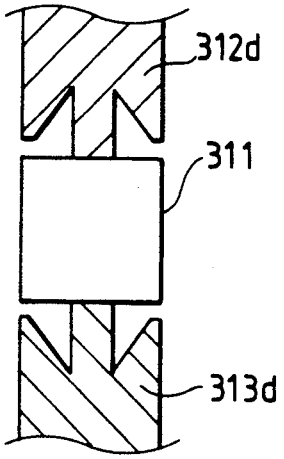
FIGS. 37 and 38 are enlarged front views showing the shapes of the heat generating elements and the electrodes of thermal heads according to tenth and eleventh embodiments.
Figure 38:
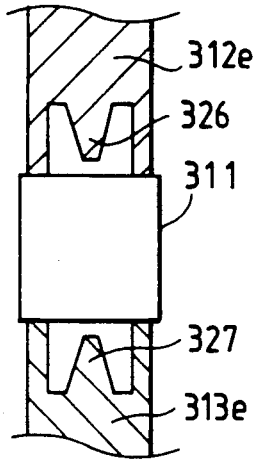

FIGS. 37 and 38 show the shapes of the heat generating elements and the electrodes of thermal heads according to tenth and eleventh embodiments.

DESCRIPTION OF TENTH EMBODIMENT (FIG. 37)

In the heat generating element 311 and electrodes 312*d* and 313*d* of FIG. 37, the portions of the electrodes 312*d* and 313*d* which protrude toward the heat generating element 311 are made greater in width away from the heat generating element 311 in order to increase the heat radiation effect of the marginal portion of the heat generating element 311.

DESCRIPTION OF ELEVENTH EMBODIMENT (FIG. 38)

FIG. 38 show the shapes of the heat generating element 311 and the electrodes 312*e* and 313*e* of the thermal head according to the eleventh embodiment.

In this embodiment, the electrodes 312*e* and 313*e* are bifurcated halfway and connected to the marginal portion of the heat generating element 311. The protruded portion 326 (327) of each electrode is proximate to the central portion of the electrode which are remote from these junctions. The temperature distribution when this heat generating element 311 is electrically energized is shown in FIG. 39.

Figure 39:
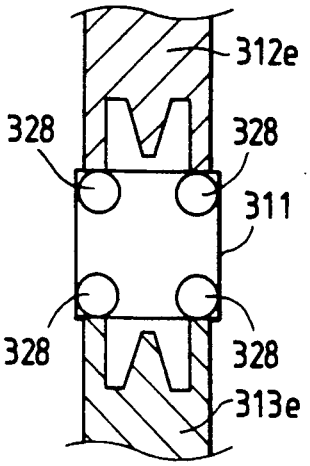
FIG. 39 shows the heat generation distribution in the heat generating element of FIG. 38.

In this figure, the vicinity of the junctions between the electrodes 312*e*, 313*e* and the heat generating element 311 in which the density of the electric current flowing through the heat generating element 311 becomes highest in temperature, and becomes the center of heat generation (transfer) as indicated by 328 in FIG. 39. Thus, according to the heat generating element of FIG. 38, the areas 328 which are the centers of transfer are present at four locations in a heat generating element and therefore, there is the effect that harmonization increases falsely and resolution increases.

As described above, in the thermal head according to the present embodiment, the width of the electrodes at the junctions between the heat generating element and the electrodes is made smaller than the width of the heat generating element and the width of the electrodes in the portions thereof remote from the junctions is made greater than the width of the electrodes at the junctions, whereby the yield during the manufacture of the head is good, and by controlling the applied energy, harmony expression can be accomplished easily.

Also, in the thermal head according to the present embodiment, a portion of the electrodes is made proximate to the heat generating element, whereby the heat radiation of the heat generating element can be changed to make the temperature of the heat generating element more uniform.

Other embodiments will further be described by the use of twelfth to fourteenth embodiments. The embodiment of the thermal head which will now be described is one which is provided with a plurality of heat generating resistance members arranged in a row and electrodes for supplying electrical energy to respective ones of said plurality of heat generating resistance members and in which the width of said electrodes is smaller than the effective width of said heat generating resistance members at the junctions between said electrodes and said heat generating resistance members and the resistance value of said heat generating resistance members is higher in the vicinity of said junctions.

DESCRIPTION OF TWELFTH EMBODIMENT (FIG. 40)

Figure 40:
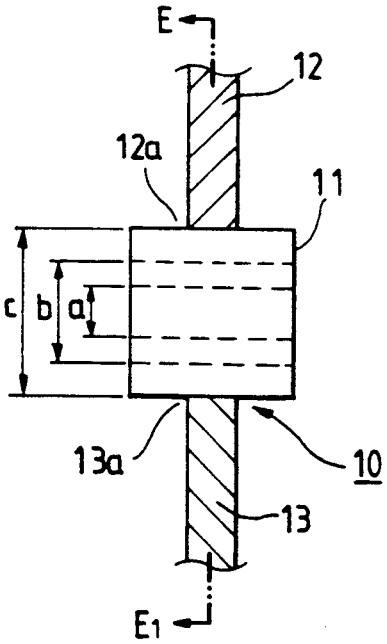
FIG. 40 is an enlarged front view showing the shapes of the heat generating element and the electrode portion of a thermal head according to still another embodiment.
Figure 41:
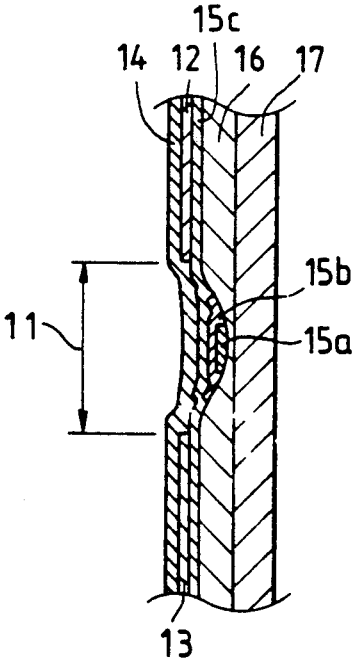
FIG. 41 shows the cross-section $E-E_1$ of FIG. 40.

FIG. 40 is an enlarged front view showing the shapes of a heat generating element 411 and the electrodes 412 and 413 of a thermal head 410 according to still another embodiment, and FIG. 41 is a cross-sectional view showing the cross-section E-$E_1$ of FIG. 40.

In FIG. 40, the reference numeral 411 designates a heat generating element of the thermal head 410, and this thermal head 410 is comprised of a plurality of such heat generating elements 411 arranged in a row, and these heat generating elements are selectively electrically energized correspondingly to recording data, whereby image recording is accomplished. The electrode 412 is a common electrode for supplying electric power to each heat generating element, and the electrode 413 is a signal electrode provided correspondingly to each heat generating element, and by the voltage level thereof being changed correspondingly to the recording data, the control of the electrical energization of the heat generating elements 411 is executed.

The heat generating element 411 and the electrodes 412 and 413 of the thermal head 410 according to the present embodiment will now be described with reference to FIG. 41. A glaze layer 416 as a heat accumulating portion is formed on an alumina substrate 417. Resistance layers 415*a*, 415*b*, 415*c* and an electrode layer 412 (413) are further formed on the glaze layer as by vacuum evaporation or sputtering. The electrode layer and the resistance layers are partly cut away as by photolithography or photoetching to thereby form the electrodes 412 and 413 and the heat generating element 411, and a wear resisting layer 414 is further formed thereon as by sputtering. Here, the portion called the heat generating element 411 refers to the resistance layer portion between the electrode layers 412 and 413.

As is apparent from FIG. 40, the width of the electrodes in the portions 412*a* and 413*a* thereof wherein the heat generating element 411 and the electrodes 412 and 413 are connected together is smaller than the width of the heat generating element 411. Also, in FIG. 40, the letter a indicates the length of the resistance layer 415*a* in the direction of flow of the electric current, and likewise, the letter b indicates the length of the resistance layer 415*b* in the direction of flow of the electric current. The letter c indicates the length between the electrodes 412 and 413 which form the heat generating element 411. By such a construction, the resistance layer portion comprising resistance layers 415*a*–415*c* is of a shape in which a level difference is provided in the thickness along the direction of flow of the electric current flowing from the electrode 412 toward the electrode 413, and the resistance value of the heat generating element 411 varies non-continuously along the direction of flow of the electric current.

Thus, the resistance value of the portions of the heat generating element 411 which are near to the electrodes 412 and 413 is great and the central portion of the heat generating element 411 is smallest in resistance value. The glaze layer in the central portion of the heat generating element 411 is formed concavely in advance so that the central portion of the heat generating element 411 may not be made convex by a level difference being thus provided in the resistance layer.

Figure 42A:
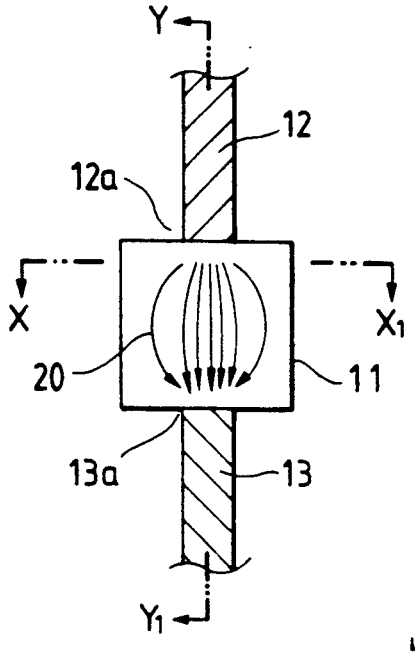
FIG. 42A shows the distribution of an electric current flowing through a thermal head according to a twelfth embodiment.

FIG. 42A shows the flow of the electric current when a pulse voltage is applied to the heat generating element 411 of the thermal head 410 shown in FIG. 40, through the electrodes 412 and 413 which are smaller in width than this heat generating element 411.

In FIG. 42A, the reference numeral 420 designates the electric current flowing through the heat generating element 411, and the density of the electric current flowing through the heat generating element 411 is great near the junctions 412*a* and 413*a* between the narrow electrodes 412, 413 and the heat generating element 411.

Figure 42B:
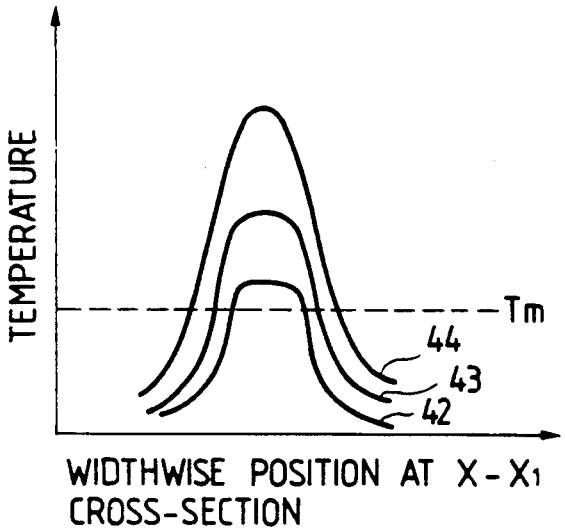
FIG. 42B shows the temperature distribution relative to the widthwise position at the cross-section $X-X_1$ of FIG. 42A.

FIG. 42B is a graph showing the temperature distribution of that portion of the heat generating element 411 which is near the electrode 412 (at the cross-section $X\text{-}X_1$ of FIG. 42A).

The temperature of the vicinity of the electrode 412 (or the electrode 413) (the vicinity of the junctions 412*a* and 413*a*) is particularly high in the heat generating element 411. As the time of application of the pulse signal applied to the signal electrode 413 of the heat generating element 411 is gradually lengthened to change the applied energy to the heat generating element 411, the widthwise temperature distribution at the cross-section $X\text{-}X_1$ of the heat generating element 411 varies as indicated by curves 442→443→444 in FIG. 42B. In FIG. 42B, Tm indicates the melting point of the ink of the ink sheet 132 (FIG. 16), and in a temperature area higher than this, the ink of the ink sheet 132 is melted and transferred to the recording sheet 134 (FIG. 16). The relation of the pulse width of the applied pulse signal is 442<443<444.

Figure 42C:
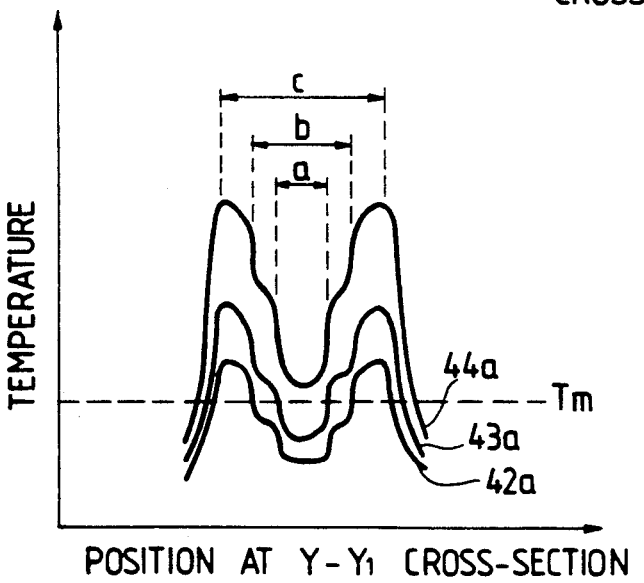
FIG. 42C shows the heat generation temperature distribution at the cross-section $Y-Y_1$ of FIG. 42A.

FIG. 42C shows the temperature distribution at the cross-section $Y\text{-}Y_1$ of FIG. 42A, and correspondingly to 442-444 in FIG. 42B, the temperature distribution is shown by 442*a*, 443*a* and 444*a* corresponding to the respective times of application. As is apparent from this figure, the temperature assumes a peak near the junctions between the heat generating element 411 and the electrodes 412 and 413, and the heat generation temperature is low in the central portion of the heat generating element 411. Also, the curve indicative of the temperature distribution is substantially vertical in the portion which intersects the temperature Tm and therefore, the irregularity of the transfer area is small.

This is because the junctions 412*a* and 413*a* are highest in the density of the electric current and the resistance value of the heat generating element 411 is higher toward the vicinity of the junctions and moreover, the resistance value of the heat generating element 411 varies non-continuously along the direction of flow of the electric current. Again in FIG. 42C, Tm indicates the melting point of the ink of the ink sheet 132, and a, b and c indicate the lengths of the resistance layers of FIG. 40 in the direction of flow of the electric current. Also, the glaze layer is concave in the central portion of the heat generating element 411 and the thickness thereof is increased at the junctions between the heat generating element 411 and the electrodes and therefore, the amount of radiant heat is great in the central portion of the heat generating element 411 and conversely, the amount of radiant heat is small near the electrodes. Thus, the amount of the heat generated near the junctions between the electrodes and the heat generating element and radiated through the electrodes and the alumina substrate becomes smaller and the concentration effect of the heat generating energy becomes more remarkable.

Figure 43:
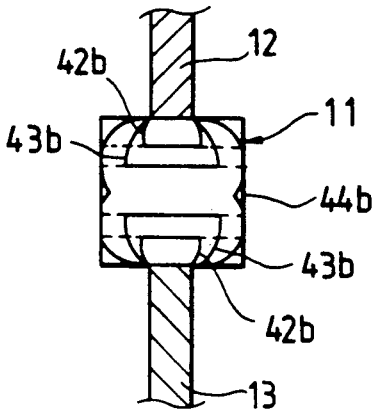
FIG. 43 shows the heat transfer area corresponding to applied energy to the thermal head according to the twelfth embodiment.

By such an effect, the shape of a dot transferred by the heat generating element 411 of this thermal head 410 becomes such as shown by 442*b*, 443*b* and 444*b* in FIG. 43. As is apparent from this figure, a fine edge portion is formed at the level difference in the thickness provided by the resistance layers 415*a* and 415*b*. Therefore, the transfer area can be changed with good accuracy correspondingly to the applied energy and the reproducibility of harmony becomes good.

Figure 44:
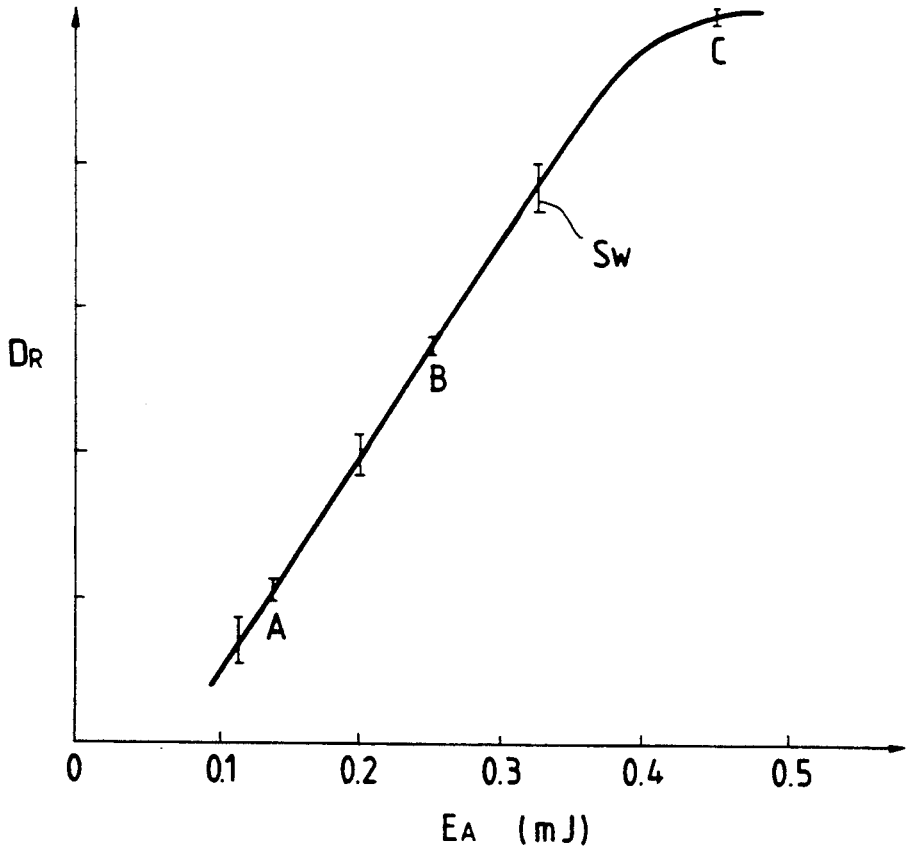
FIG. 44 shows the relation of recording density to applied energy in the thermal head according to said embodiment.

FIG. 44 is a graph showing the relation of the recording density $D_R$ to the applied energy $E_A$ in this thermal head 410.

In FIG. 44, the inclination (the rate of variation) of the recording density $D_R$ relative to the magnitude of the applied energy $E_A$ is sufficiently small as compared with the case of FIG. 9A, and the scattering width $S_W$ of the recording density $D_R$ relative to each applied energy $E_A$ also is small as indicated by the length of vertical lines in the graph. Particularly, the variation in the recording density in areas indicated by A, B and C in FIG. 44 is small, and these areas correspond to 442*b*, 443*b* and 444*b*, respectively, indicative of the transfer areas of FIG. 43.

Thus, by controlling the applied energy to this thermal head 410, half tone can be expressed and the irregularity of the recording density in this half tone recording becomes sufficiently small and stable. Also, the thickness of the heat generating element 411 of this thermal head 410 is varied at two stages and therefore, the scattering width of the density is particularly small at two points of medium density. Therefore, if multivalue recording of total four (2+2) values is effected at said two points and two points of solid density and density "0", the density reproducibility will become very good. For such a reason, harmony recording can be accomplished with good reproducibility even on coarse paper having a small degree of smoothness.

DESCRIPTION OF THIRTEENTH EMBODIMENT (FIG. 45)

Figure 45:
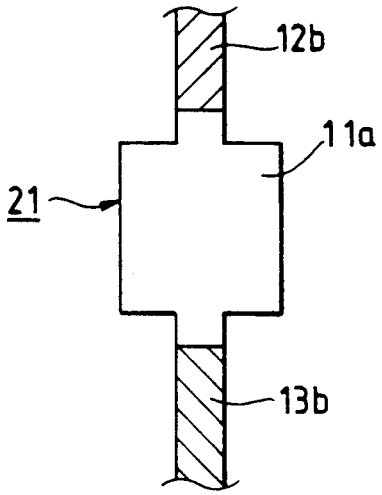
FIG. 45 is an enlarged front view showing the shapes of the heat generating element and the electrodes of a thermal head according to a thirteenth embodiment.

FIG. 45 is an enlarged front view showing the shapes of a heat generating element 411*a* and the electrodes 412*b* and 413*b* of a thermal head 421 according to a thirteenth embodiment.

In this thermal head 421, the width of the heat generating element 411*a* is smaller near the common electrode 412*b* and the signal electrode 413*b*, and is greater in the central portions of the electrodes 412*b* and 413*b*. Also, the width of the electrodes 412*b* and 413*b* is smaller than that of the central portion of the heat generating element 411*a*. Therefore, the resistance value is higher in the portions of the heat generating element 411*a* which are near the electrodes, and the heat generation temperature of those portions is also higher.

It is FIG. 46 that shows the transfer area when this thermal head 421 is electrically energized.

Here is shown an area in which, as described with reference to FIG. 42, the heat generation temperature of the heat generating element 411*a* becomes higher than the melting point Tm of the ink of the ink sheet 132. The reference numerals 422 and 423 indicate the transfer areas when the applied energy to the heat generating element 411*a* is made small, and the reference numeral 424 indicates the transfer area when the applied energy is made great, and in this case, the transfer area covers substantially the entire area of the heat generating element 411*a*.

In this manner, the energy applied to the heat generating element 411*a* is adjusted to change the transfer area of the ink sheet transferred, whereby half tone expression becomes possible. There is, for example, one level difference in the resistance value of this head and therefore, if multivalue recording of total three values (i.e., 1+2=3) is effected at one point of medium density and two points of solid density and density "0", the density reproducibility will become very good.

DESCRIPTION OF FOURTEENTH EMBODIMENT (FIG. 47)

Figure 47:
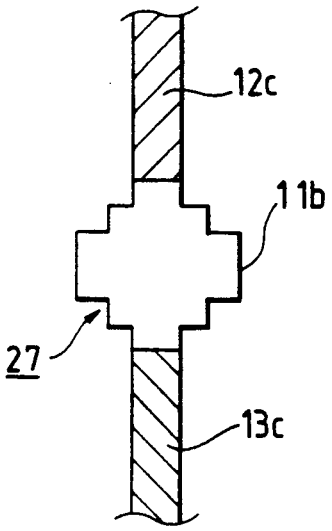
FIG. 47 is an enlarged front view showing the shapes of the heat generating element and the electrodes of a thermal head according to a fourteenth embodiment.

FIG. 47 is an enlarged view showing the shapes of a heat generating element 411*b* and the electrodes 412*c* and 413*c* of a thermal head 427 according to a fourteenth embodiment, and by making the shape of the heat generating element 411*b* such as shown, more harmony expressions are made possible. That is, the width of the heat generating element 411*b* is varied at one more stage than in the case of the heat generating element 411*a* of FIG. 45 and the heat energy applied to the heat generating element 411*b* is varied, whereby two level differences are provided in the resistance value in the heat generating element and four-value (2+2=4) recorging can be accomplished.

As described above, in the thermal head according to the present embodiment, the width of the electrodes at the junctions between the heat generating element and the electrodes is made smaller than the width of the heat generating element, and the resistance value of the heat generating element is made higher in the portions thereof which are near the electrodes and lower in the central portion thereof, and by controlling the applied energy to this thermal head, harmony expression can be accomplished with good accuracy.

Other embodiments will further be described by the use of fifteenth to twenty-first embodiments. The embodiment of the thermal head which will now be described is one which has a plurality of heat generating resistance members arranged in a row, electrodes narrower than the effective width of said heat generating resistance members and supplying electrical energy to the respective ones of said heat generating resistance members, and a glaze layer which is thick in the portions wherein said heat generating resistance members are connected to said electrodes and thin substantially in the central portions of said heat generating resistance members.

DESCRIPTION OF FIFTEENTH EMBODIMENT (FIG. 48)

Figure 48A:
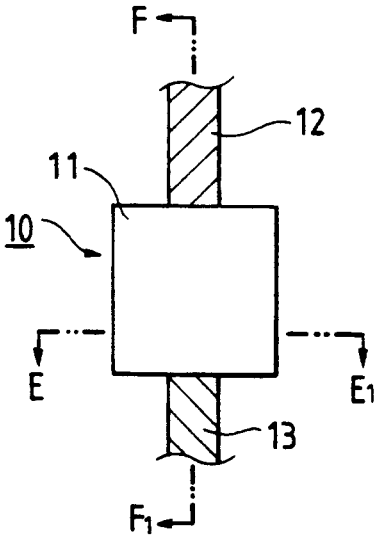
FIG. 48A is an enlarged front view showing the shapes of the heat generating element and the electrode portion of a thermal head according to a fifteenth embodiment.
Figure 48B:
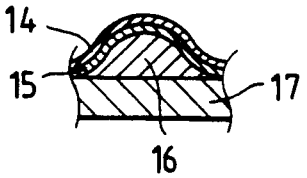
FIG. 48B shows the cross-section E-E' of the heat generating element of FIG. 48A.
Figure 48C:
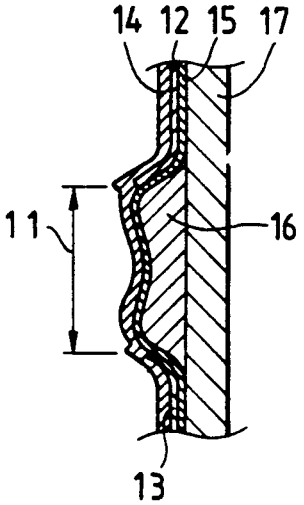
FIG. 48C shows the cross-section F-F' of the heat generating element of FIG. 48A.

FIG. 48 shows the shapes of a heat generating element 511 and the electrodes 512 and 513 of a thermal head 510 according to a fifteenth embodiment, and FIG. 48A is an enlarged front view thereof, FIG. 48B is a cross-sectional view showing the cross-section E-$E_1$ of FIG. 48A, and FIG. 48C is a cross-sectional view showing the cross-section F-$F_1$ of FIG. 48A.

In FIG. 48, the reference numeral 511 designates a heat generating element of the thermal head 510, and this thermal head 510 is comprised of a plurality of such heat generating elements 511 arranged in a row, and by these heat generating elements being selectively electrically energized correspondingly to recording data, image recording is accomplished. The electrode 512 is a common electrode for supplying electric power to each heat generating element, and the electrode 513 is a signal electrode provided correspondingly to each heat generating element, and by the voltage level thereof being changed correspondingly to the recording data, the control of the electrical energization of the heat generating elements 511 is executed.

The heat generating element 511 and the electrodes 512 and 513 of the thermal head 510 according to the present embodiment will now be described with reference to FIGS. 48B and 48C. A glaze layer 516 as a heat accumulating portion is formed on an alumina substrate 517. A resistance layer 515 and an electrode layer 512 (513) are further formed on the glaze layer as by vacuum evaporation or sputtering. The electrodes and the resistance layer are partly cut away as by photolithography or photoetching to thereby form the electrodes 512 and 513 and the heat generating element 511, and a wear resisting layer 514 is further formed thereon as by sputtering. The portion called the heat generating element 511 refers to the portion of the resistance layer 515 which is between the electrodes 512 and 513. The wear resisting layer includes all of what serves as a protective film such as an antioxidation layer.

As is apparent from FIGS. 48A–48C, the width of the electrodes in the portions wherein the heat generating element 511 is connected to the electrodes 512 and 513 is smaller than the width of the heat generating element 511. Also, the glaze layer corresponding to the width of these electrodes 512 and 513 protrudes with the junctions between the heat generating element 511 and the electrodes 512 and 513 as the vertices and therefore, the shape of the heat generating element 511 at these junctions is convex.

Figure 49A:
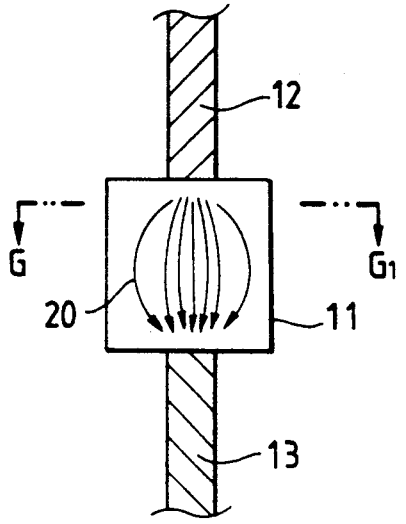
FIG. 49A shows the distribution of an electric current flowing through the heat generating element in the fifteenth embodiment.

FIG. 49A shows the flow of the electric current when a pulse voltage is applied to the heat generating element 511 of the thermal head 510 shown in FIG. 48, through the electrodes 512 and 513 which are narrower than the width of the heat generating element 511.

In FIG. 49A, the reference numeral 520 designates the electric current flowing through the heat generating element 511, and the density of the electric current flowing through the heat generating element 511 is great near the junctions between the narrow electrodes 512, 513 and the heat generating element 511.

Figure 49B:
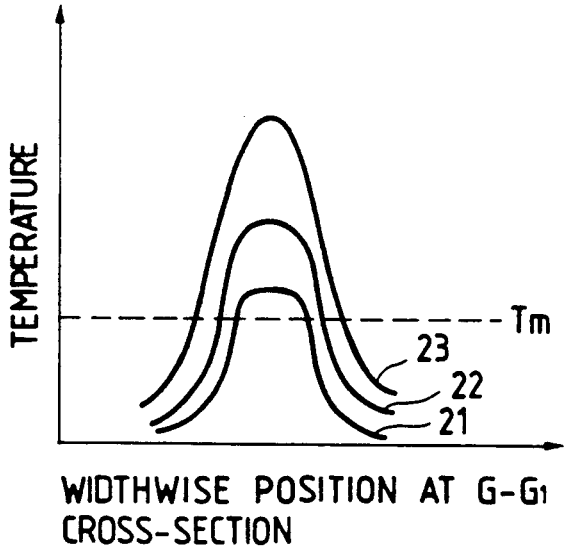
FIG. 49B shows the heat generation distribution in the cross-section $G-G_1$ of FIG. 49A.

FIG. 49B is a graph showing the temperature distribution in the portion of the heat generating element 511 which is near the electrode 512 (at the cross-section G-$G_1$ of FIG. 49A).

The temperature of the vicinity of the electrode 512 (or the electrode 513) (which is near the junctions) is particularly high in the heat generating element 511, and the temperature difference from the other portion of the heat generating element 511 exhibits a great value. As the time of application of the pulse signal applied to the heat generating element 511 is gradually lengthened to change the applied energy to the heat generating element 511, the widthwise temperature distribution at the cross-section X-$X_1$ of the heat generating element 511 varies as indicated by curves 521→522→523 in FIG. 29B. In FIG. 49B, Tm indicates the melting point of the ink of the ink sheet 132 (FIG. 16), and in a temperature area higher than this, the ink of the ink sheet 132 is melted and transferred to the recording sheet 133.

Here, the thermal head 510 is of a shape in which the wear resisting layer 514 thereof is protuberant with the junctions between the heat generating element 511 and the electrodes 512, 513 as the vertices and the central portion of the heat generating element 511 is somewhat concave. Therefore, the pressure force applied to between the thermal head 510 and the recording sheet 133 concentrates in and near the junctions between the electrodes 512, 513 and the heat generating element 511. Also, in those portions, the glaze layer 514 is thicker, whereby the heat accumulation in those portions becomes great and therefore, the concentration effect of the heat generation temperature becomes more remarkable. Thus, it becomes easier for the ink of the ink sheet in this portion to be transferred.

Figure 49C:
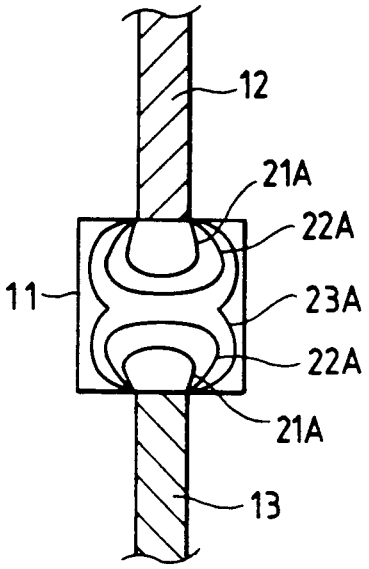
FIG. 49C shows the transfer area corresponding to applied energy to the heat generating element in a sixteenth embodiment.

As a result, the temperature area (the transfer area) of the heat generating element 511 in which the temperature becomes higher than the melting point Tm of the ink of the ink sheet 132 is such as indicated by 521A, 522A and 523A in FIG. 49C, correspondingly to the temperature distribution of FIG. 49B. Also here, the shape of the heat generating element 511 is a convex shape as shown in FIGS. 48A-48C and therefore, this thermal head becomes excellent in the transfer and reproducibility in the low recording density area wherein the dot area is small.

Figure 50:
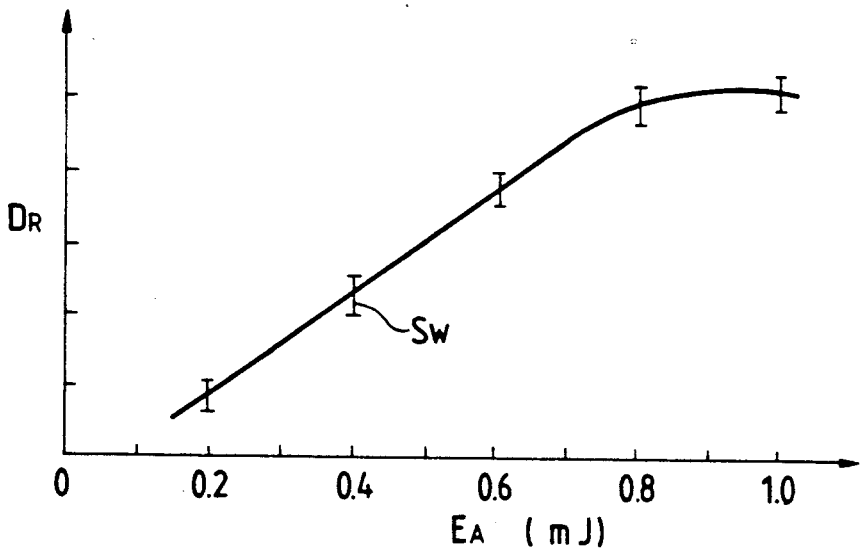
FIG. 50 shows the relation of recording density to applied energy in the thermal head according to said embodiment.

FIG. 50 is a graph showing the relation of the recording density to the applied energy in this thermal head 510.

In FIG. 50, the inclination (the rate of variation) of the recording density $D_R$ relative to the magnitude of the applied energy $E_A$ to the thermal head 510 is sufficiently small as compared with the case of FIG. 9A, and the scattering width $S_H$ of the recording density $D_R$ relative to each applied energy $E_A$ is also small as shown by the length of vertical lines in the graph. It is thus seen that half tone can be expressed by controlling the applied energy and the irregularity of the recording density in half tone recording becomes sufficiently small and stable.

DESCRIPTION OF SIXTEENTH EMBODIMENT (FIG. 51)

Figure 51A:
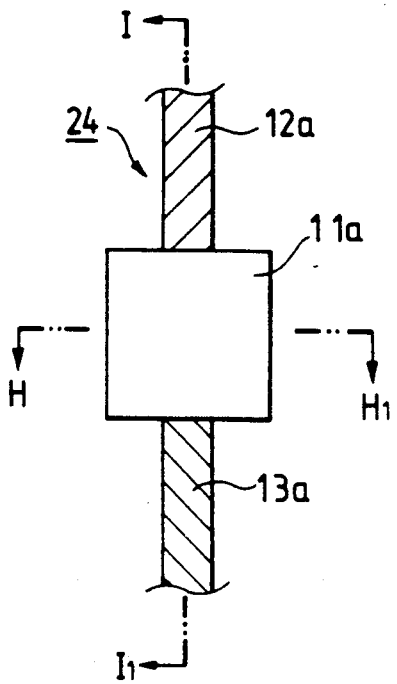
FIGS. 51A-51C show the shapes of the heat generating element and the electrodes in the sixteenth embodiment.
Figure 51B:
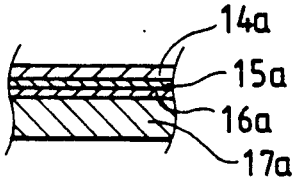
Figure 51C:
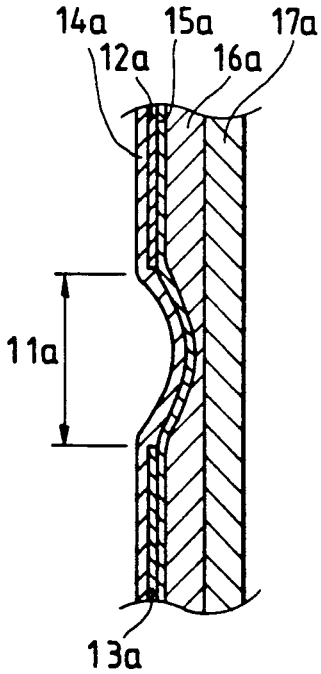

FIGS. 51A-51C show the shapes of the heat generating element 511*a*, the common electrode 512*b* and the signal electrode 513*b* of a thermal head 524 according to a sixteenth embodiment, FIG. 51A being an enlarged front view thereof, FIG. 51B being a cross-sectional view showing the cross-section H-$H_1$ of FIG. 51A, and FIG. 51C being a cross-sectional view showing the cross-section I-$I_1$ of FIG. 51A.

In this thermal head 524, like the heat generating element 511 of FIG. 48, the width of the electrodes 512*a* and 513*a* is smaller than the width of the heat generating element 511*a*. The construction of this heat generating element 511*a* will now be described with reference to FIGS. 51B and 51C. A glaze layer 516*a* as a heat accumulating portion is formed on an alumina substrate 517*a*. A resistance layer 515*a* and an electrode layer 512*a* (513*a*) are further formed on the glaze layer as by vacuum evaporation or sputtering. The electrode layer and the resistance layer are partly cut away as by photolithography or photoetching to thereby form the electrodes 512*a* and 513*a* and the heat generating element 511*a*, and a wear resisting layer 514*a* is further formed thereon as by sputtering. Here, the portion called the heat generating element 511*a* refers to that portion of the resistance layer 515*a* which is between the electrodes 512*a* and 513*a*.

Also, as shown in FIG. 51C, the glaze layer 516*a* is thin in the central portion of the heat generating element 511*a* and thick under the electrodes 512*a* and 513*a*, and the central portion of the heat generating element 511*a* is concave. Thus, the amount of accumulated heat in the vicinity of the junctions between the electrodes and the heat generating element 511*a* which is the center of heat generation becomes great and the amount of radiant heat of the central portion (the concave portion) of the heat generating element 511*a* becomes great. Consequently, as described with respect to the fifteenth embodiment, the transfer area widens about the junctions, and by controlling the applied energy to the head, half tone expression can be accomplished.

DESCRIPTION OF SEVENTEENTH EMBODIMENT (FIG. 52)

Figure 52A:
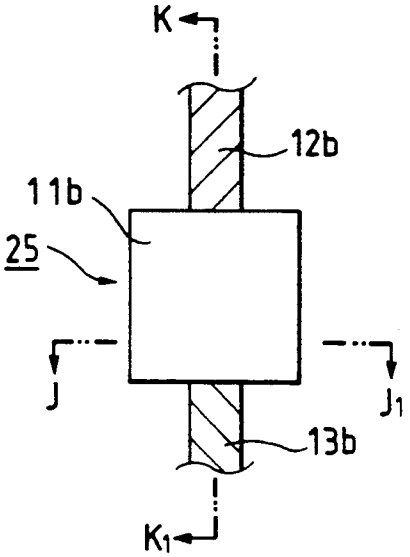
FIGS. 52A-52C show the shapes of the heat generating element and the electrodes in a seventeenth embodiment.
Figure 52B:
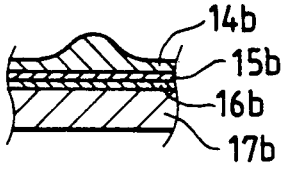
Figure 52C:
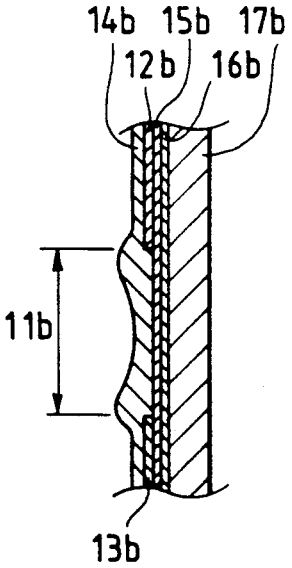

FIGS. 52A-52C show the shapes of a heat generating element 511*b* and the electrodes 512*b* and 513*b* of a thermal head 525 according to a seventeenth embodiment, FIG. 52A being an enlarged front view thereof, FIG. 52B being a cross-sectional view showing the cross-section J-$J_1$ of FIG. 52A, and FIG. 52C being a cross-sectional view showing the cross-section K-$K_1$ of FIG. 52A.

In FIGS. 52A-52C, the reference character 511*b* designates a heat generating element of the thermal head 525, and this thermal head 525 is comprised of a plurality of such heat generating elements 511*b* arranged in a row, and by these heat generating elements being selectively electrically energized correspondingly to recording data, image recording is accomplished. The electrode 512*b* is a common electrode for supplying electric power to each heat generating element, and the electrode 513*b* is a signal electrode provided correspondingly to each heat generating element, and by the voltage level thereof being changed correspondingly to the recording data, the control of the electrical energization of the heat generating elements 511*b* is executed.

The heat generating element 511*b* and the electrodes 512*b* and 513*b* of the thermal head 525 according to the seventeenth embodiment will now be described with reference to FIGS. 52B and 52C. As in the aforedescribed embodiment, a glaze layer 516*b* as a heat accumulating portion is formed on an alumina substrate 517*b*. A resistance layer 515*b* and an electrode layer 512*b* (513*b*) are further formed on the glaze layer as by vacuum evaporation or sputtering. The electrode layer and the resistance layer are partly cut away as by photolithography or photoetching to thereby form the electrodes 512*b* and 513*b* and the heat generating element 511*b*, and a wear resisting layer 514*b* is further formed thereon as by sputtering. Here, the portion called the heat generating element 511*b* refers to that portion of the resistance layer 515*b* which is between the electrode layers 512*b* and 513*b*.

As is apparent from FIGS. 52A-52C, the width of the electrodes at the junctions between the heat generating element 511*b* and the electrodes 512*b* and 513*b* is smaller than the width of the heat generating element 511*b*, and the wear resisting layer 514*b* corresponding to the width of these electrodes 512*b* and 513*b* protrudes with the junctions between the heat generating element 511*b* and the electrodes 512*b* and 513*b* as the vertices and therefore, the shape of the heat generating element 511*b* in this portion is convex.

Figure 53A:
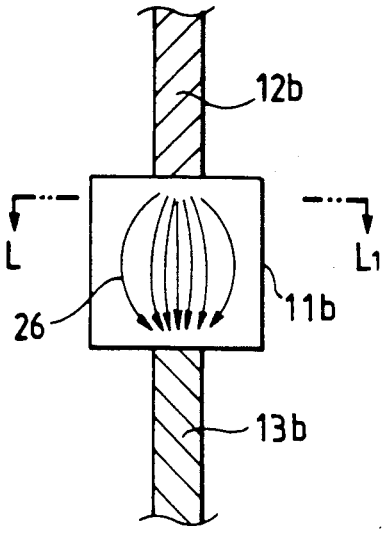
FIG. 53A shows the distribution of an electric current flowing through the heat generating element in the seventeenth embodiment.

FIG. 53A shows the flow of the electric current when a pulse voltage is applied to the heat generating element 511*b* of the thermal head 525 shown in FIGS. 52A-52C, through the electrodes 512*b* and 513*b* which are narrower than the width of the heat generating element 511*b*. In FIG. 53A, the reference numeral 526 designates the electric current flowing through the heat generating element 511*b*, and the density of the electric current flowing through the heat generating element 511*b* is great near the junctions between the narrow electrodes 512, 513*b* and the heat generating element 511*b*.

Figure 53B:
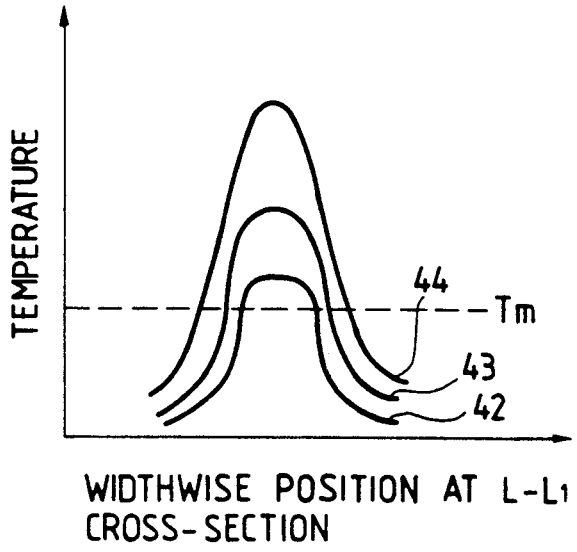
FIG. 53B shows the heat generation distribution in the cross-section $G-G_1$ of FIG. 53A.

FIG. 53B is a graph showing the temperature distribution in that portion of the heat generating element 511*b* which is near the electrode 512*b* (at the cross-section L-$L_1$ of FIG. 53A).

The temperature of the vicinity of the electrode 512*b* (or the electrode 513*b*) (the vicinity of the junctions) is particularly high in the heat generating element 511*b*, and the temperature difference of this portion from the other portion of the heat generating element 511*b* exhibits a great value. As the time of application of the pulse signal applied to the heat generating element 511*b* is gradually lengthened to change the applied energy to the heat generating element 511*b*, the widthwise temperature distribution at the cross-section L-$L_1$ of the heat generating element 511*b* varies as indicated by curves 542→543→544 in FIG. 53B. In FIG. 53B, Tm indicates the melting point of the ink of the ink sheet 132 (FIG. 16), and in a temperature area higher than this, the ink of the ink sheet 132 is melted and transferred to the recording sheet 133 (FIG. 16).

Here, the thermal head 525 is of a shape in which the wear resisting layer 514*b* thereof is protuberant with the junctions between the heat generating element 511*b* and the electrodes 512*b*, 513*b* as the vertices and the central portion of the heat generating element 511*b* is somewhat concave and therefore, the pressure force applied to between the thermal head 525 and the recording sheet concentrates in and near the junctions between the electrodes 512*b*, 513*b* and the heat generating element 511*b*. Also, the wear resisting layer 514*b* is thicker in that portion, whereby the heat accumulation in that portion becomes great and therefore, the concentration effect of the heat generation temperature becomes more remarkable. Thus, it becomes easier for the ink of the ink sheet in this portion to be transferred.

Figure 53C:
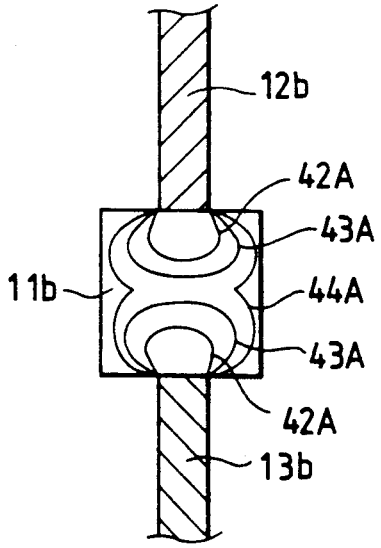
FIG. 53C shows the transfer area corresponding to applied energy to the heat generating element in the seventeenth embodiment.

As a result, the temperature area (the transfer area) of the heat generating element 511*b* of the thermal head 525 in which the temperature becomes higher than the melting point Tm of the ink of the ink sheet as shown in FIG. 53C becomes such as shown by 542A, 43A and 544A in FIG. 53C correspondingly to the temperature distribution of FIG. 53B. Also, the shape of the heat generating element 511*b* is convex as shown in FIGS. 52A-52C and therefore, this thermal head becomes excellent in the transfer and reproducibility in the low recording density area wherein the dot area is small. The relation between the applied energy and the recording density by the thus formed thermal head 525 is as shown in FIG. 50.

This thermal head 525 is also excellent in durability, because generally, the deterioration of a thermal head due to the friction between the thermal head and a recording sheet (or an ink sheet) tends to progress more rapidly as the temperature of the head becomes higher. In contrast, in the heat generating element 511*b* of the thermal head 525 according to this embodiment, heat generation takes place concentratedly and the wear resisting layer 514*b* in the vicinity of the junctions between the electrodes 512*b*, 513*b* and the heat generating element 511*b* wherein the temperature rises is made thicker and therefore, the thermal head 525 as a whole is excellent in wear resistance.

DESCRIPTION OF EIGHTEENTH EMBODIMENT (FIG. 54)

Figure 54A:
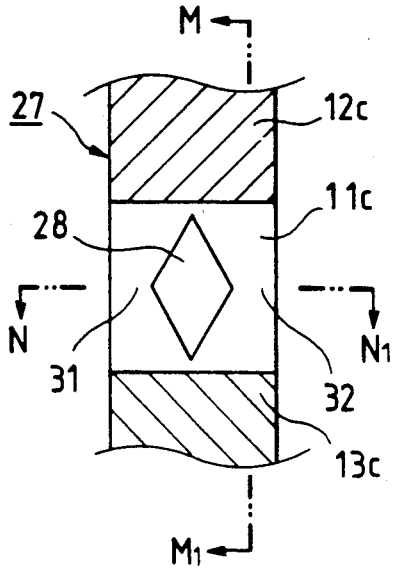
FIGS. 54A-54C show the shapes of the heat generating element and the electrodes in an eighteenth embodiment.
Figure 54B:
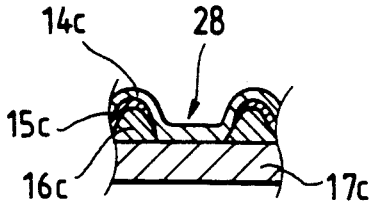
Figure 54C:
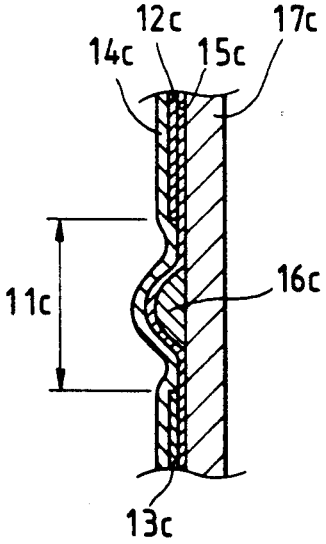

FIG. 54 shows the shapes of a heat generating element 511*c* and the electrodes 512*c* and 513*c* of a thermal head 527 according to an eighteenth embodiment, FIG. 54A being an enlarged front view thereof, FIG. 54B being a cross-sectional view showing the cross-section N-$N_1$ of FIG. 54A, and FIG. 54C being a cross-sectional view showing the cross-section M-$M_1$ of FIG. 54A.

The reference numeral 528 designates a depression provided substantially at the center of the heat generating element 511*c*, and in this portion, a wear resisting layer 514*c* is only laminated directly on an alumina substrate 517*c* and therefore, the electric current flowing between the electrodes 512*c* and 513*c* concentrates in the vicinity of the opposite end portions 531 and 532 of the depression 528 and the density of the electric current in this portion becomes great. In these portions 531 and 532 wherein the density of the electric current becomes great, the thickness of a glaze layer 516*c* is increased to cause the glaze layer to protrude with respect to its surroundings (FIGS. 54B and 54C). Thus, the pressure force between the thermal head 527 and the recording sheet concentrates in this portion, and by the thickness of the glaze layer 516*c* in these portions being made great, the heat accumulation in the heat generating central portion becomes great and the concentration effect of the heat generating energy becomes more remarkable. As a result, the transfer area widens about these portions 531 and 532, and by varying the applied energy, the transferred area can be varied as shown in FIG. 55.

Figure 55:
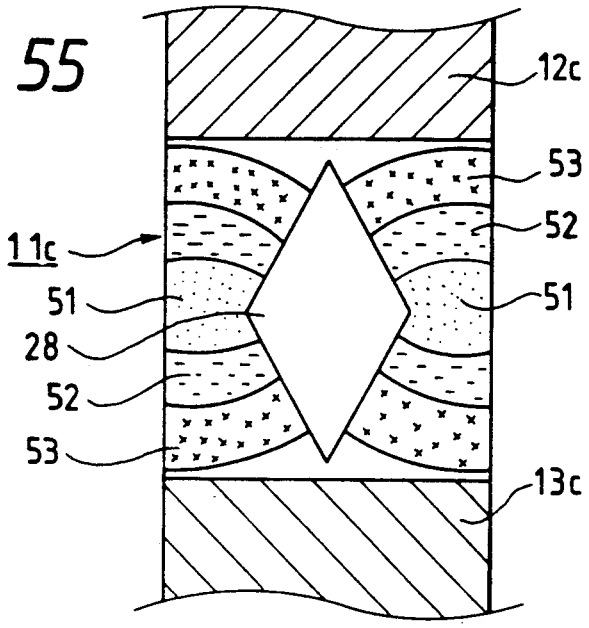
FIG. 55 shows the transfer area when the applied energy by the heat generating element in the eighteenth embodiment is changed.

In FIG. 55, the reference numerals 551-553 designate transfer areas relative to each applied energy, and by thus changing the transfer areas by the heat generating element 511*c*, half tone expression becomes possible. In order to adjust the thickness of the glaze layer, fine particles such as inorganic particles (alumina particles or the like) may be added to the portion to be thickened.

DESCRIPTION OF NINETEENTH EMBODIMENT (FIG. 56)

Figure 56A:
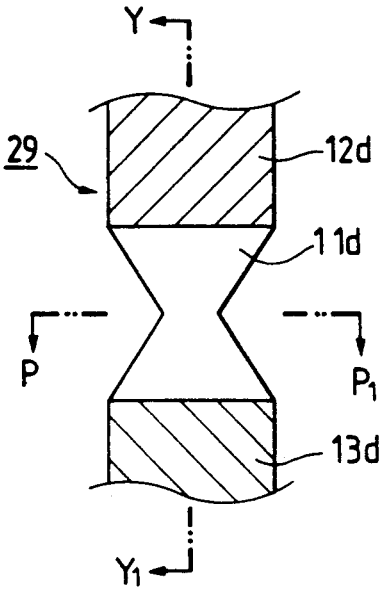
FIGS. 56A-56C show the shapes of the heat generating element and the electrodes in a nineteenth embodiment.
Figure 56B:
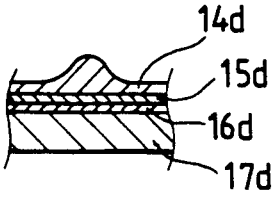
Figure 56C:
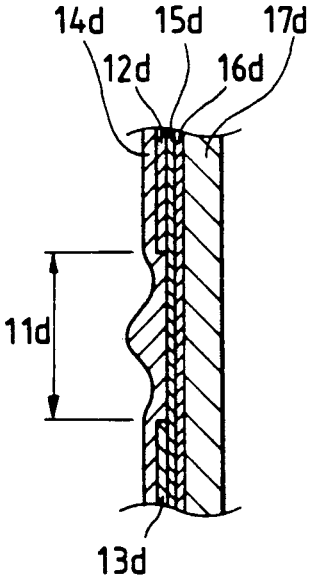

FIGS. 56A-56C show the shapes of a heat generating element 511*d* and the electrodes 512*d* and 513*d* of a thermal head 529 according to a nineteenth embodiment, FIG. 56A being an enlarged front view thereof, FIG. 56B being a cross-sectional view showing the cross-section P-$P_1$ of FIG. 56A, and FIG. 56C being a cross-sectional view showing the cross-section Y-$Y_1$ of FIG. 56A.

This heat generating element 511*d* is constricted at the center thereof and therefore, the electric current flowing from the common electrode 512*d* to the signal electrode 513*d* concentrates in this constricted portion. So, the thickness of a wear resisting layer 514*d* in this portion wherein the density of the electric current becomes great is made great to cause the wear resisting layer 514*d* to protrude with respect to its surroundings. Thereby, the pressure force to the recording sheet or the like in this protruded portion is increased and the transfer property is improved. Also, by the wear resisting layer 514*d* in the central portion which is the center of heat generation being made thick, the heat accumulation in this portion becomes great and therefore, the concentration effect of the heat generating energy becomes more remarkable and it becomes easier for the ink of the ink sheet to be transferred.

Thus, by varying the applied energy to the thermal head, the dot area transferred can be varied as indicated by 561-563 in FIGS. 56A-56C to thereby accomplish half tone expression. Also, since the wear resisting layer 514*d* in the heat generating central portion is made thick as described with respect to the previous embodiment, this head is excellent in durability.

DESCRIPTION OF TWENTIETH EMBODIMENT (FIG. 58)

Figure 58A:
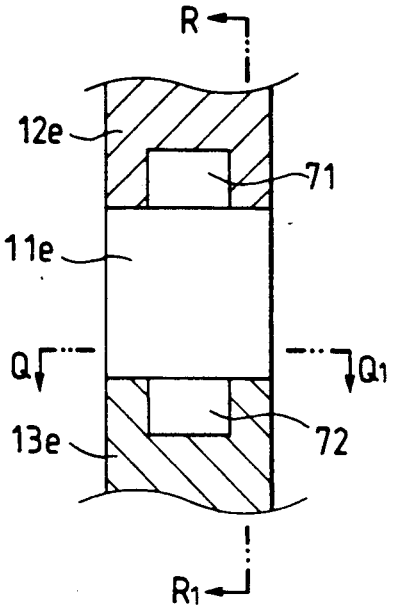
FIGS. 58A-58C show the shapes of the heat generating element and the electrodes in a twentieth embodiment.
Figure 58B:
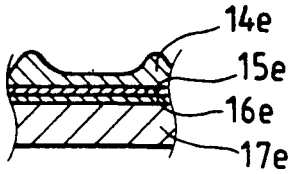
Figure 58C:
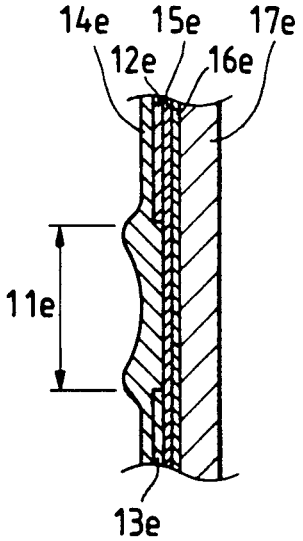

FIGS. 58A-58C show the shapes of a heat generating element 511*e* and the electrodes 512*e* and 513*e* of a thermal head according to a twentieth embodiment, FIG. 58A being an enlarged front view thereof, FIG. 58B being a cross-sectional view showing the cross-section Q-$Q_1$ of FIG. 58A, and FIG. 58C being a cross-sectional view showing the cross-section R-$R_1$ of FIG. 58A.

In the figures, the reference numerals 571 and 572 denote insulating portions provided near the junctions between the electrodes 512*e*, 513*e* and the heat generating element 511*e* and thus, the electric current flowing through the heat generating element 511*e* concentrates in the portions wherein the electrodes 512*e* and 513*e* are connected to the heat generating element 511*e* (the four corners of the heat generating element 511*e*). So, the portions of a wear resisting layer 514*e* which correspond to these portions in which the density of the electric current becomes great are made thick to cause said portions to protrude with respect to the surroundings thereof. For the same reason as that set forth in the previous embodiment, the area transferred by this thermal head varies and half tone expression becomes possible, and by the wear resisting layer 514*e* in this heat generating central portion being made thick, the durability of the thermal head can also be improved.

DESCRIPTION OF TWENTY-FIRST EMBODIMENT (FIG. 59)

Figure 59A:
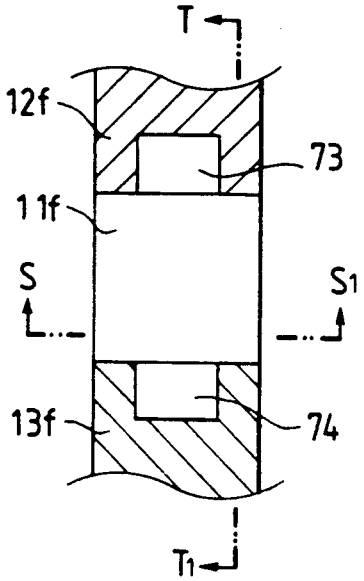
FIGS. 59A-59C show the shapes of the heat generating element and the electrodes in a twenty-first embodiment.
Figure 59B:
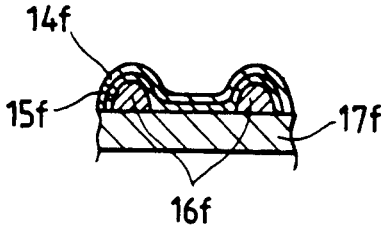
Figure 59C:
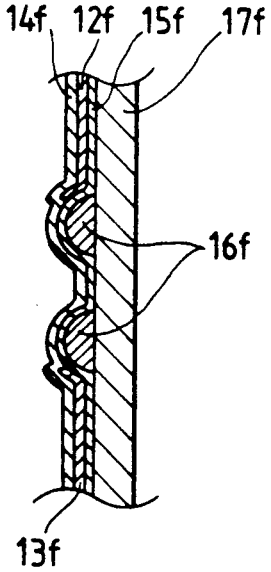

FIGS. 59A-59C show the shapes of a heat generating element 511*f* and the electrodes 512*f* and 513*f* of a thermal head according to a twenty-first embodiment, FIG. 59B being a cross-sectional view showing the cross-section S-$S_1$ of FIG. 59A, and FIG. 59C being a cross-sectional view showing the cross-section T-$T_1$ of FIG. 59A.

In FIGS. 59A-59C, the reference numerals 573 and 574 designate insulating portions and thus, the electric current flowing through the heat generating element 511*f* concentrates in the portions wherein the electrodes 512*f* and 513*f* are connected to the heat generating element 511*f* (the four corners of the heat generating element 511*f*), and these portions become the center of heat generation. Accordingly, a glaze layer 516*f* in these portions which are the center of heat generation is made thick to cause the glaze layer to protrude with respect to its surroundings. Thus, in the same manner as that described in the previous embodiment, the applied energy can be changed to thereby change the transfer area and realize half tone expression by area harmony.

Figure 60A:
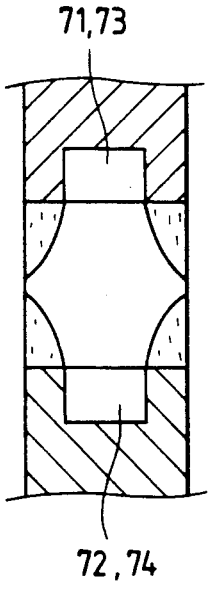
FIGS. 60A-60C show the transfer area when the applied energy by the heat generating elements in the twentieth and twenty-first embodiments is changed.
Figure 60B:
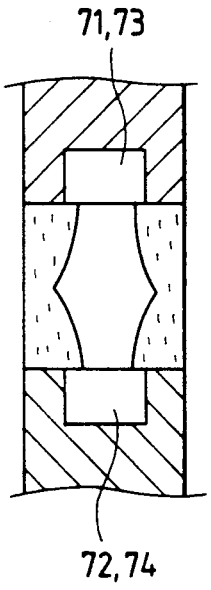
Figure 60C:
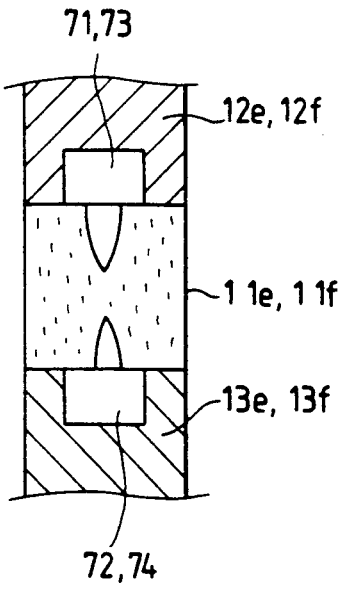

FIGS. 60A-60C shows the transfer area by the heat generating element shown in FIGS. 58A-58C or FIGS. 59A-59C correspondingly to the applied energy thereto. In these figures, the transfer area widens from the four corners of the heat generating element 511*e* (511*f*) correspondingly to the amount of applied energy. By thus adjusting the applied energy, the transfer area can be changed to accomplish harmony expression.

As described above, in the thermal head according to the present embodiment, the glaze layer in the heat generating central portion of the heat generating element is made thick and the heat accumulation effect and the pressure force to the ink sheet, etc. are increased, whereby harmony expression can be accomplished with good accuracy correspondingly to the applied energy.

Also, in the thermal head according to the present embodiment, the density of the electric current flowing through the heat generating element is endowed with a variation, and the wear resisting layer in the portion wherein the density of the electric current becomes great is made thick to cause the wear resisting layer to protrude with respect to its surroundings, whereby the pressure force and the heat accumulation effect of the head are increased and accurate harmony expression for the applied energy can be accomplished.

The thermal heads according to the aforedescribed first to twenty-first embodiments can be applied to the heat transfer recording apparatus shown in FIGS. 10-12. The thermal heads are controlled along the timing of the driving and strobe signals shown in FIG. 13 and also, the recording process is carried out along the flow chart shown in FIG. 14. Accordingly, FIGS. 10-14 and the description thereof are invoked as the description of each embodiment of the heat transfer recording apparatus in each of the aforedescribed embodiments.

In each of the aforedescribed embodiments, as the electrodes, use can be made, for example, of aluminum, gold, copper or the like, and as the resistance members, use can be made, for example, nickel chromium polysilicon, tantalum nitride, tantalum or the like.

While in each of the above-described embodiments, the thermal recording system using a thermal head has been described as an example, the present invention is not restricted thereto, but of course can also be applied to a recording system using heat to effect image recording, such as the ink jet recording system using heat to discharge ink liquid and thereby accomplish image recording.

That is, the present invention can of course be applied to a recording head which can accomplish image recording with the heat generating elements thereof caused to generate heat and to a recording apparatus provided with such recording head. So, the present invention can of course be applied, for example, to an ink jet recording apparatus or the like in which ink is caused to fly with heat generating elements caused to generate heat to thereby accomplish image recording. Of course, the present invention can also be applied to the bubble jet recording system in which at least one driving signal for providing a rapid temperature rise exceeding nuclear boiling is applied to electrothermal converting members as heat generating elements to thereby create heat energy in the electro-thermal converting members and the heat-acting surface of the recording head is film-boiled to form a bubble in ink and by the growth and contraction of this bubble, the ink is discharged through discharge openings. Accordingly, the recording head is not limited to a thermal head, but includes, for example, an ink jet head or the like.

As described above, according to each of the aforedescribed embodiments, there can be provided a thermal head which is formed so that a difference may be provided in the density of the electric current flowing through the heat generating element and in which the applied energy in varied, whereby the heat generation temperature distribution can be changed easily.

Also, there can be provided a heat transfer recording apparatus in which the heat generating area of the thermal head is changed correspondingly to the degree of harmony of image data to change the transfer area, thereby resulting in good reproducibility of harmony.

As described above, in the recording head according to each of the aforedescribed embodiments, the recording density can be reliably changed by changing the applied energy and therefore, this recording head is suitable for half tone recording and also is excellent in durability.

Also, according to the heat transfer recording apparatus of the present invention, multivalue recording is possible and recording at multiharmony can be realized easily.

As described above, according to the present invention, there can be provided a recording head which can accomplish clear-cut half tone recording and a recording apparatus provided with such recording head.

I claim:

1. A recording head for use in a recording apparatus for effecting recording on a recording medium, having a plurality of heat generating elements and electrodes for applying energy to said heat generating elements, characterized in that when the effective width of said heat generating elements is Wr and the width of the electrodes connected to said heat generating elements is We, $1/10 \leqq We/Wr \leqq \frac{1}{2}$, and when the length, in the direction of an electric current, of the portion of said heat generating elements in which the current distribution becomes finest is L, the condition that $\frac{1}{4} \leqq L/Wr \leqq 3/2$ is satisfied.

2. A recording head according to claim 1, wherein the junctions between said heat generating elements and said electrodes overlap each other.

3. A recording apparatus for effecting recording on a recording medium, having:

a recording head having a plurality of heat generating elements and electrodes for applying energy to said heat generating elements, and having a construction in which when the effective width of said heat generating elements is Wr and the width of the electrodes connected to said heat generating elements is We, $1/10 \leqq We/Wr \leqq \frac{1}{2}$, and when the length, in the direction of an electric current, of the portion of said heat generating elements in which the current distribution becomes roughest and the portion of said heat generating elements in which the current distribution becomes finest is L, the condition that $\frac{1}{4} \leqq L/Wr \leqq 3/2$ is satisfied;

control means for controlling the applied energy to said recording head; and conveying means for conveying said recording medium.

4. A recording head provided with a plurality of heat generating resistance members arranged in a row, and electrodes for supplying electrical energy to respective ones of said plurality of heat generating resistance members, characterized in that when the effective width of said heat generating resistance members is Wr and the width of the electrodes connected to said heat generating resistance members is We, $1/10 \leqq We/Wr \leqq \frac{1}{2}$, and when the length, in the direction of an electric current, of the portion of said heat generating resistance members in which the current distribution becomes roughest and the portion of said heat generating resistance members in which the current distribution becomes finest is L, the condition that $\frac{1}{4} \leqq L/Wr \leqq 3/2$ is satisfied.

5. A recording head according to claim 4, wherein the electrode portion connected to said heat generating resistance members comprises a common electrode and a signal electrode, and at least one of said common electrode and said signal electrode is narrower than the width of said heat generating resistance members.

6. A recording head according to claim 5, wherein each of said heat generating resistance members is substantially equally divided into at least two common electrode side and signal electrode side portions, and said divided portions are connected together by a conductor portion narrower than the effective width of said heat generating resistance members.

7. A heat recording apparatus characterized by:

a recording head provided with a plurality of heat generating resistance members arranged in row, and electrodes for supplying electrical energy to respective ones of said plurality of heat generating resistance members, and having a shape in which when the effective width of said heat generating resistance members is Wr and the width of the electrodes connected to said heat generating resistance members is We, $1/10 \leqq We/Wr \leqq \frac{1}{2}$ and when the length, in the direction of an electric current, of the portion of said heat generating resistance members in which the current distribution becomes roughest and the portion of said heat generating resistance members in which the current distribution becomes finest is L, the condition that $\frac{1}{4} \leqq L/Wr \leqq 3/2$ is satisfied;

harmony determining means for receiving a multivalue image signal as an input and determining the degree of harmony of each of said heat generating resistance members of said recording head correspondingly to the degree of harmony of said image signal; and recording means for electrically energizing each of said heat generating resistance members in accordance with said degree of harmony and effecting recording.

8. A recording head for use in a recording apparatus for effecting recording on a recording medium, having;

a plurality of heat generating elements, each said element having an effective width $W_r$;

electrodes for applying energy to said heat generating elements, each said electrode having a width $W_e$, $1/10 \leqq W_e/W_r \leqq \frac{1}{2}$; and an electrical conductor provided on said heat generating elements.

9. A recording apparatus for effecting recording on a recording medium, having:

a recording head provided with a plurality of heat generating elements, each said element having an effective width $W_r$, electrodes for applying energy to said heat generating elements, each said electrode having a width $W_e$, $1/10 \leqq W_e/W_r \leqq \frac{1}{2}$, and an electrical conductor provided on said heat generating elements;

control means for controlling the applied energy to said recording head; and conveying means for conveying said recording medium.

10. A recording head provided with a plurality of heat generating resistance members arranged in a row, each said member having an effective width $W_r$, and electrodes for supplying electrical energy to respective ones of said plurality of heat generating resistance members, each said electrode having a width $W_e$, characterized in that the heat generating portion is formed by said heat generating resistance members and at least one electrical conductor narrower than the width of said heat generating resistance members or an electrical conductor portion provided on said heat generating resistance member, wherein $1/10 \leqq W_e/W_r \leqq \frac{1}{2}$.

11. A recording head according to claim 10, characterized in that a glaze layer near said narrow electrical conductor is of a shape in which it protrudes with respect to its surroundings with the vicinity of the junctions between said heat generating resistance members and said electrodes as the vertices.

12. A recording head provided with a plurality of heat generating resistance members arranged in a row, each having an effective width $W_r$, and electrodes for supplying electrical energy to respective ones of said plurality of heat generating resistance members, each having a width $W_e$, characterized in that an electrical conductor portion much lower in resistance value than said heat generating resistance members is provided at a location which is within said heat generating resistance members and which is not in contact with said electrodes, $1/10 \leqq W_e/W_r \leqq \frac{1}{2}$.

13. A heat recording apparatus characterized by:

a recording head provided with a plurality of heat generating resistance members arranged in a row, each said member having an effective width $W_r$, and electrodes for supplying electrical energy to respective ones of said plurality of heat generating resistance members, each having a width $W_e$, said heat generating resistance members including at least one narrow portion narrower than the width of said heat generating resistance members, said narrow portion being formed by an electrical conductor or an electrical conductor provided on said heat generating resistance members, $1/10 \leqq W_e/W_r \leqq \frac{1}{2}$;

harmony determining means for receiving a multi-value image signal as an input and determining the degree of harmony of image data recorded by each heat generating element of said recording head correspondingly to the degree of harmony of said image signal; and recording means for electrically energizing each heat generating element of said recording head in accordance with said degree of harmony and effecting recording.

14. A recording head provided with a heat generating element, said element having an effective width $W_r$, and electrode for supplying electrical energy to said heat generating element, said electrode having a width $W_e$, characterized in that $1/10 \leqq W_e/W_r \leqq \frac{1}{2}$ and the shape of said heat generating element or said electrode is formed so that the density of an electric current flowing through said heat generating element becomes rough and fine, and in the portion wherein the density of said electric current becomes fine, a glaze layer is protruded with respect to its surroundings.

15. A recording head according to claim 14, wherein said glaze layer is protuberant with the vicinity of the junction between said heat generating element and said electrode as the vertex, and is concave in the central portion of said heat generating element.

16. A heat transfer recording apparatus characterized by:

a recording head in which the shape of a heat generating element, said element having an effective width $W_r$, or an electrode, said electrode having a width $W_e$, and $1/10 \leqq W_e/W_r \leqq \frac{1}{2}$, formed so that the density of an electric current flowing through said heat generating element becomes rough and fine, and in the portion wherein the density of said electric current becomes fine, a glaze layer is protruded with respect to its surroundings;

harmony determining means for receiving a multi-value image signal as an input and determining the degree of harmony of each heat generating element of said recording head correspondingly to the degree of harmony of said image signal; and recording means for electrically energizing each heat generating element of said recording head in accordance with said degree of harmony and effecting recording.

17. A heat transfer recording apparatus according to claim 16, wherein said glaze layer of said recording head is protuberant with the vicinity of the junction between said heat generating element and said electrode as the vertex, and is concave in the central portion of said heat generating element.

18. A recording head provided with a plurality of heat generating resistance members arranged in a row, each said member having an effective width $W_r$, and electrodes for supplying respective ones of said plurality of heat generating resistance members, each having a width $W_e$, characterized in that $1/10 \leqq W_e/W_r \leqq \frac{1}{2}$ and the width of said electrodes at the junctions thereof with said heat generating resistance members is smaller than the effective width of said heat generating resistance members, and the width of said electrodes in the portion thereof remote from said junctions is greater than the width of said electrodes at said junctions.

19. A recording head according to claim 18, wherein the width of said electrode is greater than the width of said electrodes at said junctions and the distance to said portion is within the range of 0.1 μm to 3 mm from said junctions.

20. A recording head provided with a plurality of heat generating resistance members arranged in a row, each said member having an effective width $W_r$, and electrodes for supplying electrical energy to respective ones of said plurality of heat generating resistance members, each said electrode having a width $W_e$, characterized in that $1/10 \leqq W_e/W_r \leqq \frac{1}{2}$ and the width of said electrodes at the junctions thereof with said heat generating members is smaller than the effective width of said heat generating resistance members, the width of said electrodes in the portion thereof remote from said junctions is greater than the width of said electrodes at said junctions, and a portion of said electrodes is adjacent to said heat generating resistance members in an electrically insulated condition.

21. A heat recording apparatus characterized by:

a recording head provided with a plurality of heat generating resistance members arranged in a row, each said member having an effective width $W_r$, and electrodes for supplying electrical energy to respective ones of said plurality of heat generating resistance members, each said electrode having a width $W_e$, the width of said electrodes at the junctions thereof with said heat generating resistance members being smaller than the effective width of said heat generating resistance members, the width of said electrodes in the portion thereof remote from said junctions being greater than the width of said electrodes at said junctions, $1/10 \leqq W_e/W_r \leqq \frac{1}{2}$ and;

harmony determining means for receiving a multi-value image signal as an input and determining the degree of harmony of image data recorded by each heat generating element of said recording head correspondingly to the degree of harmony of said image signal; and recording means for electrically energizing each heat generating element of said recording head in accordance with said degree of harmony and effecting recording.

22. A recording head provided with a plurality of heat generating resistance members arranged in a row, each said member having an effective width $W_r$, and electrodes for supplying electrical energy to respective ones of said plurality of heat generating resistance members, each said electrode having a width $W_e$, characterized in that $1/10 \leqq W_e/W_r \leqq \frac{1}{2}$ and the width of said electrodes at the junctions thereof with said heating generating resistance members is smaller than the effective width of said heat generating resistance members, and the resistance value of said heat generating resistance members is higher near said junctions.

23. A recording head according to claim 22, wherein said heat generating resistance members are of a shape in which a level difference is provided so that the width or thickness of said heat generating resistance members is greater in the central portion of said heat generating resistance members so that the resistance value of said heat generating resistance members may vary non-continuously along the path of an electric current.

24. A recording head according to claim 23, wherein a glaze layer in the portion thereof corresponding to the central portion of said heat generating resistance members is made thin.

25. A heat recording apparatus characterized by:

a recording head provided with a plurality of heat generating resistance members arranged in a row, each said member having an effective width $W_r$, and electrodes for supplying electrical energy to respective ones of said plurality of heat generating resistance members, the width of said electrodes at the junctions thereof with said heat generating resistance members being smaller than the effective width of said heat generating resistance members, the resistance value of said heat generating resistance members being higher near said junctions, $1/10 \leqq W_e/W_r \leqq \frac{1}{2}$;

harmony determining means for receiving a multi-value image signal as an input and determining the degree of harmony of image data recorded by each heat generating element of said recording head correspondingly to the degree of harmony of said image signal; and recording means for electrically energizing each heat generating element of said recording head in accordance with said degree of harmony and effecting recording.

26. A recording head characterized by:

a plurality of heat generating resistance members arranged in a row, each said member having an effective width $W_r$;

electrodes narrower than the effective width of said heat generating resistance members and for supplying electrical energy to respective ones of said heat generating resistance members, each said electrode having a width $W_e$, $1/10 \leqq W_e/W_r \leqq \frac{1}{2}$; and a glaze layer which is thick in the portions wherein said heat generating resistance members and said electrodes are connected together, and thin substantially in the central portion of said heat generating resistance members.

27. A recording head characterized by:

a plurality of heat generating resistance members arranged in a row, each said member having an effective width $W_r$;

electrodes narrower than the effective width of said heat generating resistance members and for supplying electrical energy to respective ones of said heat generating resistance members, each said electrode having a width $W_e$, $1/10 \leqq W_e/W_r \leqq \frac{1}{2}$; and a wear resistant layer which is convex in the portions wherein said heat generating resistance members and said electrodes are connected together.

28. A heat recording apparatus characterized by:

a recording head having a plurality of heat generating resistance members arranged in a row, each said member having an effective width $W_r$, electrodes narrower than the effective width of said heat generating resistance members and for supplying electrical energy to respective ones of said heat generating resistance members, each said electrode having a width $W_e$, $1/10 \leqq W_e/W_r \leqq \frac{1}{2}$, and a glaze layer which is thick in the portions wherein said heat generating resistance members and said electrodes are connected together, and thin substantially in the central portion of said heat generating resistance members;

harmony determining means for receiving a multi-value image signal as an input and determining the degree of harmony of image data recorded by each heat generating element of said recording head correspondingly to the degree of harmony of said image signal; and recording means for electrically energizing each heat generating element of said recording head in accordance with said degree of harmony and effecting recording.

29. A recording element for recording on a recording medium, comprising:

a signal electrode having a signal electrode width ($W_{es}$);

a common electrode having a common electrode width ($W_{ec}$); and a heat generating element having a length ($L_{er}$) and a width ($W_r$), wherein $1/10 \leqq ((W_{es}$ and/or $W_{ec})/W_r) \leqq \frac{1}{2}$, said signal electrode and said common electrode each being in electrically-conductive contact with said heat generating element so that when an electric current passes between said signal electrode, said heat-generating element, and said common electrode, said heat-generating element increases in temperature.

30. A recording element as in claim 29 wherein said recording element can be used in ink jet recording.

31. A recording head as in claims 1, 4, 8, 10, 12, 14, 18, 20, 22, 26 or 27 wherein said recording head can be used in ink jet recording.

32. A recording apparatus as in claims, 3, 7, 9, 13, 16, 21, 15 or 28 wherein said recording head can be used in ink jet recording.

* * * * *

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

IN THE DRAWINGS:

SHEET 25 OF 40

FIG. 40, elements "10", "11", "12", "12a", "13" and "13a" should read --410--, --411--, --412--, --412a--, --413-- and --413a--.

FIG. 41, elements "11", "12", "13", "14", "15a", "15b", "15c", "16" and "17" should read --411--, --412--, --413--, --414--, --415a--, --415b--, --415c--, --416-- and --417--.

SHEET 26 OF 40

Fig. 42A, elements "11", "12", "12a", "13", "13a" and "20" should read --411--, --412--, --412a--, --413--, --413a-- and --420--.

FIG. 42B, elements "42", "43" and "44" should read --442--, --443-- and --444--.

FIG. 42C, elements "42a", "43a" and "44a" should read --442a--, --443a-- and --444a--.

SHEET 27 OF 40

FIG. 43, "elements "11", "12", "13", "42b", "43b" and "44b" should read --411--, --412--, --413--, --442b--, --443b-- and --444b--.

SHEET 28 OF 40

FIG. 45, elements "11a", "12b", "13b" and "21" should read --411a--, --412b--, --413b-- and --421--.

--

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

SHEET 28 OF 40 (con't)

Figure 46A:
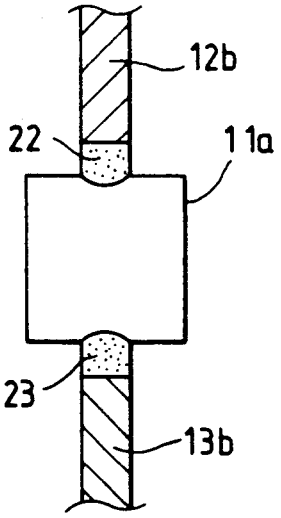
FIGS. 46A and 46B show the heat generation temperature distribution in the heat generating element in the thirteenth embodiment.

FIG. 46A, elements "11a", "12b", "13b", "22" and "23" should read --411a--, --412b--, --413b--, --422-- and --423--.

Figure 46B:
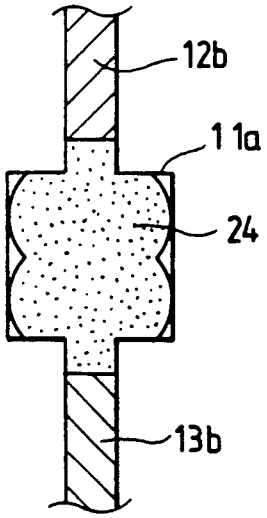

FIG. 46B, elements "11a", "12b", "13b" and "24" should read --411a--, --412b--, --413b-- and --424--.

SHEET 29 OF 40

FIG. 47, elements "11b", "12c", "13c" and "27" should read --411b--, --412c--, --413c-- and --427--.

FIG. 48A, elements "10", "11", "12" and "13" should read --510--, --511--, --512-- and --513--.

FIG. 48B, elements "14", "15", "16" and "17" should read --514--, --515--, --516-- and --517--.

FIG. 48C, elements "11", "12", "13", "14", "15", "16" and "17" should read --511--, --512--, --513--, --514--, --515--, --516-- and --517--.

SHEET 30 OF 40

FIG. 49A, elements "11", "12", "13" and "20" should read --511--, --512--, --513-- and --520--.

FIG. 49B, elements "21", "22" and "23" should read --521--, --522-- and --523--.

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

SHEET 31 OF 40

FIG. 49C, elements "11", "12", "13", "21A", "22A" and "23A" should read --511--, --512--, --513--, --521A--, --522A-- and --523A--.

SHEET 32 OF 40

FIG. 51A, elements "11a", "12a", "13a" and "24" should read --511a--, --512a--, --513a-- and --524--.

FIG. 51B, elements "14a", "15a", "16a" and "17a" should read --514a--, --515a--, --516a-- and --517a--.

FIG. 51C, elements "11a", "12a", "13a", "14a", "15a", "16a" and "17a" should read --511a--, --512a--, --513a--, --514a--, --515a--, --516a-- and --517a--.

SHEET 33 OF 40

FIG. 52A, elements "11b", "12b", "13b" and "25" should read --511b--, --512b--, --513b-- and --525--.

FIG. 52B, elements "14b", "15b", "16b" and "17b" should read --514b--, --515b--, --516b-- and --517b--.

FIG. 52C, elements "11b", "12b", "13b", "14b", "15b", "16b" and "17b" should read --511b--, --512b--, --513b--, --514b--, --515b--, --516b-- and --517b--.

--

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

SHEET 34 OF 40

FIG. 53A, elements "11b", "12b", "13b" and "26" should read --511b--, --512b--, --513b-- and --526--.

FIG. 53B, elements "42", "43" and "44" should read --542--, --543-- and --544--.

FIG. 53C, elements "11b", "12b", "13b", "42A", "43A" and "44A" should read --511b--, --512b--, --513b--, --542A--, --543A-- and --544A--.

SHEET 35 OF 40

FIG. 54A, elements "11c", "12c", "13c", "27", "28", "31" and "32" should read --511c--, --512c--, --513c--, --527--, --528--, --531-- and --532--.

FIG. 54B, elements "14c", "15c", "16c", "17c" and "28" should read --514c--, --515c--, --516c--, --517c-- and --528--.

FIG. 54C, elements "11c", "12c", "13c", "14c", "15c", "16c" and "17c" should read --511c--, --512c--, --513c--, --514c--, --515c--, --516c-- and --517c--.

SHEET 36 OF 40

FIG. 55, elements "11c", "12c", "13c", "28", "51", "52" and "53" should read --511c--, --512c--, --513c--, --528--, --551--, --552-- and --553--.

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

SHEET 36 OF 40 (con't)

Figure 57:
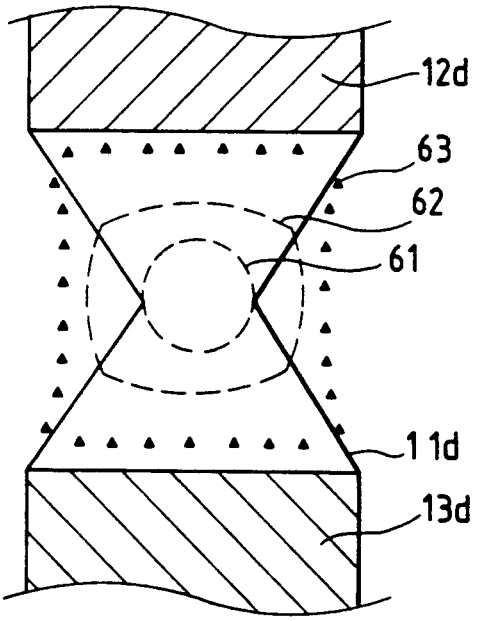
FIG. 57 shows the transfer area when the applied energy by the heat generating element in the nineteenth embodiment is changed.

FIG. 57, elements "11d", "12d", "13d", "61", "62" and "63" should read --511d--, --512d--, --513d--, --561--, --562-- and --563--.

SHEET 37 OF 40

FIG. 56A, elements "11d", "12d", "13d" and "29" should read --511d--, --512d--, --513d-- and --529--.

FIG. 56B, elements "14d", "15d", "16d" and "17d" should read --514d--, --515d--, --516d-- and --517d--.

FIG. 56C, elements "11d", "12d", "13d", "14d", "15d", "16d" and "17d" should read --511d--, --512d--, --513d-- --514d--, --515d--, --516d-- and --517d--.

SHEET 38 OF 40

FIG. 58A, elements "11e", "12e", "13e", "71" and "72" should read --511e--, --512e--, --513e--, --571-- and --572--.

FIG. 58B, elements "14e", "15e", "16e" and "17e" should read --514e--, --515e--, --516e-- and --517e--.

FIG. 58C, elements "11e", "12e", "13e", "14e", "15e", "16e" and "17e" should read --511e--, --512e--, --513e--, --514e--, --515e--, --516e-- and --517e--.

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

SHEET 39 OF 40

FIG. 59A, elements "11f", "12f", "13f", "73" and "74" should read --511f--, --512f--, --513f--, --573-- and --574--.

FIG. 59B, elements "14f", "15f", "16f" and "17f" should read --514f--, --515f--, --516f-- and --517f--.

FIG. 59C, elements "12f", "13f", "14f", "15f", "16f" and "17f" should read --512f--, --513f--, --514f--, --515f--, --516f-- and --517f--.

SHEET 40 OF 40

FIG. 60A, elements "71", "72", "73" and "74" should read --571--, --572--, --573-- and --574--.

FIG. 60B, elements "71", "72", "73" and "74" should read --571--, --572--, --573-- and --574--.

FIG. 60C, elements "11e", "11f", "12e", "12f", "13e", "13f", "71, "72", "73" and "74" should read --511e--, --511f--, --512e--, --512f--, --513e--, --513f--, --571--, --572--, --573-- and --574--.

COLUMN 1

Line 11, "half tone" should read --halftone--.
Line 26, "widthwisely" should read --widthwise--.
Line 38, "half tone" should read --halftone--.
Line 42, "half tone" should read --halftone--.

--

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

COLUMN 1

Line 46, "half tone" should read --halftone--.
Line 48, "half tone" should read --halftone--.
Line 62, "presentday" should read --present-day--.

COLUMN 2

Line 41, "of" should be deleted.

COLUMN 3

Line 2, "half tone" should read --halftone--.
Line 10, "which" should read --it--.

COLUMN 4

Line 46, "cross-section Z" should read --cross-section $Z-Z_2$--.

COLUMN 8

Line 8, "is" should read --is,--.
Line 65, "If" should read --It--.

COLUMN 9

Line 53, "half tone" should read --halftone--.
Line 55, "half tone" should read --halftone--.

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

COLUMN 10

Line 3, "measurement" should read --measurement.--.
Line 32, "heads" should read --head--.

COLUMN 11

Line 55, "half tone" should read --halftone--.

COLUMN 12

Line 28, "the least is" should read --is the least--.

COLUMN 13

Line 54, "half tone" should read --halftone--.

COLUMN 14

Line 12, "vehement" should read --severe--.
Line 14, "expause" should read --density--.
Line 16, "expause" should read --density--.

COLUMN 19

Line 66, "half tone," should read --halftone,--.
Line 67, "half tone" should read --halftone--.

COLUMN 21

Line 1, "half tone" should read --halftone--.
Line 12, "half tone" should read --halftone--.

--

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

COLUMN 23

Line 45, "half tone" should read --halftone--.
Line 46, "half tone" should read --halftone--.

COLUMN 24

Line 12, "half tone" should read --halftone--.
Line 57, "half tone" should read --halftone--.

COLUMN 25

Line 2, "half tone" should read --halftone--.
Line 51, "thermal head 311" should read --thermal head 310--.

COLUMN 26

Line 66, "half tone" should read --halftone--.
Line 67, "half tone" should read --halftone--.

COLUMN 27

Line 17, "and" should read --and,--.

COLUMN 29

Line 17, "show" should read --shows--.

COLUMN 32

Line 22, "half tone" should read --halftone--.
Line 23, "half tone" should read --halftone--.
Line 67, "half tone" should read --halftone--.

--

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

COLUMN 33

Line 20, "recorging" should read --recording--.

COLUMN 34

Line 54, "FIG. 29B." should read --FIG. 49B.--.

COLUMN 35

Line 27, "half tone" should read --halftone--.
Line 29, "half tone" should read --halftone--.

COLUMN 36

Line 5, "half tone" should read --halftone--.

COLUMN 37

Line 44, "43A" should read --543A--.

COLUMN 38

Line 38, "half tone" should read --halftone--.

COLUMN 39

Line 5, "FIGS. 56A-56C" should read --FIG. 57--.
Line 6, "half tone" should read --halftone--.
Line 35, "half tone" should read --halftone--.
Line 62, "half tone" should read --halftone--.
Line 63, "shows" should read --show--.

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

COLUMN 40

Line 34, "nickel" should read --of nickel--.

COLUMN 41

Line 2, "in" should read --is--.
Line 13, "half tone" should read --halftone--.
Line 21, "half tone" should read --halftone--.

COLUMN 42

Line 19, "in row," should read --in a row,--.

COLUMN 43

Line 52, "and" should read --an--.

COLUMN 45

Line 2, "$1/10 \leqq w_e/W_r \leqq 1/2$" should read --$1/10 \leqq w_e/W_r \leqq 1/2$;--.
Line 3, "and;" should read --;--.

--

UNITED STATES PATENT AND TRADEMARK OFFICE

CERTIFICATE OF CORRECTION

PATENT NO. : 5,142,300

DATED : August 25, 1992

INVENTOR(S) : MAKOTO AOKI

It is certified that error appears in the above-identified patent and that said Letters Patent is hereby corrected as shown below:

COLUMN 46

Line 66, "15" should read --25--.

Signed and Sealed this

Seventh Day of June, 1994

Bruce Lehman

BRUCE LEHMAN

*Commissioner of Patents and Trademarks*

*Attest:*

*Attesting Officer*